US011174090B2

(12) United States Patent
Rogers et al.

(10) Patent No.: US 11,174,090 B2
(45) Date of Patent: Nov. 16, 2021

(54) CONTAINER WITH MAGNETIC CLOSURE

(71) Applicant: YETI Coolers, LLC, Austin, TX (US)

(72) Inventors: Kyle Edward Rogers, Austin, TX (US); John Fritz, Austin, TX (US); Jeffrey Charles Munie, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 183 days.

(21) Appl. No.: 16/522,071

(22) Filed: Jul. 25, 2019

(65) Prior Publication Data

US 2019/0344951 A1 Nov. 14, 2019

Related U.S. Application Data

(63) Continuation of application No. 16/295,711, filed on Mar. 7, 2019, now Pat. No. 10,954,055, which is a continuation-in-part of application No. 16/096,206, filed as application No. PCT/US2018/021546 on Mar. 8, 2018.

(Continued)

(51) Int. Cl.

| | |
|---|---|
| ***B65D 33/16*** | (2006.01) |
| ***B65D 81/38*** | (2006.01) |
| ***A45C 13/00*** | (2006.01) |
| ***A45C 13/10*** | (2006.01) |
| ***A45C 7/00*** | (2006.01) |
| ***B65D 5/36*** | (2006.01) |
| ***B65D 33/24*** | (2006.01) |
| *A45C 11/20* | (2006.01) |

(52) U.S. Cl.

CPC ..... *B65D 81/3823* (2013.01); *A45C 7/00* (2013.01); *A45C 13/008* (2013.01); *A45C 13/103* (2013.01); *A45C 13/1069* (2013.01); *B65D 5/36* (2013.01); *B65D 33/24* (2013.01); *B65D 81/3897* (2013.01); *A45C 11/20* (2013.01); *A45C 2200/10* (2013.01); *B65D 2313/04* (2013.01)

(58) Field of Classification Search

CPC ..... A45C 13/008; A45C 7/00; A45C 13/1069; A45C 11/20; B65D 2313/04; B65D 33/24; B65D 81/3823

See application file for complete search history.

(56) References Cited

U.S. PATENT DOCUMENTS

| | | | |
|---|---|---|---|
| 1,631,371 | A | 6/1927 | Greubel |
| 1,671,385 | A | 5/1928 | Strayer |

(Continued)

FOREIGN PATENT DOCUMENTS

| | | |
|---|---|---|
| CA | 179459 A | 9/1917 |
| CA | 170760 | 7/2017 |

(Continued)

OTHER PUBLICATIONS

Jun. 6, 2020—(WO) ISR—App. No. PCT/US20/021513.

(Continued)

*Primary Examiner* — Stephen J Castellano

(74) *Attorney, Agent, or Firm* — Banner & Witcoff, Ltd.

(57) ABSTRACT

A container device that has an outer shell with an opening that is sealed by a closure mechanism. The closure mechanism can include magnetic strips that are configured to partially or wholly seal the opening.

16 Claims, 46 Drawing Sheets

Related U.S. Application Data

(60) Provisional application No. 62/468,673, filed on Mar. 8, 2017.

(56) References Cited

U.S. PATENT DOCUMENTS

| | | | |
|---|---|---|---|
| 1,712,109 | A | 5/1929 | Hammer |
| 1,809,696 | A | 6/1931 | Heilweil |
| 1,899,696 | A | 2/1933 | Freedman |
| 1,942,246 | A | 1/1934 | Johaneson |
| 1,986,057 | A | 1/1935 | Hackworth |
| 2,304,528 | A | 12/1942 | Bafia |
| 2,496,296 | A | 2/1950 | Lobl |
| 2,513,575 | A | 7/1950 | Lombard |
| 2,522,480 | A | 9/1950 | Lionel |
| 2,627,097 | A | 2/1953 | Ellis |
| 2,672,232 | A | 3/1954 | Kessell, Jr. |
| 2,784,757 | A | 3/1957 | Requa |
| 3,102,314 | A | 9/1963 | Alderfer |
| 3,111,735 | A | 11/1963 | Ellis |
| 3,161,932 | A | 12/1964 | Russell |
| 3,455,359 | A | 7/1969 | Schweizer |
| 3,716,091 | A | 2/1973 | Gaines |
| 3,749,301 | A | 7/1973 | Peckar |
| 3,827,019 | A | 7/1974 | Serbu |
| 3,831,986 | A | 8/1974 | Kobayashi |
| 3,998,304 | A | 12/1976 | Edgerton, Jr. et al. |
| 4,033,013 | A | 7/1977 | Peterson |
| D256,097 | S | 7/1980 | Amberg |
| 4,213,549 | A | 7/1980 | Hibbard |
| 4,258,493 | A | 3/1981 | Kettlestrings et al. |
| 4,399,595 | A | 8/1983 | Yoon et al. |
| 4,408,643 | A | 10/1983 | Laske et al. |
| 4,421,150 | A | 12/1983 | Masters |
| 4,489,770 | A | 12/1984 | Reich, II |
| D284,254 | S | 6/1986 | Carlson |
| 4,679,242 | A | 7/1987 | Brockhaus |
| 4,716,947 | A | 1/1988 | Haddock |
| 4,738,390 | A | 4/1988 | Brennan |
| 4,810,102 | A | 3/1989 | Norton |
| D304,008 | S | 10/1989 | Hornung |
| 4,905,857 | A | 3/1990 | Her |
| 4,911,962 | A | 3/1990 | Baumann et al. |
| 4,988,216 | A | 1/1991 | Lyman |
| 5,010,988 | A | 4/1991 | Brown |
| 5,030,013 | A | 7/1991 | Kramer |
| 5,148,580 | A | 9/1992 | Dyckow |
| 5,181,555 | A | 1/1993 | Chruniak |
| 5,196,818 | A | 3/1993 | Anderson |
| 5,216,900 | A | 6/1993 | Jones |
| 5,226,540 | A | 7/1993 | Bradbury |
| 5,237,838 | A | 8/1993 | Merritt-Munson |
| 5,244,136 | A | 9/1993 | Collaso |
| D343,288 | S | 1/1994 | Chao |
| D350,689 | S | 9/1994 | Chao |
| 5,370,622 | A | 12/1994 | Livingston et al. |
| 5,372,429 | A | 12/1994 | Beaver, Jr. et al. |
| 5,505,305 | A | 4/1996 | Scholz et al. |
| D372,173 | S | 7/1996 | Fukuda et al. |
| 5,540,366 | A | 7/1996 | Coomber |
| 5,604,960 | A | 2/1997 | Good |
| D381,506 | S | 7/1997 | Roeder |
| 5,645,205 | A | 7/1997 | Kennedy |
| D386,611 | S | 11/1997 | Sheu |
| 5,682,653 | A | 11/1997 | Berglof et al. |
| 5,706,940 | A | 1/1998 | Amarello |
| 5,746,638 | A | 5/1998 | Shiraishi |
| 5,797,683 | A | 8/1998 | Gunzi et al. |
| 5,816,709 | A | 10/1998 | Demus |
| 5,844,772 | A | 12/1998 | Lee et al. |
| 5,875,795 | A | 3/1999 | Bouix |
| D411,446 | S | 6/1999 | Cautereels |
| D412,267 | S | 7/1999 | Anderson |
| 6,067,813 | A | 5/2000 | Smith |
| 6,068,119 | A | 5/2000 | Derr et al. |
| 6,073,789 | A | 6/2000 | Lundblade |
| 6,092,707 | A | 7/2000 | Bowes, Jr. |
| 6,112,959 | A | 9/2000 | Townsend |
| 6,149,305 | A | 11/2000 | Fier |
| 6,179,677 | B1 | 1/2001 | Dornier |
| 6,223,551 | B1 | 5/2001 | Mitchell |
| 6,224,258 | B1 | 5/2001 | Dodson |
| 6,226,842 | B1 | 5/2001 | Wong |
| 6,301,754 | B1 | 10/2001 | Grunberger et al. |
| 6,336,340 | B1 | 1/2002 | Laby |
| 6,361,210 | B2 | 3/2002 | Denko |
| 6,397,560 | B1 | 6/2002 | Weder |
| D460,898 | S | 7/2002 | Wang |
| 6,412,116 | B1 | 7/2002 | Clark |
| 6,422,032 | B1 | 7/2002 | Greene |
| 6,427,475 | B1 | 8/2002 | DeFelice et al. |
| 6,434,801 | B2 | 8/2002 | Grunberger |
| D463,276 | S | 9/2002 | Piscopo et al. |
| 6,468,624 | B1 | 10/2002 | Fujisawa et al. |
| 6,470,705 | B2 | 10/2002 | Bride-Flynn |
| 6,505,385 | B2 | 1/2003 | Grunberger |
| D472,773 | S | 4/2003 | Samartgis |
| D478,782 | S | 8/2003 | Li |
| 6,601,403 | B1 | 8/2003 | Roth et al. |
| D482,529 | S | 11/2003 | Hardigg et al. |
| 6,646,864 | B2 | 11/2003 | Richardson |
| 6,659,274 | B2 | 12/2003 | Enners |
| D485,069 | S | 1/2004 | Parker |
| 6,698,608 | B2 | 3/2004 | Parker et al. |
| 6,722,784 | B2 | 4/2004 | Breil, Jr. |
| 6,742,354 | B1 | 6/2004 | Watts |
| 6,749,551 | B2 | 6/2004 | Metzler et al. |
| 6,779,199 | B1 | 8/2004 | O'Dea et al. |
| 6,821,018 | B1 | 11/2004 | Denko |
| 6,915,934 | B2 | 7/2005 | Hassett |
| 6,929,125 | B1 | 8/2005 | Seamans |
| 6,955,381 | B2 | 10/2005 | Parker et al. |
| D513,123 | S | 12/2005 | Richardson et al. |
| D513,451 | S | 1/2006 | Richardson et al. |
| D514,808 | S | 2/2006 | Morine et al. |
| D516,309 | S | 3/2006 | Richardson et al. |
| D516,807 | S | 3/2006 | Richardson et al. |
| D516,870 | S | 3/2006 | Martinez et al. |
| 7,017,776 | B1 | 3/2006 | Hupp |
| 7,033,657 | B2 | 4/2006 | Martin |
| D523,242 | S | 6/2006 | Hardigg et al. |
| D527,226 | S | 8/2006 | Maldonado |
| D529,344 | S | 10/2006 | Maldonado |
| 7,187,261 | B2 | 3/2007 | Cassar |
| D543,700 | S | 6/2007 | Parker et al. |
| D550,210 | S | 9/2007 | Polany et al. |
| 7,299,652 | B2 | 11/2007 | Gagnon |
| 7,301,303 | B1 | 11/2007 | Hulden |
| D573,844 | S | 7/2008 | Hanson et al. |
| 7,400,917 | B2 | 7/2008 | Wood et al. |
| D577,261 | S | 9/2008 | Wang |
| D578,409 | S | 10/2008 | Clark |
| 7,496,195 | B2 | 2/2009 | Kramer |
| 7,513,633 | B2 | 4/2009 | Ermeti |
| D592,910 | S | 5/2009 | Hanson et al. |
| D598,647 | S | 8/2009 | Kertesz et al. |
| D601,383 | S | 10/2009 | Shah |
| D602,740 | S | 10/2009 | Urquiola |
| D607,701 | S | 1/2010 | Pedrazzi et al. |
| D609,005 | S | 2/2010 | Dolce et al. |
| D609,056 | S | 2/2010 | Pierce |
| D609,470 | S | 2/2010 | Guyon et al. |
| 7,665,895 | B2 | 2/2010 | Takita et al. |
| D617,149 | S | 6/2010 | Olivari |
| 7,730,739 | B2 | 6/2010 | Fuchs |
| D620,249 | S | 7/2010 | Yu |
| D620,376 | S | 7/2010 | Peyser et al. |
| D620,707 | S | 8/2010 | Mogil |
| D623,406 | S | 9/2010 | Yu |
| D623,853 | S | 9/2010 | Yu |
| 7,793,782 | B2 | 9/2010 | Chuang |
| D627,199 | S | 11/2010 | Pruchnicki |
| D630,013 | S | 1/2011 | Yu |
| D630,939 | S | 1/2011 | Peters et al. |
| D632,074 | S | 2/2011 | Chan et al. |

(56) References Cited

U.S. PATENT DOCUMENTS 7,896,199 B2 3/2011 Kaczmarek
D644,024 S 8/2011 Jobert
8,005,251 B2 8/2011 Chan
D648,935 S 11/2011 Wickrama
D653,915 S 2/2012 George
D664,425 S 7/2012 Krupa
8,209,995 B2 7/2012 Kieling et al.
8,223,997 B2 7/2012 Wilson, II et al.
D668,119 S 10/2012 Everson
D670,906 S 11/2012 Du
D677,511 S 3/2013 Gray
8,399,764 B2 3/2013 Klosky
8,403,975 B2 3/2013 Hadas
8,424,680 B2 4/2013 Fair et al.
8,434,617 B1 5/2013 Wang
D688,449 S 8/2013 Schinasi
8,550,714 B2 10/2013 Ben-Shushan et al.
D693,573 S 11/2013 Holefleisch
8,573,002 B2 11/2013 Ledoux et al.
D694,521 S 12/2013 Robinson et al.
D695,015 S 12/2013 Robinson et al.
D695,568 S 12/2013 Hayes
8,607,536 B2 12/2013 Bailey et al.
D701,456 S 3/2014 Farley et al.
D703,493 S 4/2014 de Ste. Croix et al.
D708,848 S 7/2014 Zwetzig
D709,333 S 7/2014 Stamatopoulos
D709,334 S 7/2014 Stamatopoulos
8,770,402 B2 7/2014 Bergreen et al.
D727,107 S 4/2015 Parodi, Jr.
D734,643 S 7/2015 Boroski
D734,761 S 7/2015 Ballou et al.
D736,569 S 8/2015 Bronwasser et al.
9,122,941 B2 9/2015 Hoobler et al.
9,139,352 B2 9/2015 Seiders et al.
9,167,876 B2 10/2015 Yamaguchi et al.
D745,272 S 12/2015 Slimane
9,220,328 B2 12/2015 Magness
9,264,089 B2 2/2016 Tages
D751,814 S 3/2016 Louboutin
9,290,313 B2 3/2016 De Lesseux et al.
9,307,315 B2 4/2016 McKeough
9,334,087 B2 5/2016 Cho et al.
D758,805 S 6/2016 Myoung
9,392,855 B2 7/2016 Taylor
D763,569 S 8/2016 Tai
D763,629 S 8/2016 Swartz et al.
D764,791 S 8/2016 Patel
9,444,506 B2 9/2016 Lai et al.
D780,524 S 3/2017 Jacobsen
D787,821 S 5/2017 Liu
D811,738 S 3/2018 Dumas
D824,664 S 8/2018 Munie
D825,913 S 8/2018 Barlier
D827,299 S 9/2018 Vickery
D828,112 S 9/2018 Furneaux et al.
D835,949 S 12/2018 Triska et al.
10,229,395 B2 3/2019 Smith et al.
D847,499 S 5/2019 Dumas
D850,100 S 6/2019 Oviedo-Polanco
10,373,128 B2 8/2019 Smith et al.
D861,338 S 10/2019 Seiders et al.
2001/0051378 A1 12/2001 Radmacher et al.
2002/0012480 A1 1/2002 Konno
2004/0165332 A1 8/2004 Beson
2004/0173484 A1 9/2004 Bates et al.
2004/0183313 A1 9/2004 Sherman et al.
2004/0237266 A1 12/2004 Wang
2004/0238303 A1* 12/2004 Hafif ..... A45C 5/143 190/18 A
2005/0097711 A1 5/2005 Halstead
2005/0116003 A1 6/2005 Butler et al.
2005/0145302 A1 7/2005 Mutterer et al.
2005/0230465 A1 10/2005 Metzler et al.
2005/0262871 A1 12/2005 Bailey-Weston
2006/0003709 A1 1/2006 Wood
2006/0006969 A1 1/2006 Cassar
2006/0016841 A1 1/2006 Shurm
2006/0072857 A1* 4/2006 Revels ..... A45C 13/1023 383/35
2007/0051785 A1 3/2007 Roessiger
2007/0215663 A1 9/2007 Chongson et al.
2007/0232109 A1 10/2007 Parker et al.
2007/0261977 A1 11/2007 Sakai
2007/0261978 A1 11/2007 Sanderson
2008/0037907 A1 2/2008 Suskind
2008/0077289 A1 3/2008 Fujishima
2008/0179364 A1* 7/2008 Thatcher ..... A45F 3/14 224/600
2008/0272872 A1 11/2008 Fiedler
2009/0078731 A1 3/2009 Yi
2009/0114557 A1 5/2009 Nelson
2009/0184143 A1 7/2009 Witt et al.
2009/0208146 A1 8/2009 Kirby
2010/0025442 A1 2/2010 Shurm
2010/0040307 A1 2/2010 Lien
2010/0140861 A1 6/2010 Kubota et al.
2010/0181220 A1 7/2010 Dasara
2010/0298025 A1 11/2010 Spence
2010/0310194 A1 12/2010 Archambault
2012/0096669 A1 4/2012 Treacy
2012/0137637 A1 6/2012 Gillis
2012/0216374 A1 8/2012 Manuello
2013/0077897 A1 3/2013 Li
2013/0221048 A1 8/2013 Revels et al.
2013/0230260 A1 9/2013 Maynard et al.
2013/0242481 A1 9/2013 Kim et al.
2013/0243354 A1 9/2013 Lytle
2014/0066144 A1 3/2014 Hong
2014/0138378 A1 5/2014 Lequeux
2014/0138384 A1 5/2014 O'Brien
2014/0158558 A1 6/2014 Ve
2014/0209011 A1 7/2014 Byun
2014/0254956 A1 9/2014 Buell, III
2014/0262658 A1 9/2014 Wegener
2014/0360892 A1 12/2014 Lin
2015/0037799 A1 2/2015 Takagi
2015/0076144 A1 3/2015 Chalifoux
2015/0225164 A1* 8/2015 Seiders ..... A45C 13/103 220/592.25
2015/0239631 A1 8/2015 Kinskey
2015/0305402 A1 10/2015 Bourgoin
2016/0021997 A1 1/2016 Gonzalez
2016/0023808 A1 1/2016 Traverso et al.
2016/0058142 A1 3/2016 Buynar
2016/0083147 A1 3/2016 Mauro
2016/0130040 A1 5/2016 Yeh
2016/0198823 A1 7/2016 Bergreen et al.
2016/0221722 A1 8/2016 Burke et al.
2016/0235174 A1 8/2016 Lenci et al.
2016/0269517 A1 9/2016 Alexander
2016/0379184 A1 12/2016 Smith et al.
2016/0379185 A1 12/2016 Smith et al.
2017/0036844 A1 2/2017 Seiders et al.
2017/0066559 A1 3/2017 Kim et al.
2017/0280937 A1 10/2017 Mogil et al.
2018/0044094 A1 2/2018 Seiders et al.
2018/0252458 A1 9/2018 Furneaux et al.
2019/0279170 A1 9/2019 Smith et al.
2019/0344951 A1 11/2019 Rogers et al.

FOREIGN PATENT DOCUMENTS

CH 686058 A5 12/1995
CN 2499356 Y 7/2002
CN 3466138 8/2005
CN 101168090 A 4/2008
CN 201104571 Y 8/2008
CN 201153601 Y 11/2008
CN 101313791 A 12/2008
CN 300906331 4/2009
CN 101466617 A 6/2009
CN 201274836 Y 7/2009
CN 301000008 9/2009

(56) References Cited

FOREIGN PATENT DOCUMENTS

| | | | |
|---|---|---|---|
| CN | 301000009 | | 9/2009 |
| CN | 201393583 | Y | 2/2010 |
| CN | 301808202 | | 1/2012 |
| CN | 301985365 | | 7/2012 |
| CN | 302208071 | | 12/2012 |
| CN | 302623610 | | 11/2013 |
| CN | 103584443 | A | 2/2014 |
| CN | 203435847 | U | 2/2014 |
| CN | 302860668 | | 7/2014 |
| CN | 103237473 | B | 12/2015 |
| CN | 303514632 | | 12/2015 |
| CN | 105564794 | A | 5/2016 |
| CN | 205512895 | U | 8/2016 |
| CN | 205512896 | U | 8/2016 |
| CN | 205568112 | U | 9/2016 |
| CN | 106108308 | A | 11/2016 |
| CN | 304011530 | | 1/2017 |
| CN | 106858960 | A | 6/2017 |
| CN | 304291753 | | 9/2017 |
| CN | 304338166 | | 11/2017 |
| CN | 304351331 | | 11/2017 |
| CN | 304351332 | | 11/2017 |
| CN | 304361367 | | 11/2017 |
| CN | 304383056 | | 12/2017 |
| CN | 304423326 | | 12/2017 |
| CN | 304457891 | | 1/2018 |
| CN | 304457892 | | 1/2018 |
| CN | 304457893 | | 1/2018 |
| CN | 304555914 | | 3/2018 |
| CN | 207186216 | U | 4/2018 |
| CN | 304668083 | | 6/2018 |
| CN | 304713490 | | 7/2018 |
| CN | 304719918 | | 7/2018 |
| CN | 304781354 | | 8/2018 |
| CN | 304781362 | | 8/2018 |
| CN | 304782359 | | 8/2018 |
| CN | 304785773 | | 8/2018 |
| CN | 304785791 | | 8/2018 |
| CN | 304790835 | | 8/2018 |
| CN | 304823679 | | 9/2018 |
| CN | 304854892 | | 10/2018 |
| CN | 304877475 | | 11/2018 |
| CN | 304890011 | | 11/2018 |
| CN | 304915313 | | 11/2018 |
| CN | 304948871 | | 12/2018 |
| DE | 60104156 | T2 | 8/2005 |
| DE | 202009000499 | U1 | 3/2009 |
| EM | 000164199-0001 | | 7/2004 |
| EM | 000285028-0001 | | 6/2005 |
| EM | 000434253-0001 | | 1/2006 |
| EM | 000596333-0007 | | 10/2006 |
| EM | 001504127-0001 | | 4/2009 |
| EM | 001519406-0001 | | 6/2009 |
| EM | 001133383-0002 | | 1/2010 |
| EM | 001900705-0002 | | 9/2011 |
| EM | 001922204-0001 | | 11/2011 |
| EM | 002047233-0001 | | 5/2012 |
| EM | 002225706-0001 | | 5/2013 |
| EM | 002294322-0002 | | 8/2013 |
| EM | 001294060-0002 | | 10/2013 |
| EM | 001294060-0003 | | 10/2013 |
| EM | 002540948-0003 | | 9/2014 |
| EM | 002541185-0001 | | 9/2014 |
| EM | 002541185-0003 | | 9/2014 |
| EM | 002515247-0001 | | 10/2014 |
| EM | 002515247-0002 | | 10/2014 |
| EM | 002550715-0002 | | 10/2014 |
| EM | 002630814-0002 | | 2/2015 |
| EM | 002676536-0001 | | 6/2015 |
| EM | 002838573-0001 | | 11/2015 |
| EM | 003117324-0009 | | 5/2016 |
| EM | 003122464-0001 | | 5/2016 |
| EM | 004109049-0001 | | 7/2017 |
| EM | 00530559-0001 | | 7/2018 |
| EM | 005303559-0003 | | 7/2018 |
| EM | 005511102-0001 | | 8/2018 |
| EM | 005511102-0002 | | 8/2018 |
| EM | 005511102-0003 | | 8/2018 |
| EM | 005511102-0004 | | 8/2018 |
| EM | 005618204-0001 | | 8/2018 |
| EM | 005887585-0006 | | 1/2019 |
| EM | 006501607-0001 | | 5/2019 |
| EP | 0922399 | A2 | 6/1999 |
| EP | 1683736 | A2 | 7/2006 |
| EP | 1864916 | A1 | 12/2007 |
| EP | 2571391 | A2 | 3/2013 |
| FR | 20105616-001 | | 4/2011 |
| GB | 2045117 | | 6/1995 |
| GB | 4012617 | | 10/2009 |
| JP | S4971312 | U | 6/1974 |
| JP | S49112604 | U | 9/1974 |
| JP | S49123217 | A | 11/1974 |
| JP | S53161363 | U | 12/1978 |
| JP | S58039009 | A | 3/1983 |
| JP | S59070508 | U | 5/1984 |
| JP | S6076076 | U | 5/1985 |
| JP | S61073224 | U | 5/1986 |
| JP | 562058606 | A | 3/1987 |
| JP | S62134836 | U | 8/1987 |
| JP | S63068865 | U | 5/1988 |
| JP | S63111442 | U | 7/1988 |
| JP | H01126956 | U | 8/1989 |
| JP | 1992074010 | U | 6/1992 |
| JP | H04074010 | U | 6/1992 |
| JP | H0556809 | A | 3/1993 |
| JP | H06021210 | A | 1/1994 |
| JP | H06021210 | U | 3/1994 |
| JP | 3003213 | U | 10/1994 |
| JP | H06076076 | U | 10/1994 |
| JP | H0679320 | U | 11/1994 |
| JP | H08502427 | A | 3/1996 |
| JP | H9328149 | A | 12/1997 |
| JP | H10127329 | A | 5/1998 |
| JP | 3051283 | U | 8/1998 |
| JP | 3051385 | U | 8/1998 |
| JP | H1126956 | A | 1/1999 |
| JP | H11147572 | A | 6/1999 |
| JP | 3059196 | U | 7/1999 |
| JP | H11269713 | A | 10/1999 |
| JP | 3160109 | B2 | 4/2001 |
| JP | 2001267164 | A | 9/2001 |
| JP | 2003071978 | A | 3/2003 |
| JP | 2004000355 | A | 1/2004 |
| JP | 3515781 | B2 | 4/2004 |
| JP | 2005335769 | A | 12/2005 |
| JP | 2005343482 | A | 12/2005 |
| JP | 2006123987 | A | 5/2006 |
| JP | 4074010 | B2 | 4/2008 |
| JP | D1355521 | | 4/2009 |
| JP | 3154150 | U | 10/2009 |
| JP | D1376358 | | 12/2009 |
| JP | 2010030644 | A | 2/2010 |
| JP | 2020512281 | A | 4/2010 |
| JP | D2010-8653 | | 12/2010 |
| JP | 2011121631 | A | 6/2011 |
| JP | D2012-551 | | 8/2012 |
| JP | D1487395 | | 1/2014 |
| JP | D1500514 | | 6/2014 |
| JP | D1619280 | | 12/2018 |
| KR | 20020046244 | A | 6/2002 |
| KR | 200341520 | Y1 | 2/2004 |
| KR | 20070089473 | A | 8/2007 |
| KR | 3020070006269 | | 12/2007 |
| KR | 3020070006271 | | 2/2008 |
| KR | 3020100039256 | | 4/2012 |
| KR | 3020120016755 | | 9/2012 |
| KR | 3020140014014 | | 11/2014 |
| TR | 652921-0001 | | 7/2013 |
| WO | 9408541 | A1 | 4/1994 |
| WO | D032527-029 | | 5/1995 |
| WO | D038554-029 | | 2/1997 |
| WO | 0108527 | A1 | 2/2001 |
| WO | 2007140916 | A3 | 2/2008 |
| WO | 08025905 | A2 | 3/2008 |

(56) References Cited

FOREIGN PATENT DOCUMENTS

| | | | |
|---|---|---|---|
| WO | D082059-001 | | 11/2013 |
| WO | D091354-003 | | 3/2016 |
| WO | 17136754 | A1 | 8/2017 |
| WO | D099344-004 | | 2/2018 |
| WO | D099344-034 | | 2/2018 |
| WO | D099990-006 | | 3/2018 |
| WO | 2018165426 | A1 | 9/2018 |
| WO | D103345-001 | | 4/2019 |
| WO | 2019135922 | A1 | 7/2019 |

OTHER PUBLICATIONS

Apr. 3, 2020—(WO) International Search Report & Written Opinoin—PCT/US20/021519.
Jun. 19, 2018—(WO) International Search Report and Written Opinion—App. No. PCT/US18/21546.
Feb. 27, 2015—(JP) Office Action—App. No. 2013-510725.
Feb. 27, 2015—(CN) CSR—App. No. CN103237473B.
Jan. 15, 2015—(CN) Office Action—App No. 201180031291.5.
Oct. 30, 2020—(CN) Office Action—App. No. 201880015578.0.
Oct. 20, 2020—(IP) Office Action—App. No. 2019548313.
Jan. 29, 2021—(EP) Supplementary Search Report—App. No. 18763122.
May 6, 2019—(WO) International Search Report and Written Opinion—App. No. PCT/US2018/066679.
Jun. 9, 2021—(CN) Second Office Action—App. No. 201880015578.0.

* cited by examiner

CONTAINER WITH MAGNETIC CLOSURE

CROSS-REFERENCE TO RELATED APPLICATIONS

This application is a continuation of U.S. application Ser. No. 16/295,711, filed Mar. 7, 2019, now U.S. Pat. No. 10,954,055, which is a continuation-in-part of U.S. application Ser. No. 16/096,206, filed Oct. 24, 2018, which is a U.S. National Stage application of International Application No. PCT/US2018/021546, filed Mar. 8, 2018, which claims the benefit of and priority to U.S. Provisional Patent Application No. 62/468,673, filed Mar. 8, 2017, which are expressly incorporated herein by reference in their entirety for any and all non-limiting purposes.

FIELD

The present disclosure relates generally to non-rigid, semi-rigid and rigid portable container devices useful for storing personal belongings in a sealed storage compartment that has a magnetic closure.

BACKGROUND

Containers may be designed to store a user's personal belongings in order to provide a degree of protection from incidental impact (e.g. drops), as well as from liquids and dirt. Containers may be composed of rigid materials such as metal or plastics or flexible materials such as fabric or foams. Containers may be designed with an opening/aperture that allows access to the interior contents of the container. The opening may also be provided with a closure mechanism.

SUMMARY

This Summary provides an introduction to some general concepts relating to this invention in a simplified form that are further described below in the Detailed Description. This Summary is not intended to identify key features or essential features of the invention.

Aspects of the disclosure herein may relate to container devices having one or more of (1) a partial or full waterproof closure (2) a magnetic closure.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

Figure 1:
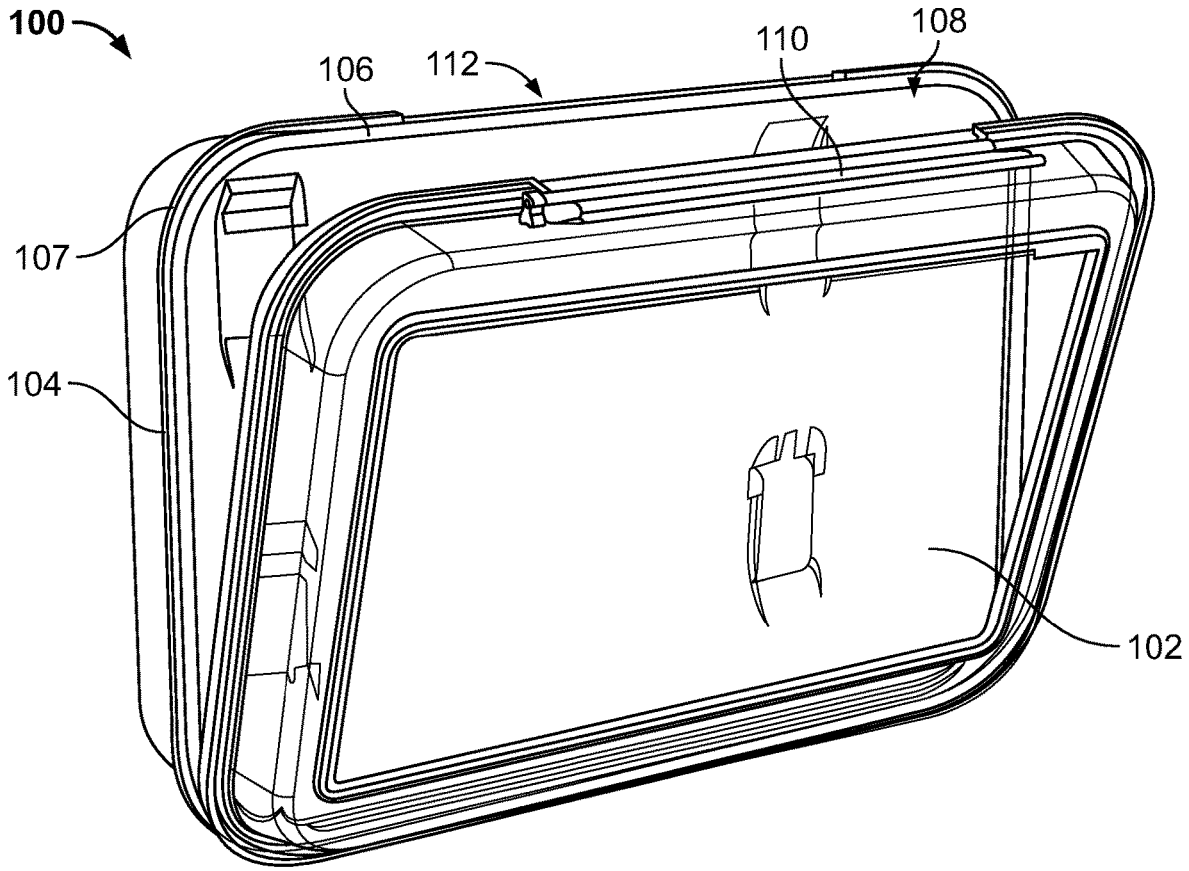
FIG. 1 schematically depicts an implementation of a container, according to one or more aspects described herein.

Further, it is to be understood that the drawings may represent the scale of different components of various examples; however, the disclosed examples are not limited to that particular scale. Further, the drawings should not be interpreted as requiring a certain scale unless otherwise stated.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "front," "back," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

In the description that follows, reference is made to one or more container structures. It is contemplated that any of the disclosed structures may be constructed from any polymer, composite, and/or metal/alloy material, without from the scope of these disclosures. Additionally, it is contemplated that any manufacturing methodology may be utilized, without departing from the scope of these disclosures. For example, one or more welding (e.g. high frequency, ultrasonic welding, or laser welding of fabric, or metal/alloy welding), gluing, stitching, molding, injection molding, blow molding, stamping, deep-drawing, casting, die-casting, drilling, deburring, grinding, polishing, sanding, or etching processes, among many others, may be utilized to construct of the various containers described throughout these disclosures. Additionally, where reference is made to a magnetic element or structure throughout these disclosures, it may be assumed that the element or structure includes one or more magnets (e.g. permanent magnets), or one or more metals or alloys (e.g. ferromagnetic materials, among others), which may be attracted to magnets. Further, a magnetic strip, as described herein, may include a continuous magnetic element, a series of two or more discrete magnetic elements, or a two- or three-dimensional array of magnetic elements. Additionally, these magnetic elements may be constructed from any magnetic metal or alloy, and may be combined with one or more non-magnetic materials, such as polymers, ceramics, or non-magnetic metals or alloys. It is also contemplated that the various disclosures described in this document may be combined in any manner, such that various permutations of combined elements may be possible.

Various magnetic closure mechanisms are described throughout the following disclosures. These magnetic closure mechanisms may be configured to be partially or fully watertight and/or airtight. It is contemplated that the magnetic closure mechanisms may include gaskets and seals in addition to the described magnetic elements, without departing from the scope of these disclosures.

It is contemplated that any of the containers discussed throughout this document may be partially or fully watertight, airtight, and/or sealed to substantially or fully prevent dust or other materials from entering into and/or escaping from the containers. For example, containers 100, 200, 300, 400, 700, 800, 1400, 2002, 2200, 2300, and/or 2500, which are described in further detail in the proceeding paragraphs, may include partially or fully water resistant outer shells/outer walls and closure mechanisms.

FIG. 1 schematically depicts an implementation of a container 100, according to one or more aspects described herein. It is contemplated that a container, such as container 100, may alternatively be referred to as a pouch, bag, box, or vessel, among others, through these disclosures. In one example, container 100 may have a hard shell that is resistant to deformation. In one implementation, the container 100 has a clamshell mechanism with a front shell 102 that is hingedly coupled to a back shell 104. Where discussed throughout these disclosures, a hinge coupling may utilize one or more of a flexure element (e.g. a live hinge), or a piano hinge, among many others. It is contemplated that the shells 102 and 104 may be constructed from any polymer, composite, and/or metal/alloy material, among others. In one implementation, the front shell 102 may be partially or wholly transparent. In one example, the front shell 102 and/or the back shell 104 may be constructed from a polycarbonate material. However, additional or alternative polymeric materials may be utilized, without departing from the scope of these disclosures.

The container 100 may have a gasket 106 that extends around at least a portion of an internal perimeter of the back shell 104. The gasket 106 may be positioned within a channel 107 of the back shell 104. The gasket 106 may be constructed from silicone, neoprene, nitrile, polyvinylchloride, or butyl rubber, among others. In one example, the gasket 106 may be configured to partially or wholly seal the opening 108 into an internal storage compartment within the container 100.

In one implementation, it is contemplated that the container 100 may include a closure mechanism, which may otherwise be referred to as a fastener mechanism throughout these disclosures, having a clasp 110 that is hingedly coupled to the front shell 102, and configured to removably couple to a top portion 112 of the back shell 104. In certain examples, the clasp 110 in conjunction with the gasket 106 can create a waterproof or water resistant seal between the front shell 102 and back shell 104. Moreover, the container 100 can be formed of a waterproof or water resistant fabric to form a dry compartment within the container 100. However, additional or alternative closure mechanisms may be utilized, without departing from the scope of these disclosures. For example, the container 100 may utilize two or more clasps similar to clasp 110, one or more zippers, rail-type closure mechanisms, hook and loop fasteners, tabs, interference fitting closure mechanisms, interlocking closure mechanism, or magnetic closure mechanisms, without departing from the scope these disclosures.

Figure 2:
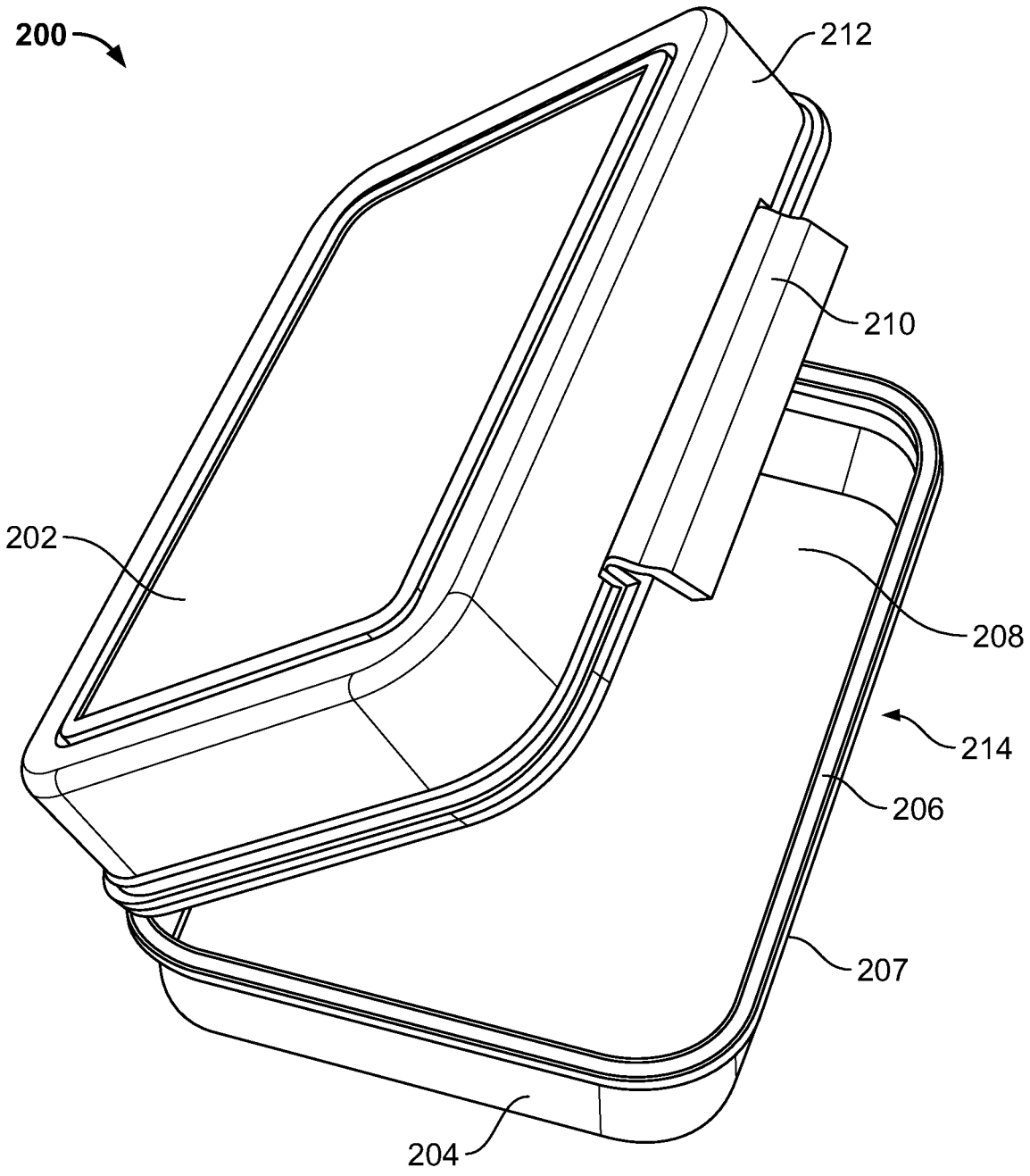
FIG. 2 schematically depicts an implementation of a container, according to one or more aspects described herein.

FIG. 2 schematically depicts an implementation of a container 200, according to one or more aspects described herein. The container 200 may have a firm shell that is at least partially resistant to deformation. In one specific example, container 200 utilizes a clamshell design and has a front shell 202 that is hingedly coupled to a back shell 204. The back shell 204 may have a gasket 206 that is positioned within a channel 207 extending around at least a portion of an internal perimeter of the back shell 204. As depicted, an opening provides access to an internal storage compartment 208 of the container 200. This internal storage compartment 208 may be partially or wholly sealed (e.g. partially or wholly sealed to air and/or water, among others), when the front shell 202 is engaged with the back shell 204 along the gasket 206. In one example, the gasket 206 may be similar to the gasket 106 described in relation FIG. 1. It is further contemplated that the container 200 may be constructed from a molded Ethylene Vinyl Acetate material that has a fabric coating.

In the depicted example, the container 200 may include a closure mechanism that has a clasp 210 that is hingedly coupled to a top surface 212 of the front shell 202. Accordingly, the clasp 210 may be configured to engage with a tab structure (not depicted) on a top surface 214 of the back shell 204. Like in the above example, it is also contemplated that the clasp 110 in conjunction with the gasket 206 can create a waterproof or water resistant seal between the front shell 202 and back shell 204. Moreover, the container 200 can be formed of a waterproof or water resistant fabric to form a dry compartment within the container 200. However, additionally or alternative closure mechanisms may be utilized, such as a magnetic closure mechanism, or hook and loop fasteners, among others.

Figure 3A:
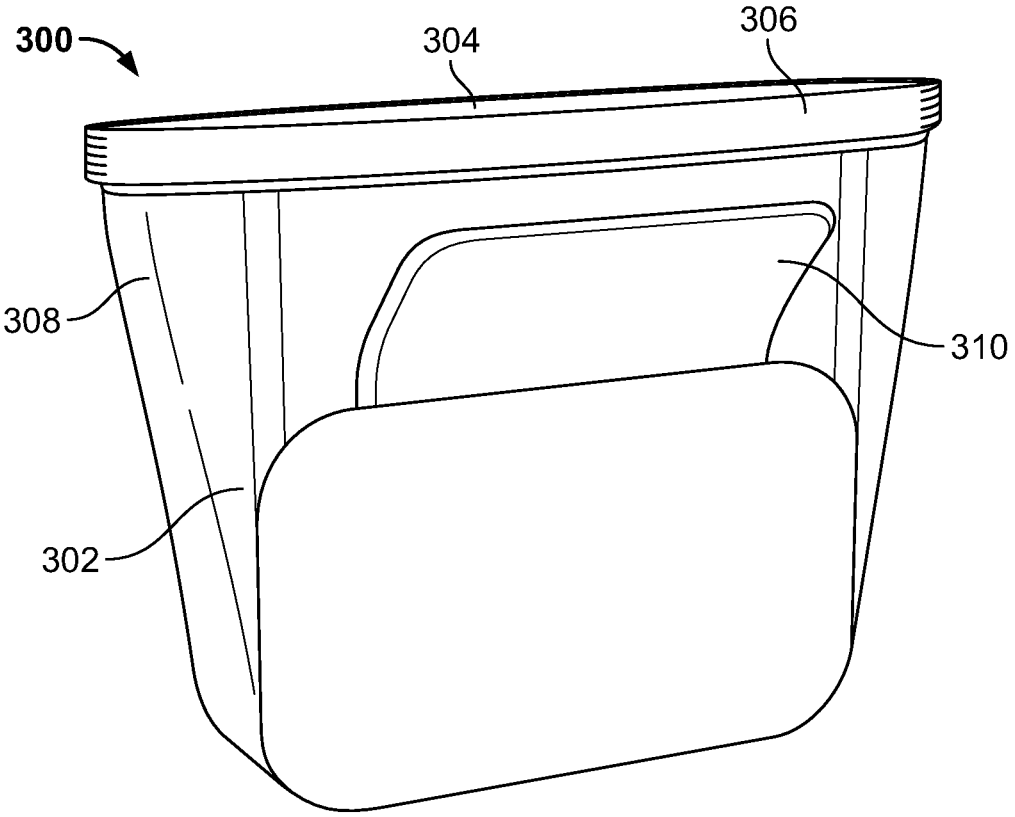
FIGS. 3A and 3B schematically depict another implementation of a container, according to more aspects described herein.
Figure 3B:
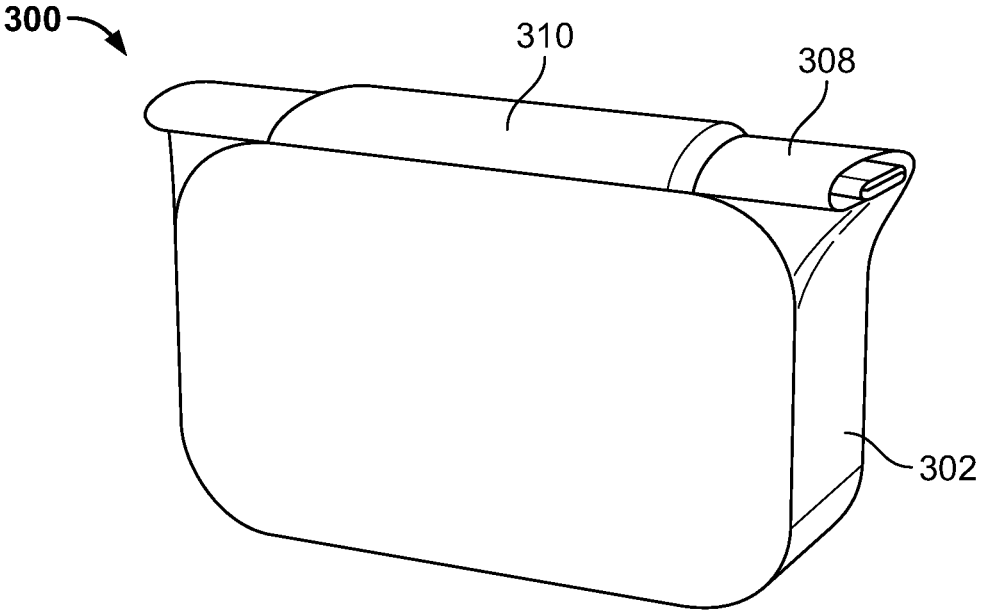

FIGS. 3A and 3B schematically depict another implementation of a container 300, according to one or more aspects described herein. In particular, FIG. 3A schematically depicts container 300 in an open configuration and FIG. 3B schematically depicts container 300 in a closed configuration. In one implementation, container 300 is constructed from one or more deformable materials, such that one or more surfaces of the outer shell 302 may be folded.

In one example, an opening 304 extends into an internal storage compartment of the container 300. The opening 304 may be partially or wholly sealed by a first closure mechanism 306. The first closure mechanism may include a magnetic closure extending around at least a portion of a perimeter of the opening 304. Additionally or alternatively, the first closure mechanism 306 may include a rail-type fastener, and/or a zipper fastener, among others. Further, the opening 304 may be partially or wholly sealed by folding/rolling an upper portion 308 of the outer shell 302 toward a second closure mechanism 310. As depicted in FIG. 3B, the second closure mechanism 310 may be configured to extend over the folded top portion 308 and affix to a back side (not depicted) of the outer shell 302. Accordingly, the second closure mechanism 310 may include one or more hook and loop fasteners, clasp fasteners, ties, or magnetic elements, among others.

Figure 4:
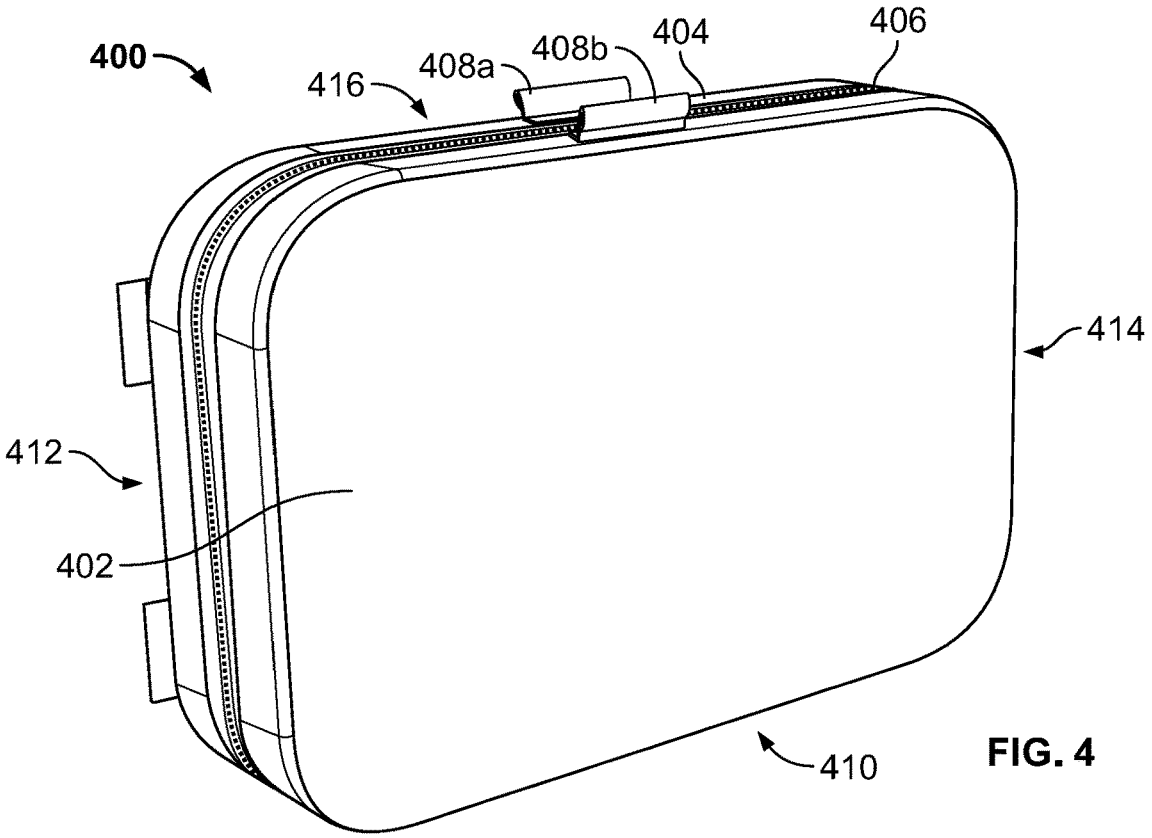
FIG. 4 schematically depicts one implementation of a container, according to one or more aspects described herein.

FIG. 4 schematically depicts one implementation of a container 400, according to one or more aspects described herein. In one implementation, the container 400 has a front shell 402 that is coupled to a back shell 404. The front shell 402 may be coupled to the back shell 404 by a hinge mechanism (not depicted in FIG. 4.) that is positioned along one or more side surfaces of the container 400 (e.g. bottom surface 410, left side surface 412, right side surface 414, and/or top surface 416). The front shell 402 may be coupled to the back shell 404 by one or more additional or alternative closure mechanisms that are configured to partially or wholly seal an opening that extends into a storage compartment (not depicted in FIG. 4) of the container 400. In one example, the container 400 may include a rail-type closure mechanism, a zipper closure, and/or a magnetic closure mechanism, among others. As such, the one or more additional or alternative closure mechanisms may be configured to seal an opening that extends, partially or wholly, around a frame element 406.

In one example, the container 400 includes pull-tabs 408*a* and 408*b* that are configured to provide grip surfaces onto which a user may manually grasp the container 400 in order to hingedly uncouple/hingedly couple the front shell 402 from/to the back shell 404 to gain access to/seal one or more internal storage compartments of the container 400. It is further contemplated that the container 400 may include one or more alternative coupling mechanisms in place of the hinge mechanism (not depicted in FIG. 4.) positioned along one or more side surfaces of the container 400. For example, the front shell 402 may be configured to be removably coupled to the back shell 404.

One or more of the front shell 402 and the back shell 404 may be deformable, or may be partially or fully rigid. In one example, one or more of the front shell 402 in the back shell 404 may be constructed from a molded EVA (Ethylene Vinyl Acetate), and may have a fabric coating. This fabric coating may include any synthetic or natural fiber material. It is further contemplated that the container 400 may utilize any polymer, composite, and/or metal/alloy without departing from the scope of these disclosures.

Figure 5:
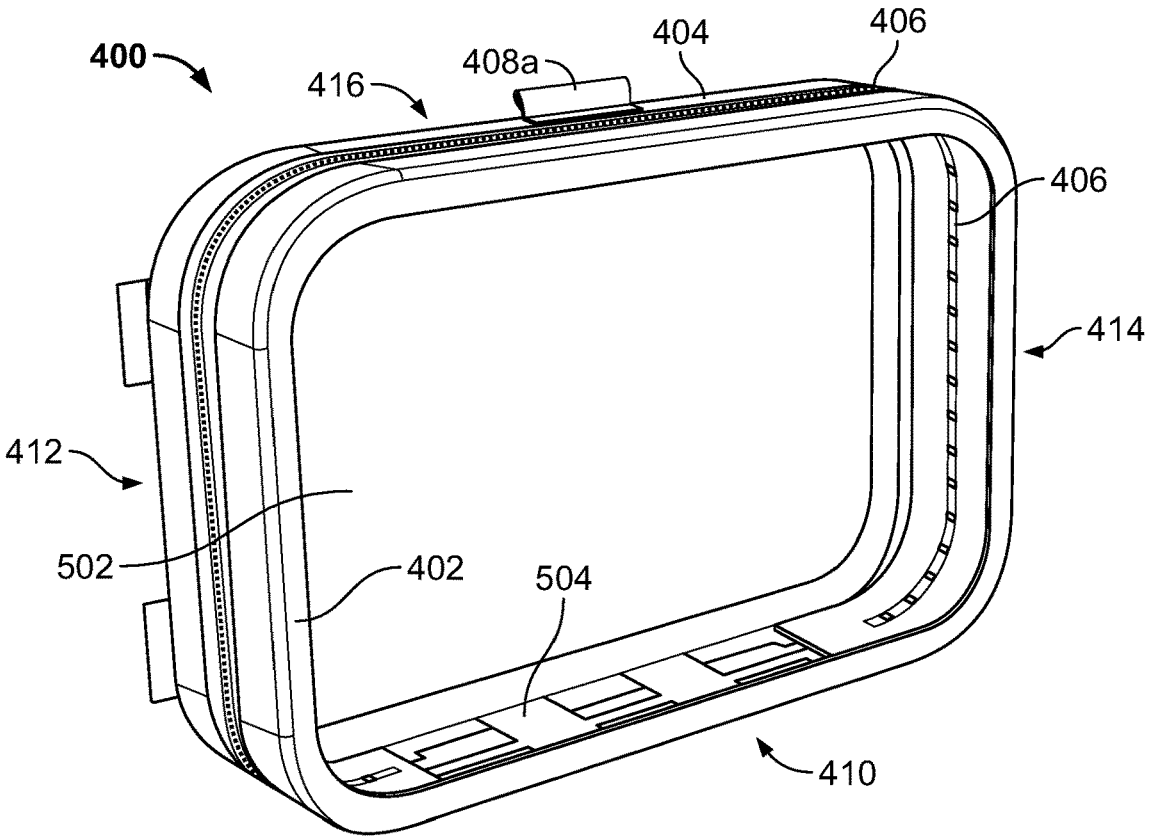
FIG. 5 schematically depicts another view of the container from FIG. 4, according to one or more aspects described herein.

FIG. 5 schematically depicts another view of the container 400 that has a front surface of the front shell 402 removed in order to provide a view into an internal compartment 502 of the container 400. FIG. 5 schematically depicts a hinge mechanism 504 that extends along a portion of the bottom surface 410, and is configured to hingedly couple the front shell 402 to the back shell 404. Additionally, FIG. 5 schematically depicts an internal view of the frame 406 that extends at least partially around a perimeter of the container 400. In one example, the frame 406 is constructed from an elastomer. As previously described, the frame 406 includes one or more additional or alternative closure mechanisms configured to partially or wholly seal an opening into the internal storage compartment 502. These additional or alternative closure mechanisms are described in further detail in relation to the proceeding figures.

Figure 6:
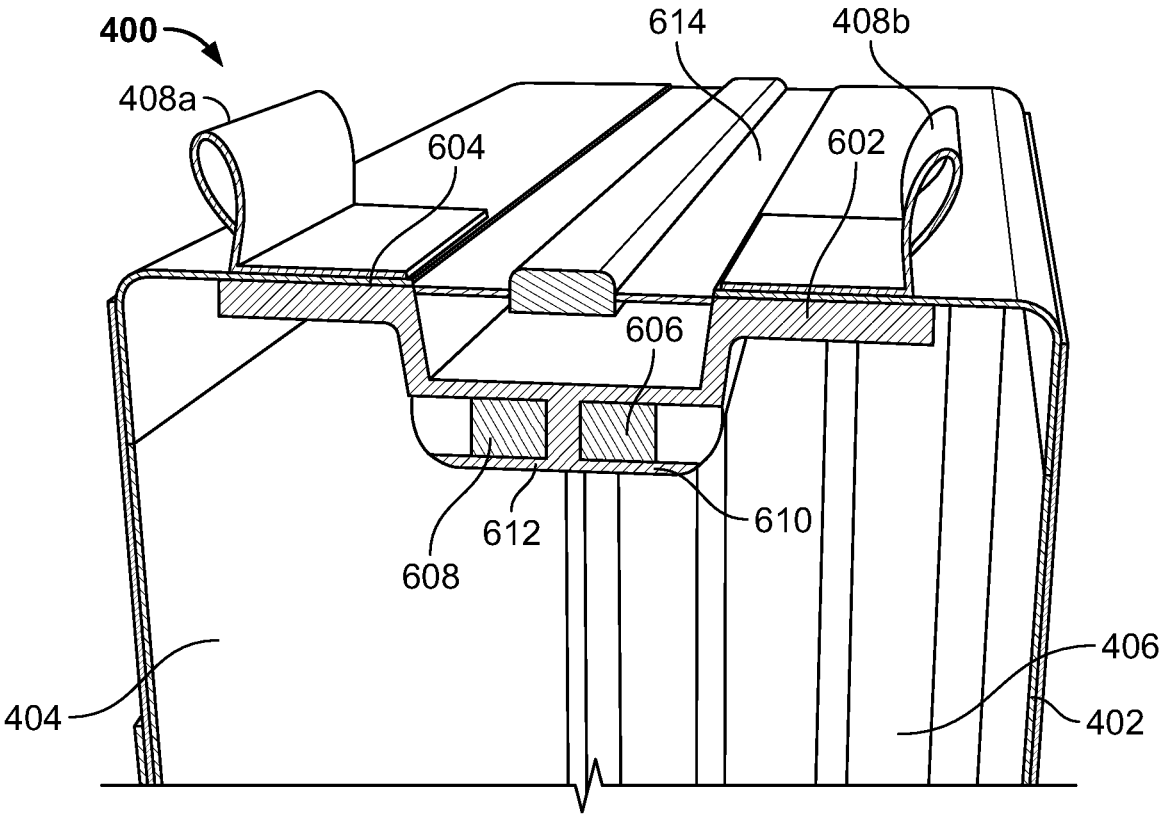
FIG. 6 schematically depicts a cross-sectional view of a top portion of the container from FIG. 4, according to one or more aspects described herein.

FIG. 6 schematically depicts a cross-sectional view of a top portion of the container 400, according to one or more aspects described herein. FIG. 6 schematically depicts the front shell 402 having a front frame 602 that extends around at least a portion of an internal perimeter of the front shell 402. The container 400 also includes a back shell 404 and a back frame 604 that extends around an internal perimeter of the back shell 404. In one example, the container 400 has a closure mechanism that includes a front magnetic strip 606. The front magnetic strip 606 may extend around at least a portion of the front frame 602. Further, the front magnetic strip 606 may be encapsulated within a front channel 610 of the front frame 602. Similarly, the closure mechanism may include a back magnetic strip 608 that extends around at least a portion of the back frame 604. The back magnetic strip 608 may also be encapsulated within a back channel 612 of the back frame 604. It is contemplated that the front magnetic strip 606 and the back magnetic strip 608 may include one or more magnetic elements configured in one or more linear strips, or two-dimensional arrays. For example, the front magnetic strip 606 and the back magnetic strip 608 may include a continuous magnetic element, or several magnetic elements spaced apart from one another within the front channel 610 and the back channel 612. It is contemplated that the front magnetic strip 606 and the back magnetic strip 608 may include one or more permanent magnets, and/or or elements that include metals/alloys that are attracted to magnets. Accordingly, the front magnetic strip 606 may be configured to magnetically couple to the back magnetic strip 608.

Additionally, the closure mechanism of the container 400 may include a zipper 614. The zipper 614 may extend around at least a portion of the front frame 602 and the back frame 604. It is contemplated that any zipper mechanism having any size (e.g. teeth size, spacing) and/or having any slider body and pull type, may be utilized, without departing from the scope of the disclosures. It is further contemplated that the zipper 614 may be configured to be partially or wholly water resistant. As such, the zipper 614, when closed, may partially or wholly prevent water ingress into the storage compartment 502. Additionally or alternatively, the magnetic closure that includes the front magnetic strip 606 and the back magnetic strip 608 may seal the opening into the internal storage compartment 502 such that it is partially or wholly water resistant and/or air tight.

In one example, the zipper assembly 614 can be watertight up to 7 psi above atmospheric pressure during testing with compressed air. However, in other examples, the water tightness of the closure 614 can be from 5 psi to 9 psi above atmospheric pressure and in other examples, the water tightness of the closure 614 can be from 2 psi to 14 psi above atmospheric pressure. The waterproof zipper assembly 614 can include a slider body and pull-tab (not depicted). In one particular example, the waterproof zipper assembly 614 can be constructed with plastic or other non-metallic teeth to prevent injury when retrieving contents from an internal storage compartment of the container 400.

Further advantageously, the magnetic closure mechanism that includes the front magnetic strip 606 and the back magnetic strip 608 may, when the strips 606 and 608 are magnetically coupled to one another, align the front shell 402 with the back shell 404. This magnetic alignment may allow the zipper 614 to be manually opened or closed without any snagging/other partial failure of the zipper mechanism that may be experienced due to misalignment of zipper teeth etc.

Figure 7:
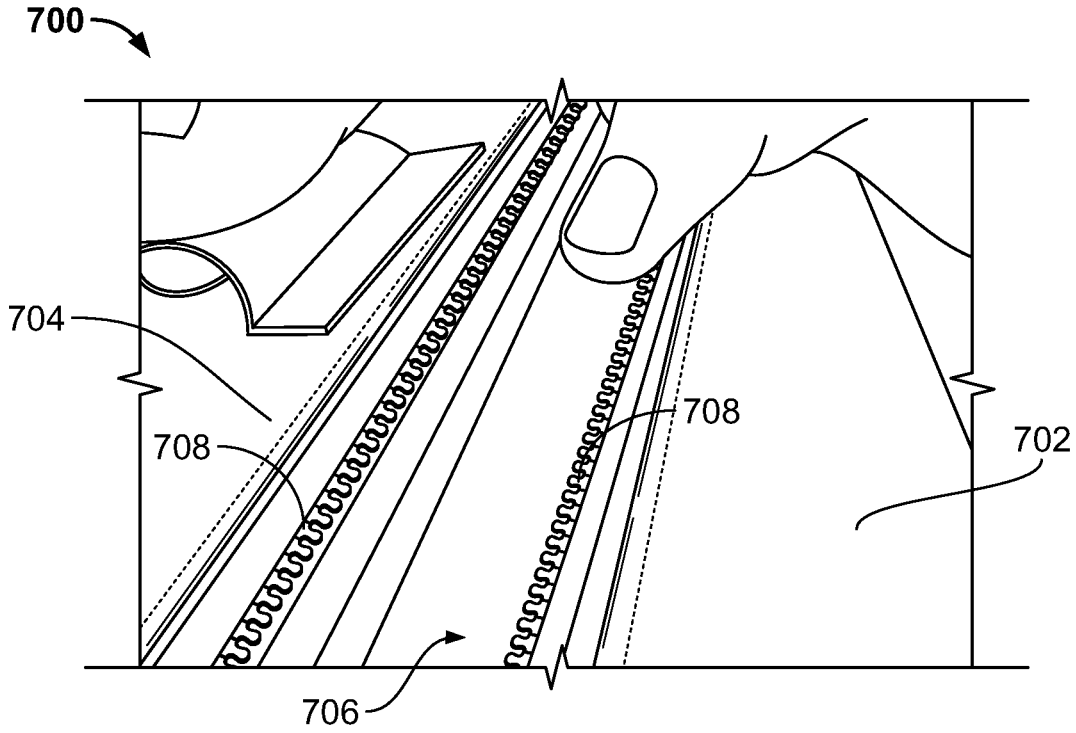
FIG. 7 depicts one implementation of a container, according to one or more aspects described herein.

FIG. 7 depicts one implementation of a container 700 that may be similar to container 400, according to one or more aspects described herein. In particular, the container 700 has a front shell 702 that may be similar to the front shell 402, and a back shell 704 that may be similar to the back shell 404, and configured to be hingedly coupled to the front shell 702. As depicted, the front shell 702 is uncoupled from the back shell 704 such that an internal storage compartment is accessible through opening 706. FIG. 7 also depicts a zipper 708 that may be similar to zipper 614.

Figure 8A:
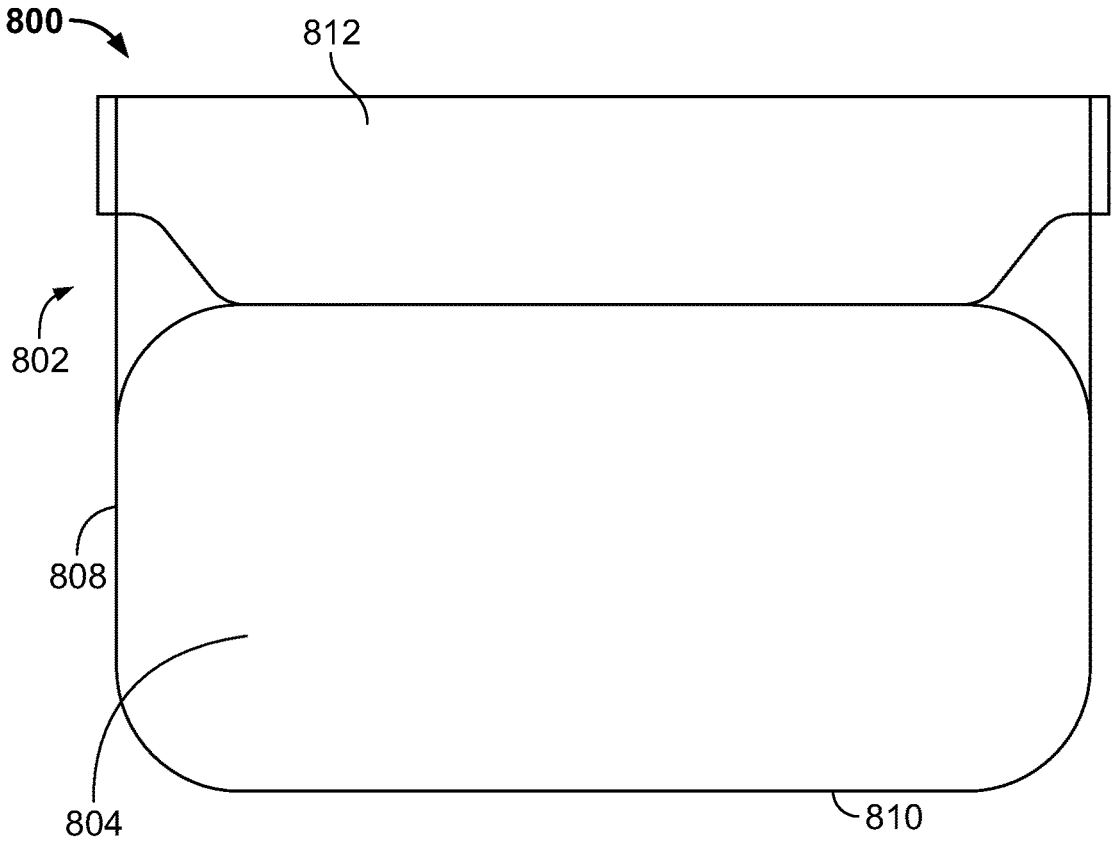
FIGS. 8A-8B schematically depict an implementation of a container, according to one or more aspects described herein.
Figure 8B:
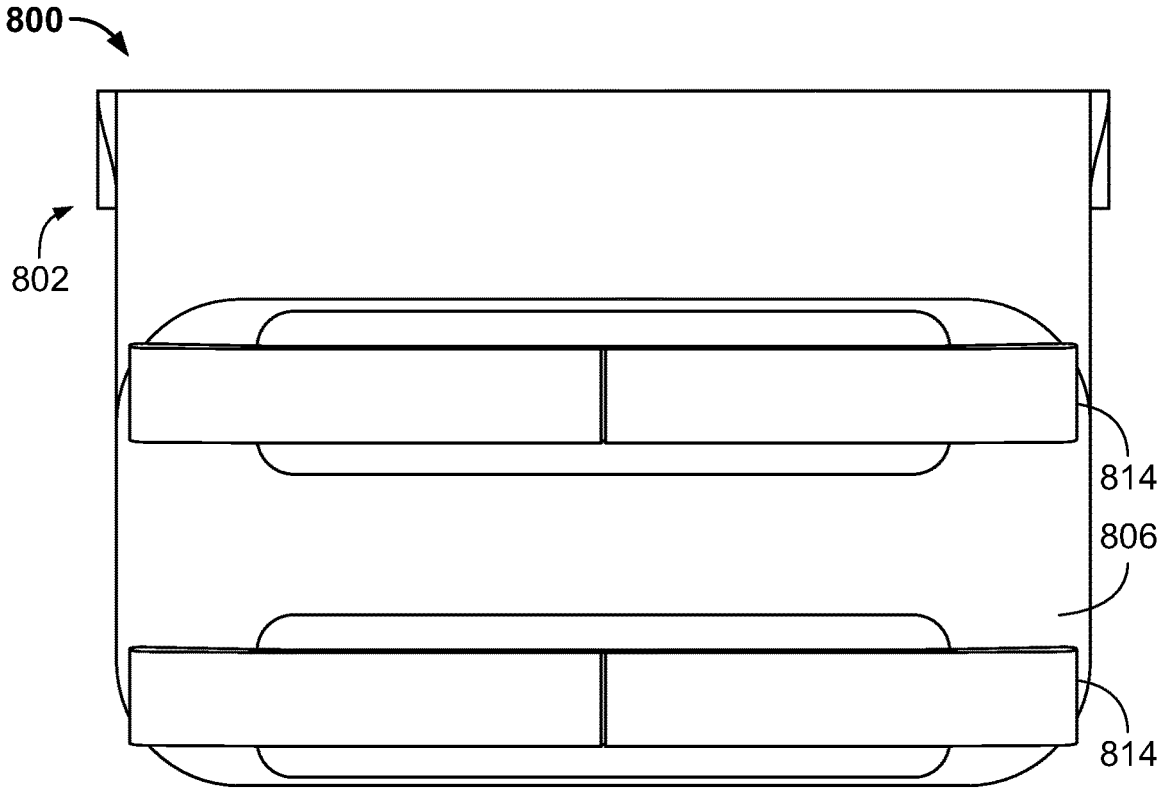

FIGS. 8A-8B schematically depict an implementation of a container 800, according to one or more aspects described herein. In particular, FIG. 8A schematically depicts a front elevation view of the container 800 and FIG. 8B schematically depicts a partial back elevation view of a same implementation of the container 800. In one example, the container 800 may have an outer shell 802 that is formed from a partially or wholly water resistant material. It is contemplated that the outer shell 802 of container 800 may include a front portion 804, a back portion 806, side portions 808, and base portion 810. The container 800 may also include a closure mechanism 812 that may be configured to resealably seal an opening (not depicted in FIG. 8A or 8B) at a top of the container 800. Additionally, the container 800 may include an attachment mechanism 814 on the back portion 806, which may be utilized to removably couple the container 800 to another structure, such as, for example, a bag, an insulating container, or an item of apparel (e.g. a belt), among others. In one implementation, the attachment mechanism may include one or more straps with hook and loop fasteners configured to allow the straps to be removably coupled to an external structure.

In one example, the container 800 may be configured to be removably coupled to another container, such as an insulating device, or insulating container. In particular, the container 800 may be configured to be removably coupled to one or more of the insulating devices described in U.S. patent application Ser. No. 15/261,407 filed 9 Sep. 2016, the entire contents of which are incorporated herein by reference in their entirety for any and all non-limiting purposes. Similarly, any of the other containers 100, 200, 300, 400, 700, and/or 1400 described throughout this document may also be configured to be removably coupled to one or more of the insulating devices described in U.S. patent application Ser. No. 15/261,407.

It is contemplated that the outer shell 802 of the container 800 may be constructed from one or more panels that are coupled to one another to form the depicted front portion 804, a back portion 806, side portions 808, and base portion 810. In particular, the one or more panels may be glued, stitched, or welded (ultrasonic welding, RF welding, laser welding, among others) together, among others. It is contemplated that the outer shell 802 of the container 800 may have one or more substantially rigid structures, one or more deformable structures, or a combination thereof. Additionally, the outer shell 802 may utilize one or more polymers (such as, among others, polypropylene, polyvinylchloride, polyethylene, polyethylene terephthalate, acrylonitrile butadiene styrene), composite materials, and/or one or more metals/alloys.

Figure 9C:
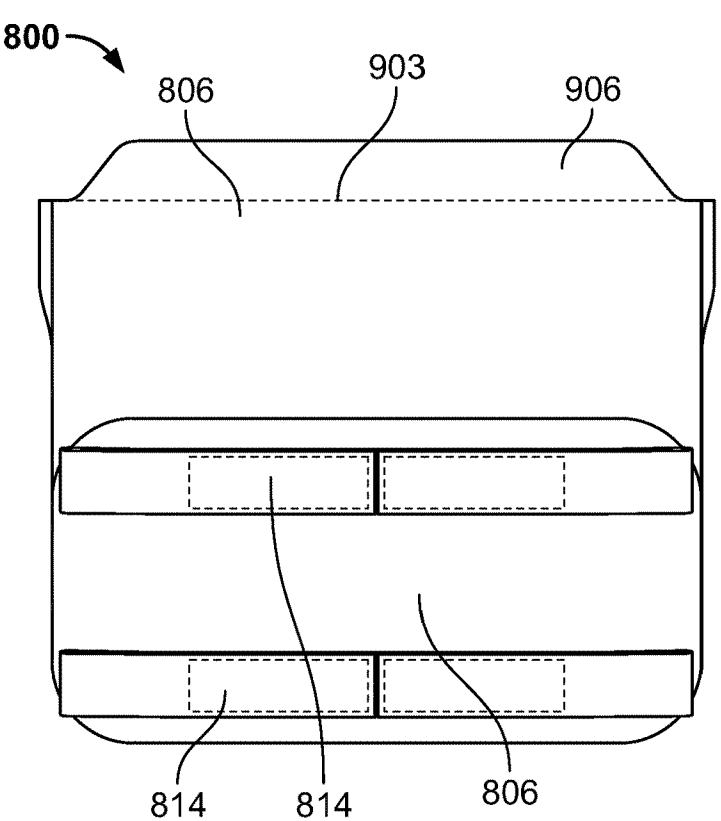
FIGS. 9A-9C schematically depict the container from FIGS. 8A-8B in an open configuration, according to one or more aspects described herein.
Figure 9B:
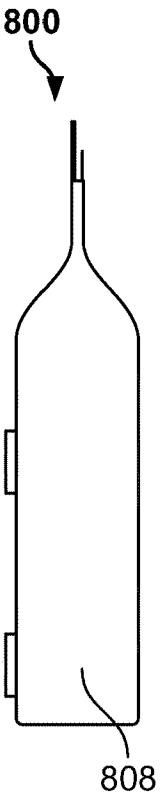
Figure 9A:
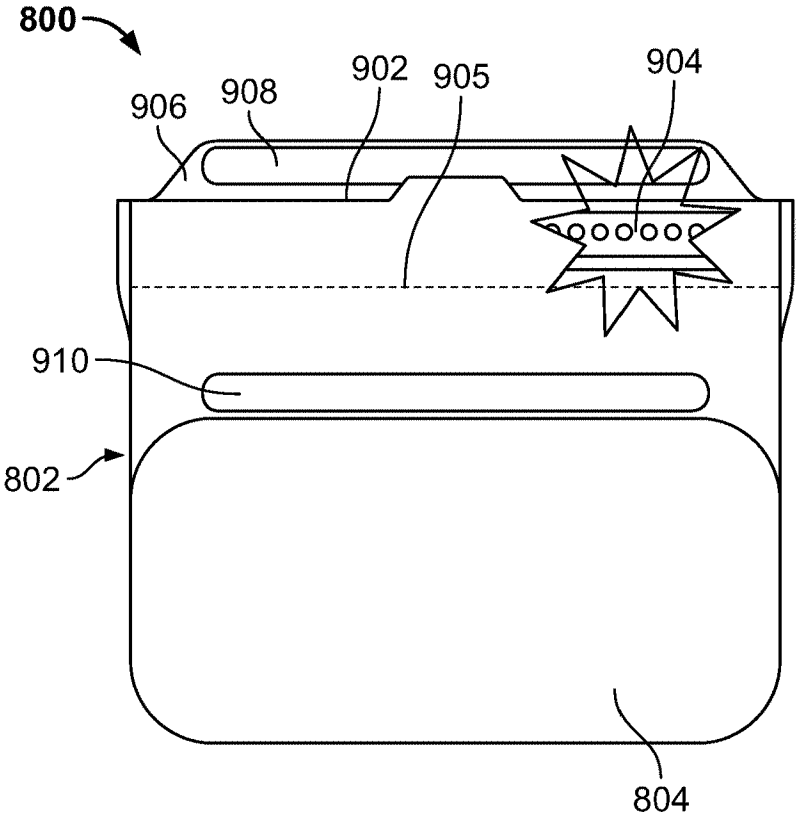

FIGS. 9A-9C schematically depict the container 800 in an open configuration, according to one or more aspects described herein. In particular, FIG. 9A schematically depicts a front elevation view, FIG. 9B schematically depicts a side elevation view, and FIG. 9C schematically depicts a back elevation view of the container 800. In one implementation, an opening 902 may be positioned at a top of the container 800, with the opening extending into one or more storage compartments encapsulated by the outer shell 802. The container 800 may include a closure mechanism that includes a magnetic seal. The magnetic seal is described in further detail in the proceeding sections of this document, and schematically depicted in part within the cutaway window of FIG. 9A as element 904. As will be described in further detail in relation to subsequent figures, the magnetic seal 904 may be configured to magnetically and resealably seal the opening 902 in the container 800. Additionally or alternatively, the closure mechanism of the container 800 may include a flap portion 906 that extends from the back portion 806 above an edge of the opening 902 (edge of opening 902 schematically depicted by dashed line 903). The flap portion 906 may include a first fastener element 908 that is configured to be removably coupled to a second fastener element 910. The second fastener element 910 is further coupled to an external surface of the front portion 804 of container 800. In certain examples, the second fastener element can be formed with a larger area and can be in the form of a larger rectangle such that the flap portion 906 of the container 800 can be secured to the container at different heights. This may allow for the container's size to be adjustable to accommodate for different loads in the container 800. In one example, the first and second fastener elements 908 and 910 may include hook and loop or French cleat fastener elements. In another implementation, the first and second fastener elements 908 and 910 may include magnetic fasteners, such as magnetic strips. The magnetic fasteners may be used separately or in conjunction with French cleats, hook and loop, and other types of fastening elements. The above methods may also be used to connect various removable straps to the container. In yet another implementation, the first and second fastener elements 908 and 910 may include, or may be used in conjunction with, one or more of a rail/zipper-type fastener, one or more buttons, clasps, snaps, ties, interlocking shanks, stamped hooks, toggles, or interference-type removable couplings, among others.

In one implementation, the outer shell of the container 800 may be configured to fold along one or more lines (not depicted in FIGS. 9A-9C) to engage the first and second fastener elements 908 and 910 with one another. It is contemplated that the container 800 may fold along one or more fold lines spaced approximately half way between the first and second fastener elements 908 and 910 (e.g. along the schematically depicted line 905). Additionally or alternatively, at least a portion of the outer shell of the container 800 may be configured to be rolled in order to engage the first and second fastener elements 908 and 910 with one another.

Figure 10:
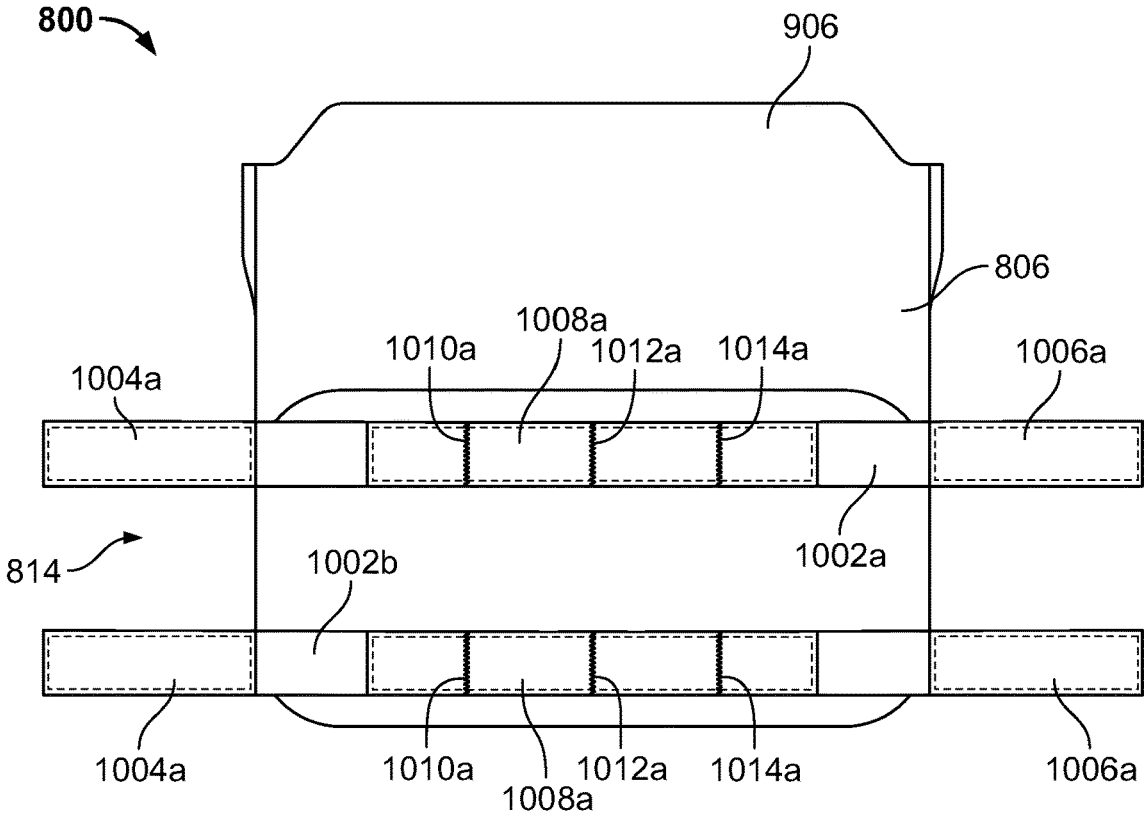
FIG. 10 schematically depicts a view of the back portion of the container from FIGS. 8A-8B, according to one or more aspects described herein.

FIG. 10 schematically depicts a view of the back portion of the container 800, according to one or more aspects described herein. In particular, FIG. 10 schematically depicts the container 800 with the attachment mechanism 814 in an open configuration. In one example, the attachment mechanism 814 may include two straps (e.g. straps 1002*a* and 1002*b*). It is contemplated that the attachment mechanism 814 may utilize a single strap (similar to one of straps 1002*a* and 1002*b*), or three or more straps (similar to one or more of straps 1002*a* and 1002*b*), without departing from the scope of these disclosures. It is contemplated that straps 1002*a* and 1002*b* may be substantially similar. Accordingly, the following describes strap 1002*a* and it may be assumed that similar features are present on strap 1002*b*.

In one implementation, the strap 1002*a* includes fastener elements 1004*a*, 1006*a* and 1008*a*. In one example, elements 1004*a*, 1006*a* and 1008*a* may include hook and loop fasteners, and such that each of elements 1004*a*, 1006*a* and 1008*a* includes one or both of hook and loop elements such that a selected one of the elements 1004*a*, 1006*a* and 1008*a* may be configured to removably couple to itself, or to one or more of the other two fastener elements. In one example, the fastener elements 1004*a*, 1006*a* and 1008*a* may be glued, welded, or sewn onto the strap 1002*a*. For example, elements 1010*a*, 1012*a*, and 1014*a* may represent seams along which the fastener element 1008*a* is sewn to the strap 1004*a*. Further, seams 1010*a*, 1012*a*, and 1014*a* may additionally or alternatively couple the strap 1004*a* to the back portion 806. Further, it is contemplated that fastener elements 1004*a*, 1006*a* and 1008*a* may include fastener structures in addition to, or as an alternative to hook and loop elements. In particular, the fastener elements may include one or more rail/zipper-type fasteners, one or more buttons, clasps, snaps, buckles, pegs, magnets, or ties, among others, without departing from the scope of these disclosures.

Figure 11:
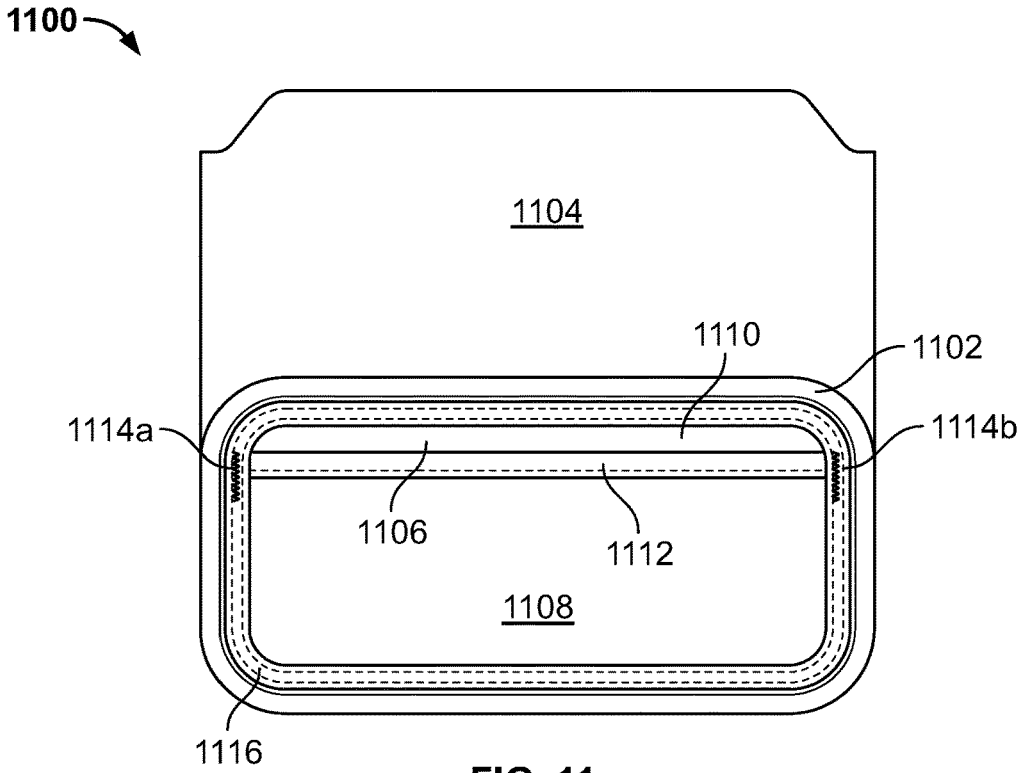
FIG. 11 schematically depicts a portion of an internal back panel of the container from FIGS. 8A-8B, according to one or more aspects described herein.

In one implementation, the storage compartment of the container 800 may include one or more sub-compartments. As such, FIG. 11 schematically depicts a portion of an internal back panel 1100 of the container 800, according to one or more aspects described herein. In particular, the storage compartment of the container 800 may include a storage sub-compartment 1102. In one specific example, the storage sub-compartment 1102 may include a padded slip pocket. In one implementation, the padded slip pocket 1102 may be coupled to an internal back surface 1104. In one example, the back portion 806 of the container 800 may comprise a single layer of material such that the internal back surface 1104 is an internal surface of the back portion 806. In another implementation, the container 800 includes multiple layers of material such that the internal back surface 1104 is a separate structure to that of the back portion 806. It is contemplated that the padded slip pocket 1102 may include an opening 1106 formed between a slip pocket front panel 1108 and a slip pocket back panel 1110. The slip pocket front panel 1108 may have a top edge seam 1112 which is coupled to the slip pocket back panel 1110 at points 1114*a* and 1114*b*. Additionally, the slip pocket back panel 1110 may be coupled to the internal back surface 1104 along seam 1116, which may extend around a full perimeter of the pocket 1108. In one implementation, seam 1116 and coupling points 1114*a* and 1114*b* may comprise sewn couplings. In other implementations, the seam 1116 and coupling points 1114*a* and 1114*b* may additionally or alternatively, be welded or glued, among others.

In certain examples, the sub-compartment 1102 may be padded such that one or more items stored therein is provided an amount of impact absorption to reduce the likelihood of damage if the container 800 is dropped of hit by an external element/structure. Accordingly, one or more of the slip pocket front panel 1108 and the slip pocket back panel 1110 may include one or more padding elements. In one example, one or more of panels 1108 and 1110 may include one or more of a foam (e.g. polyethylene foam), a honeycomb, and/or an air bladder material positioned between two external layers. In another implementation, one or more of panels 1108 and 1110 may include a single layer of a padded material, such as neoprene/polychloroprene, among others.

Figure 12:
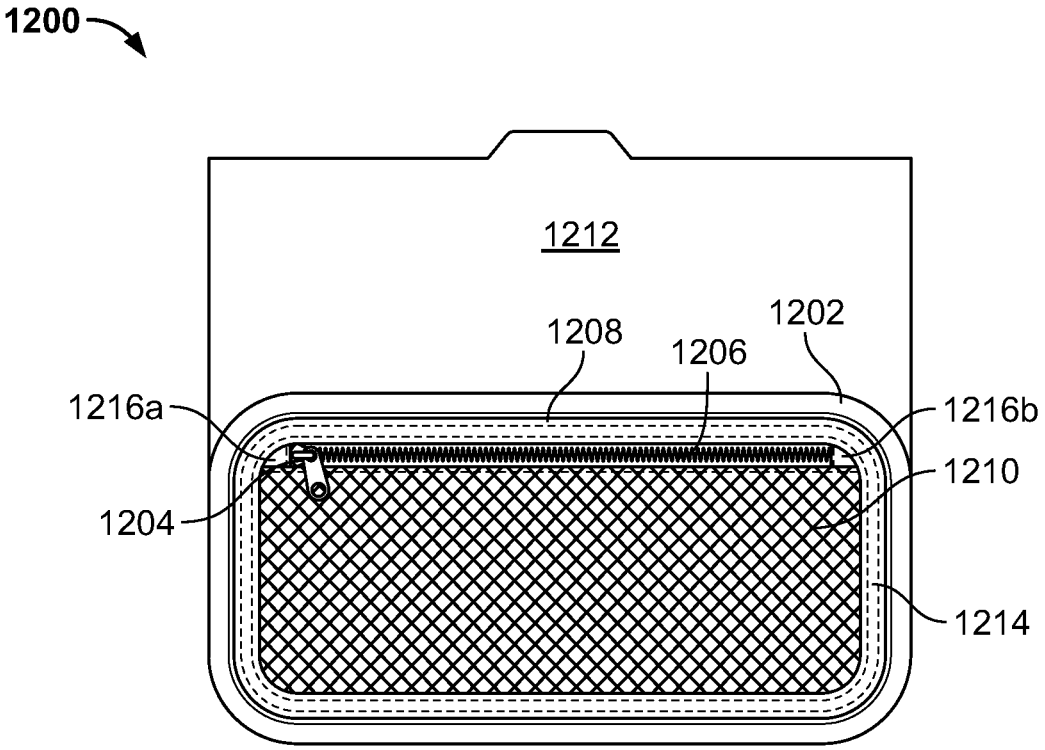
FIG. 12 schematically depicts a portion of an internal front panel of the container from FIGS. 8A-8B, according to one or more aspects described herein.

FIG. 12 schematically depicts a portion of an internal front panel 1200 of the container 800, according to one or more aspects described herein. In a similar manner to sub-compartment 1102 of FIG. 11, FIG. 12 schematically depicts sub-compartment 1202, which may be a padded or unpadded compartment having a zipper closure. In particular, the zipper closure 1204 may be configured to provide a partially or fully sealable closure for opening 1206 that extends into the sub-compartment 1202. Similar to sub-compartment 1102, sub-compartment 1202 may include a zip pocket back panel 1208 and a zip pocket front panel 1210. The zip pocket back panel 1208 may be coupled to the internal front surface 1212 of the container 800. In one example, the internal front surface 1212 is an internal surface of the front portion 804. In other examples, the container 800 may have multiple layers, such that the internal front surface 1212 is spaced apart from the front portion 804 by one or more intermediate material layers.

In one example, the zip pocket back panel 1208 may be coupled to the internal front surface 1212 along seam 1214, which may extend around a full perimeter of the pocket 1202. Further, the seam 1214 may be stitched, welded, or glued, among others. Additionally, the zip pocket front panel 1210 may be coupled to the back panel 1208 and/or internal front surface 1212 along seam 1214. The zipper closure 1204 may include end stops 1216*a* and 1216*b* that are spaced apart across the opening 1206. One or more of the zip pocket back panel 1208 and zip pocket front panel 1210 may be padded or unpadded, similar to the slip pocket front panel 1108 and a slip pocket back panel 1110. Additionally or alternatively, one or more of the zip pocket back panel 1208 and zip pocket front panel 1210 may include a mesh material or partially or wholly transparent polymer material.

Figures 13A, 13B:
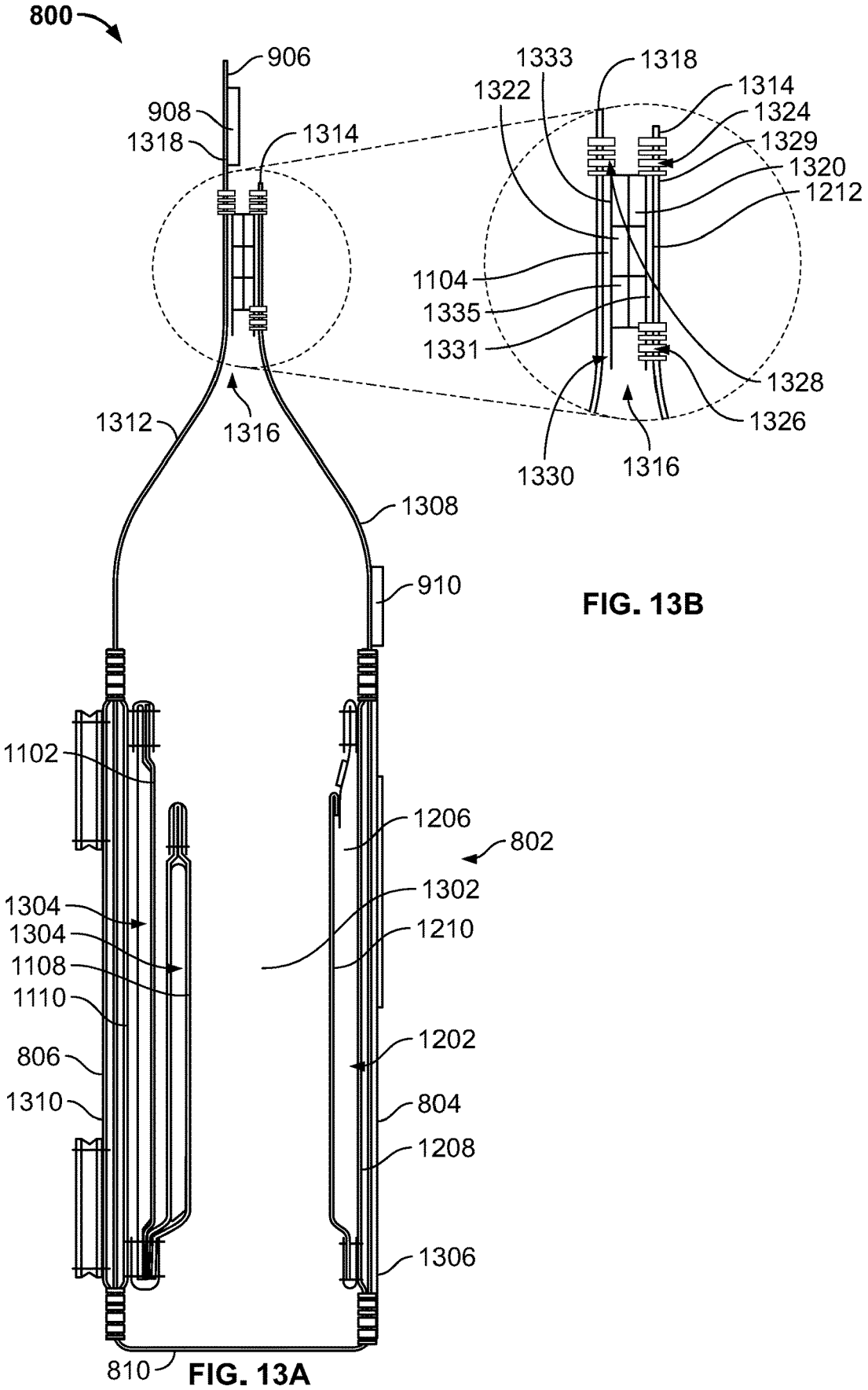
FIG. 13A schematically depicts a cross-sectional end view of one implementation of the container from FIGS. 8A-8B, according to one or more aspects described herein.
FIG. 13B schematically depicts a more detailed view of the opening of the container from FIGS. 8A-8B, according to one or more aspects described herein.

FIG. 13A schematically depicts a cross-sectional end view of one implementation of the container 800, according to one or more aspects described herein. As previously described, an internal compartment 1302 is enclosed by front portion 804, back portion 806, and base portion 810 (as well as side portions 808 not depicted in FIG. 13A). Further, the internal compartment 1302 may include one or more sub-compartments 1102 and 1202.

Further to the description of FIG. 11, FIG. 13A schematically depicts padding layers 1304 within the slip pocket front panel 1108 and slip pocket back panel 1110. In one specific implementation, padding layers 1304 may include 0.5-5 mm of polyethylene foam. It is contemplated that other types of foams, padding materials, and/or other thickness may be utilized, without departing from the scope of these disclosures.

As previously described, one or more of the front portion 804, a back portion 806, side portions 808, and base portion 810 may include multiple material panels that are coupled together. In one specific example, the front portion 804 may include a lower front portion 1306 that is coupled to an upper front portion 1308. Similarly, the back portion 806 may include a lower back portion 1310 that is coupled to an upper back portion 1312. Alternatively, the lower front portion 1306 and the upper front portion 1308 may be formed as a single element, and/or the lower back portion 1310 and the upper back portion 1312 may be formed as a single element. In one example, the upper front portion 1308 may include a front edge 1314 of the opening 1316 into the compartment 1302. Similarly, the upper back portion 1312 may include a back edge 1318 of the opening 1316.

FIG. 13B schematically depicts a more detailed view of the opening 1316 of container 800, according to one or more aspects described herein. In particular, FIG. 13B schematically depicts a cross-sectional end view of a first magnetic strip 1320 having a first magnetic strip top side 1329 and a first magnetic strip bottom side 1331, and coupled to an internal surface 1212 of the front portion 804 at a front edge 1314 of the opening 1316. Similarly, a second magnetic strip 1322 having a second magnetic strip top side 1333 and a second magnetic strip bottom side 1335, and may be coupled to an internal surface 1104 of the back portion 806 at a back edge 1318 of the opening 1316.

In one implementation, the first magnetic strip 1320 may be rigidly coupled to the internal surface 1212 along at least an upper seam 1324 and a lower seam 1326. Further, the second magnetic strip 1322 may be hingedly coupled to the internal surface 1104. The hinged coupling of the magnetic strip 1322 may be at seam 1328 at the back edge 1318 of the opening 1316. As such, the second magnetic strip 1322 may have a loose end 1330 that is uncoupled from the surface 1104 and may rotate about the seam 1328. Further, the second magnetic strip bottom side 1335 may be unattached to the outer shell 802. In other examples, either or both of the first magnetic strip bottom side 1331 and the second magnetic strip bottom side 1335 may be unattached to the outer shell 802.

Figure 13C:
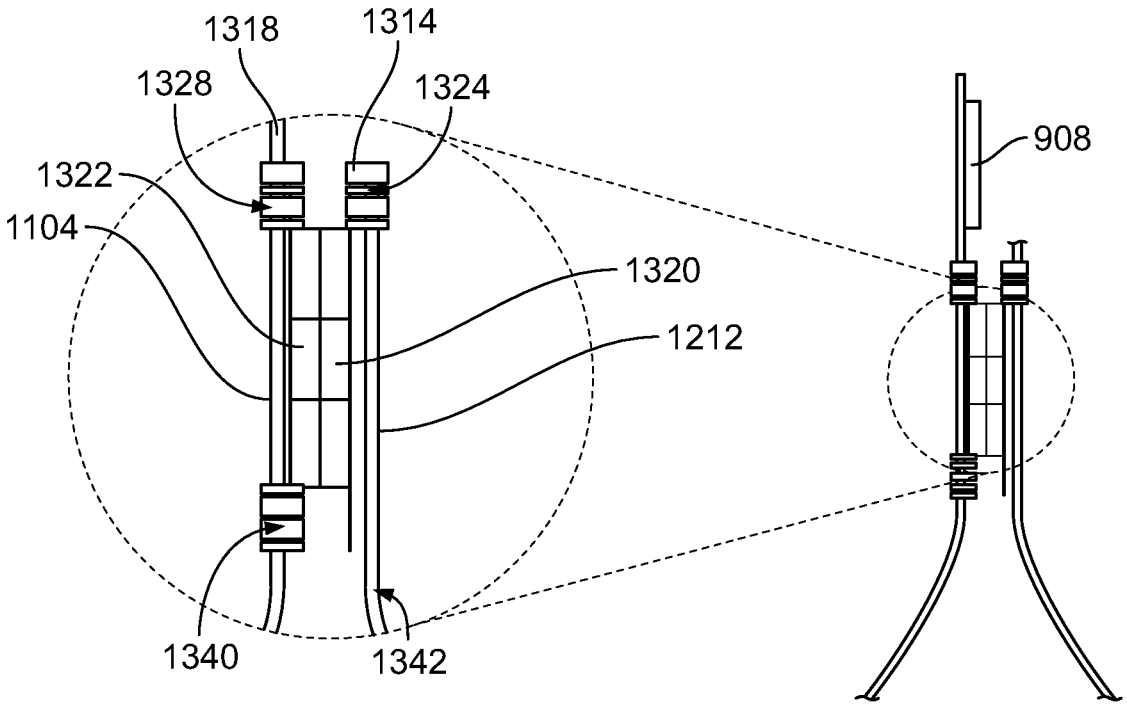
FIG. 13C schematically depicts an alternative implementation of the opening of the container from FIGS. 8A-8B, according to one or more aspects described herein.

In another implementation, as schematically depicted in FIG. 13C, the first magnetic strip 1320 may be hingedly coupled to the internal surface 1212 along the upper seam 1324, and the second magnetic strip 1322 may be rigidly coupled to the internal surface 1104 by the upper seam 1328 and another lower seam 1340, without departing from the scope of these disclosures. As such, the first magnetic strip 1320 may have a loose end 1342 that is uncoupled from the surface 1212 and may rotate about the seam 1324.

Figure 13D:
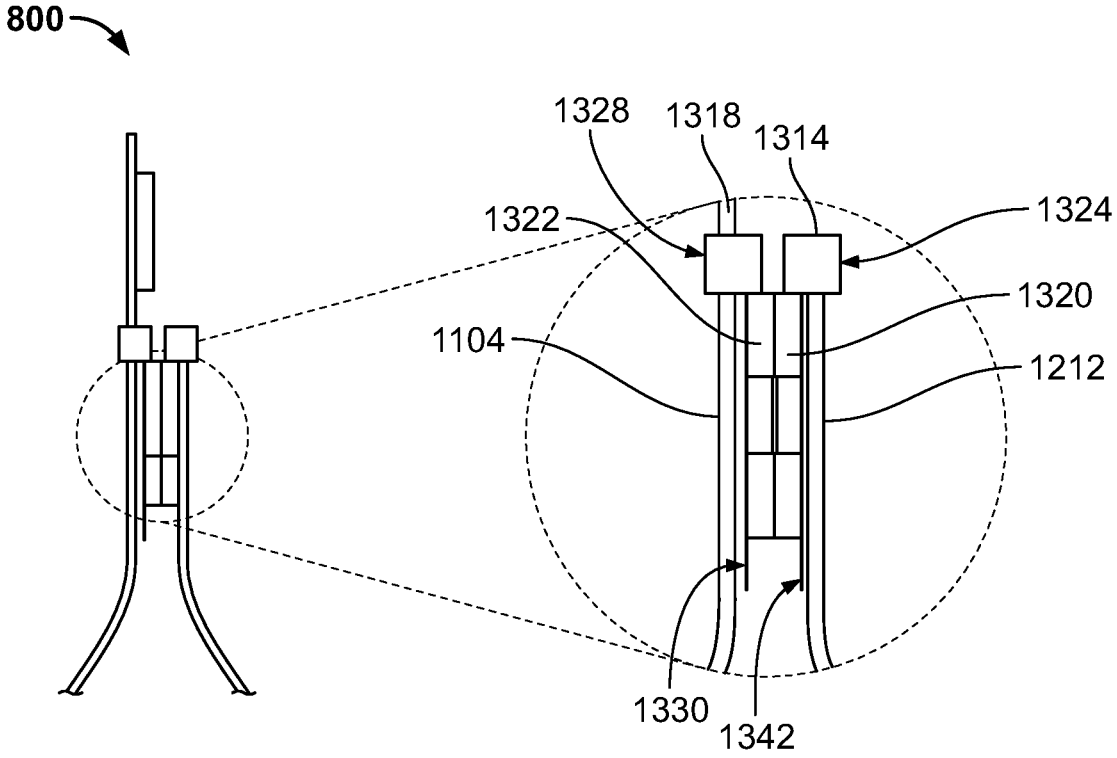
FIG. 13D schematically depicts an alternative implementation of the opening of the container from FIGS. 8A-8B, according to one or more aspects described herein.

In yet another implementation, as schematically depicted in FIG. 13D, both the first magnetic strip 1320 and the second magnetic strip 1322 may be hingedly coupled to the respective internal surfaces 1212 and 1104 at the respective front edges 1314 and 1318. As such, the first magnetic strip 1320 may have a loose end 1342 that is uncoupled from the surface 1212 and the second magnetic strip 1322 may have a loose end 1330 that is uncoupled from the surface 1104.

Advantageously, the hinged coupling of one or more of the first and/or second magnetic strips 1320 and 1322 may allow the magnetic coupling to remain engaged and seal the compartment 1302 up to a comparatively higher internal/external pressure being applied to the sidewalls of the internal compartment 1302 than if both of the magnetic strips 1320 and 1322 were rigidly coupled to the respective internal surfaces 1212 and 1104.

The containers described throughout these disclosures may be configured to remain sealed in response to a pressure differential between an internal storage compartment of a given container and an external environment surrounding the container. In one implementation, container 800 may be configured to remain sealed up to a first pressure level using the magnetic closure formed by magnetic strips 1320 and 1322 being magnetically coupled to one another. Further, container 800 may be configured to remain sealed up to a second pressure level, higher than the first pressure level, when both the magnetic closure, formed by magnetic strips 1320 and 1322, is engaged and a secondary closure is engaged by removably coupling the fastener element 908 to the fastener element 910. In one example, the use of the secondary closure, formed by fastener elements 908 and 910, in combination with the magnetic closure formed by magnetic strips 1320 and 1322, may increase by a factor of 5 or more the pressure to which the seal of the internal storage compartment of container 800 can withstand when compared to the use of the magnetic closure formed by magnetic strips 1320 and 1322 alone. In other examples, the pressure tolerance resulting from engaging fastener elements 908 and 910 in combination with the magnetic closure formed by magnetic strips 1320 and 1322 may increase by a factor of 5-10. In one implementation, the magnetic closure formed by magnetic strips 1320 and 1322 may be configured to withstand a pressure of 0.5-0.9 psi or more, and the combination of magnetic closure formed by magnetic strips 1320 and 1322, and the secondary closure formed by fastener elements 908 and 910, may be configured to withstand a pressure of 2.5-4.5 psi or more. Further, it is contemplated that alternative pressure ranges may be withstood by container 800, or any other container described throughout this disclosure.

Figure 14:
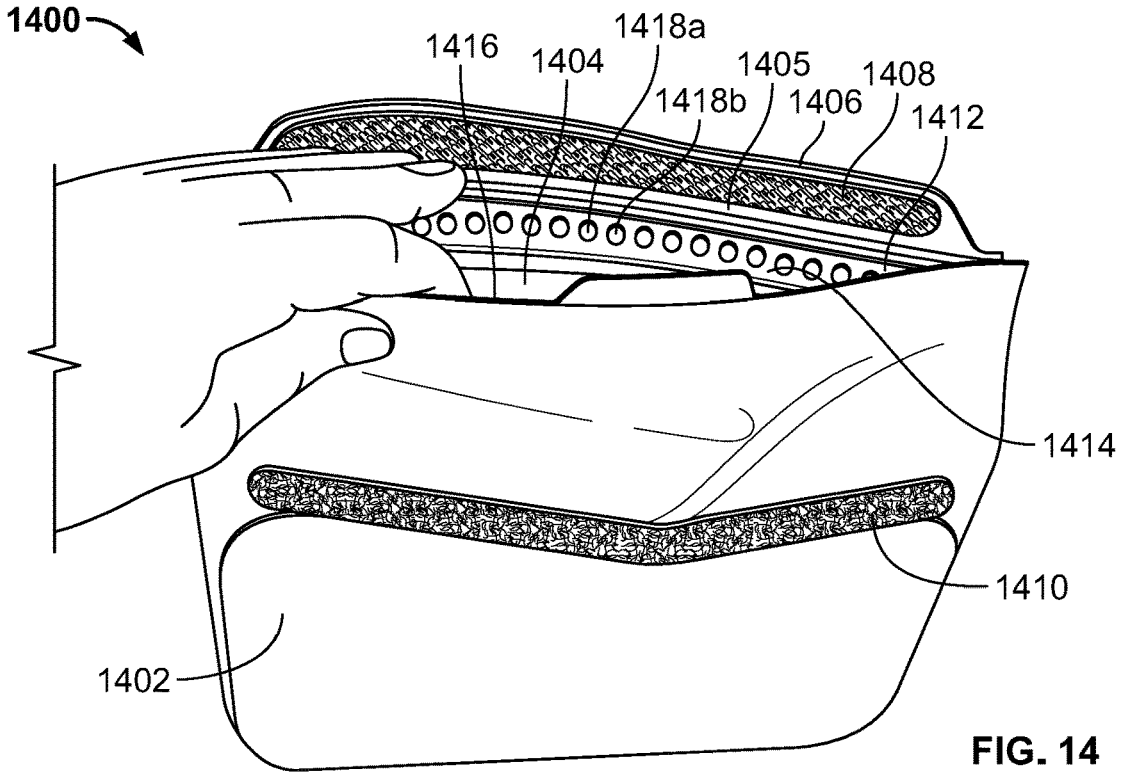
FIG. 14 depicts one implementation of a container, according to one or more aspects described herein.

FIG. 14 depicts one implementation of a container 1400, similar to container 800, according to one or more aspects described herein. In particular, container 1400 may include a front portion 1402 that may be similar to front portion 802, and a back portion 1404 that may be similar to back portion 806. The container 1400 may also include a flap portion 1406 that may be similar to the flap portion 906. As such, the flap portion 1406 may have a first fastener element 1408 coupled thereto. The first fastener element 1408 may be similar to first fastener element 908, and may be configured to couple to a second fastener element 1410 that is coupled to an external surface of the front portion 1402. As such, the second fastener element 1410 may be similar to the second fastener element 910. In one specific example, the first and second fastener elements 1408 and 1410 may include hook and loop fastener elements. However, additional or alternative fastener elements may be utilized with these elements, without departing from the scope of these disclosures. For example, both the first and second fastener elements 1408 and 1410 may include magnetic fasteners, such as magnetic strips, among others.

Additionally, FIG. 14 depicts a magnetic strip 1412. This magnetic strip 1412 may be similar to magnetic strip 1322, and may be configured to magnetically seal an opening 1414 of the container 1400. In particular, the magnetic strip 1412 may be coupled to an internal surface of the back portion 1404 at a back edge 1405 of the opening 1414. In one example, the magnetic strip 1412 may be configured to magnetically attach to a second magnetic strip (not depicted) that is coupled to an internal surface of the front portion 1402 at a front edge 1416 of the opening 1414.

In one implementation, the magnetic strip 1412 may include a row of magnetic elements (e.g. elements 1418*a*, 1418*b* etc.). In one implementation, these magnetic elements 1418*a*, 1418*b* may be permanent magnets. In another example, the magnetic elements 1418*a*, 1418*b* may be magnetically attracted to permanent magnets. It is further contemplated that the magnetic strip 1412 may, additionally or alternatively, include an array of magnetic elements similar to elements 1418*a* and 1418*b* that has two or more rows. Further, it is contemplated that the magnetic strip 1412 may include one or more continuous magnetic bands, rather than a series of multiple magnetic elements (e.g. elements 1418*a* and 1418*b*). These magnetic bands may include one or more magnetic wires or foils, without departing from the scope of these disclosures. Further, additional or alternative implementations of magnetic closures may be utilized with the container 1400, without departing from the scope of these disclosures. In one example, the magnetic seal formed by the magnetic strips 1320, 1322 and/or 1412 may form a partially or wholly water resistant seal of the openings 902 and/or 1414.

Figure 15:
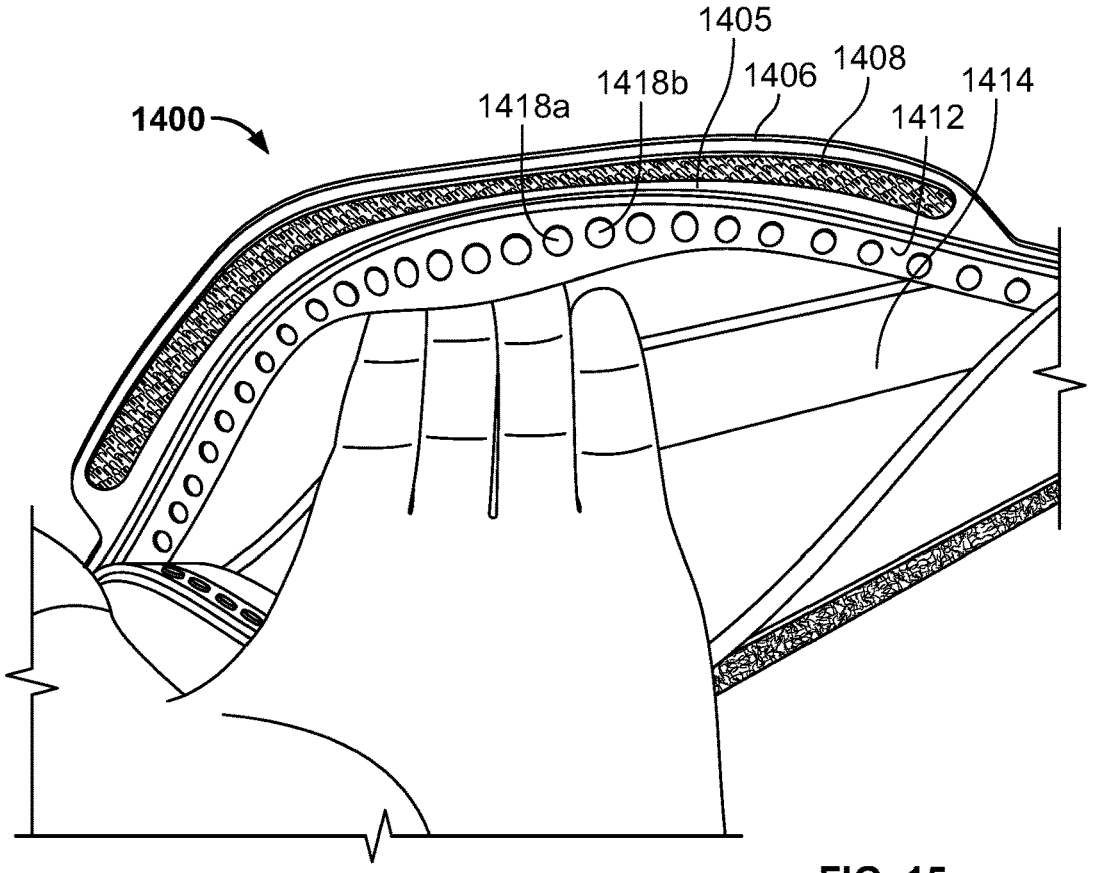
FIG. 15 depicts another view of the container from FIG. 14, according to one or more aspects described herein.

FIG. 15 depicts another view of the container 1400 from FIG. 14, according to one or more aspects described herein. In one example, FIG. 15 illustrates that the magnetic strip 1412 may be hingedly coupled to an internal surface of the back portion 1404 at a back edge 1405 of the opening 1414.

Figure 16:
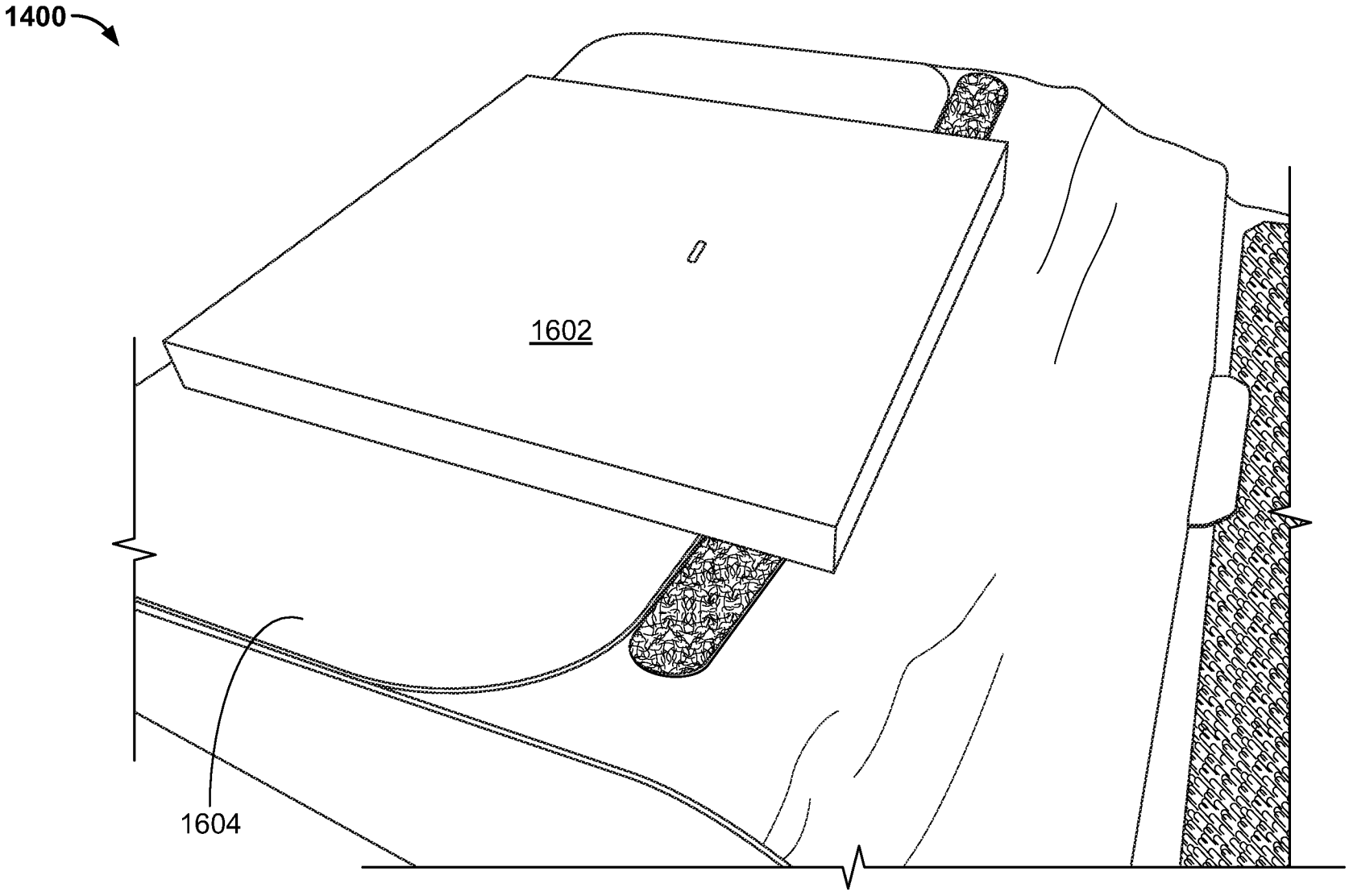
FIG. 16 depicts another view of the container from FIG. 14, according to one or more aspects described herein.

FIG. 16 depicts another view of the container 1400 from FIG. 14, according to one or more aspects described herein. In particular, FIG. 16 depicts a test of the magnetic fastener of the container 1400, e.g. the fastener that includes the magnetic strip 1412 that is configured to magnetically couple to a second magnetic strip in order to seal the opening 1414. As depicted, the container 1400 demonstrates the ability of the magnetic fastener to maintain an airtight seal as a 5 kg mass is positioned on a back portion 1604 of the container 1600 (in this test setup, the container 1600 only contains air).

Figure 17B:
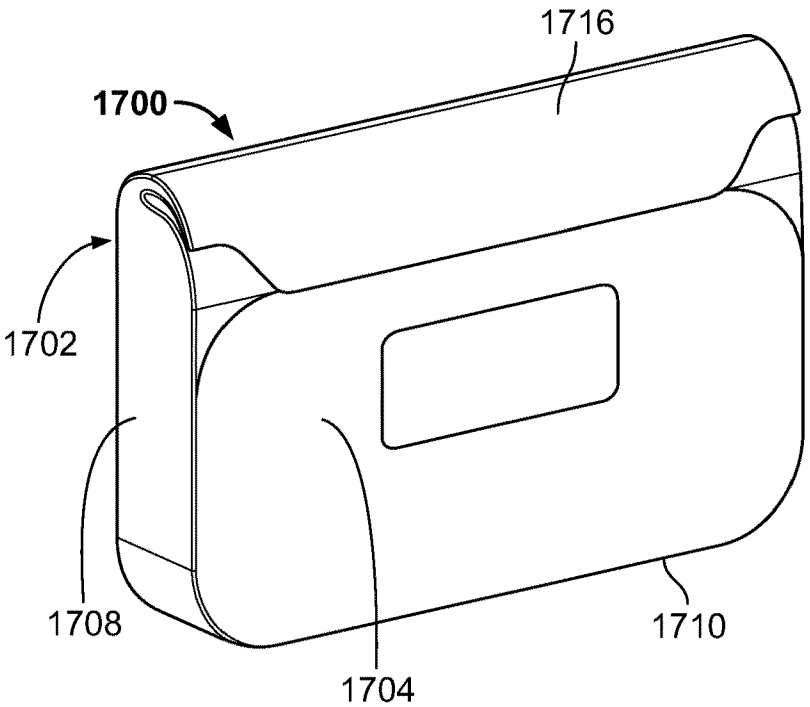
FIGS. 17A-17B schematically depict isometric views of another implementation of a container, according to one or more aspects described herein.
Figure 17A:
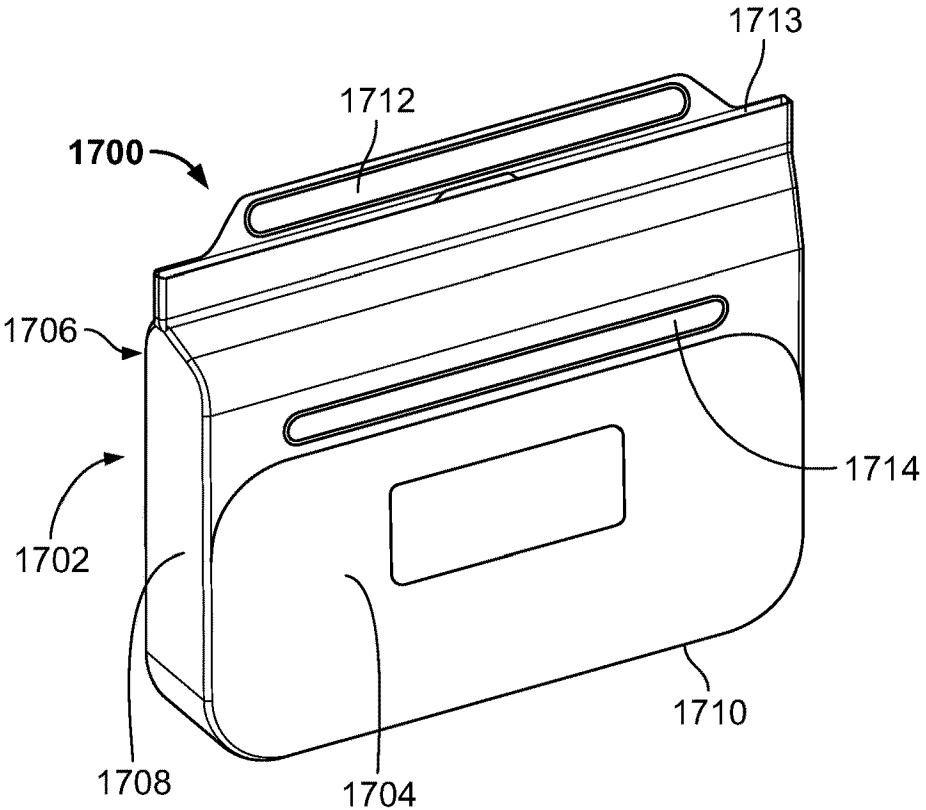

FIGS. 17A-17B schematically depict isometric views of another implementation of a container 1700, according to one or more aspects described herein. In particular, FIG. 17A schematically depicts the container 1700 in an open configuration and FIG. 17B schematically depicts the container in a closed configuration. In one example, container 1700 may be similar to container 800, and have an outer shell 1702 with a front portion 1704, a back portion 1706, side portions 1708, and a base portion 1710. Additionally, container 1700 has a first fastener element 1712 that is configured to be removably coupled to a second fastener element 1714. In order to removably couple the first fastener element 1712 to the second fastener element 1714, a flap portion 1716 of the back portion 1706 may be folded or rolled, to bring the first fastener element 1712 proximate the second fastener element 1714. It is further contemplated that the container 1700 may have a magnetic closure 1713, similar to that of magnetic closure described in relation to FIG. 13B. As such, in one example, when the container 1700 is in the open configuration of FIG. 17A, the magnetic closure may be capable of sealing the container 1700 up to 0.25 psi pressure. In other examples, when the container 1700 is in the open configuration of FIG. 17A, the magnetic closure may be capable of sealing the container 1700 for pressures of up to 0.3 psi, 0.4 psi, 0.5 psi, 0.6 psi, 0.7 psi, or 1.0 psi. Further, when in the closed configuration of FIG. 17B, the combination of the magnetic closure 1713 and the first and second fastener element 1712 and 1714 may be capable of sealing the container 1700 up to a pressure of 2.75 psi. In other examples, the combination of the magnetic closure 1713 and the first and second fastener element 1712 and 1714 may be capable of sealing the container 1700 up to a pressure of 3.0 psi, 3.5 psi, 4.0 psi, 4.5 psi, or 0.50 psi.

Figure 18B:
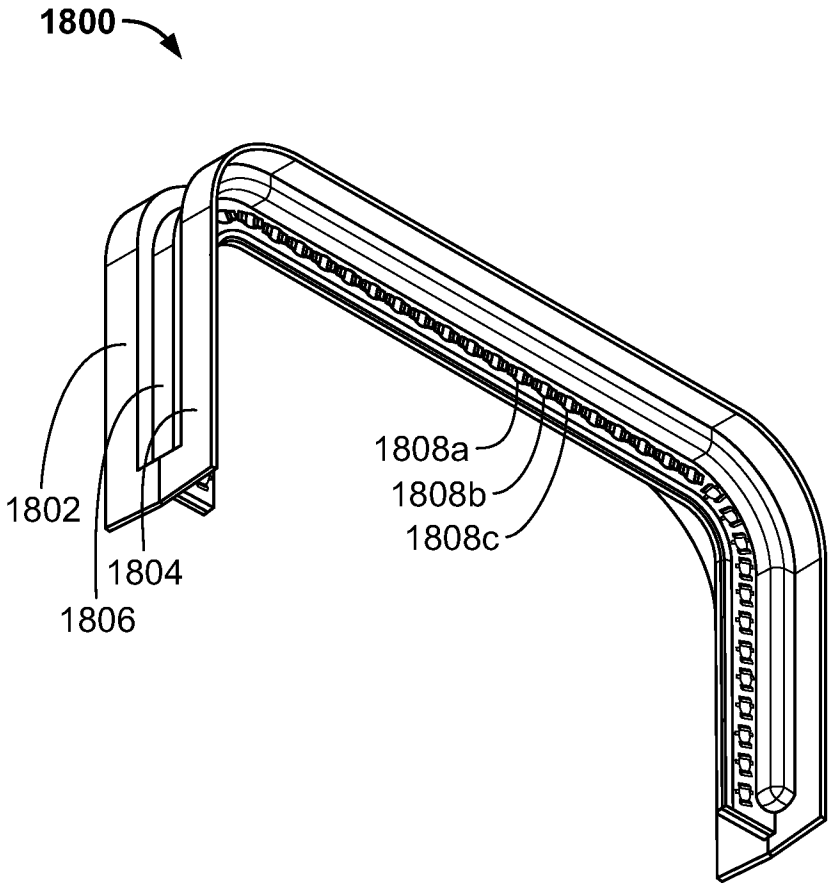
FIGS. 18A-18B schematically depict isometric views of a closure mechanism, according to one or more aspects described herein.
Figure 18A:
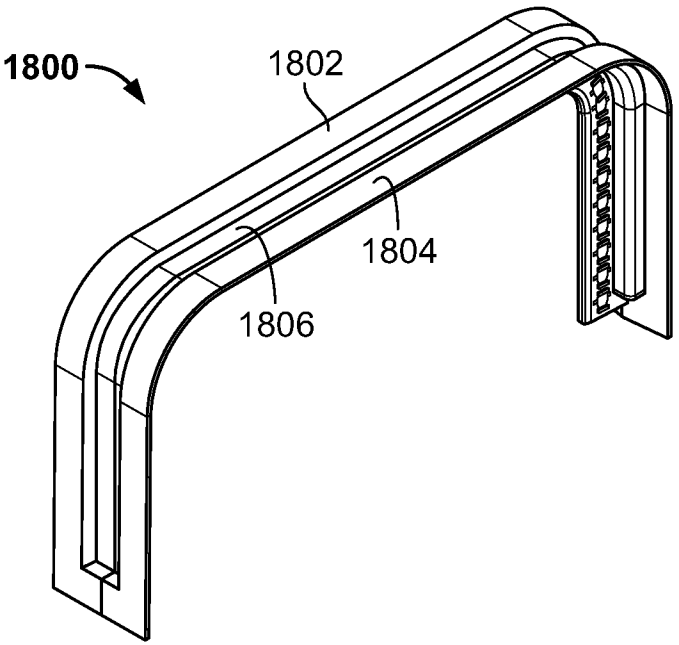

FIGS. 18A-18B schematically depict isometric views of a closure mechanism, according to one or more aspects described herein. In particular, FIG. 18A schematically depicts an isometric view of a top portion of a closure mechanism 1800. The closure mechanism 1800 may be similar to the closure mechanism of container 400, and include a back frame 1802, similar to back frame 604, that is configured to be magnetically and removably coupled to a front frame 1804, similar to front frame 602. When coupled, as depicted in FIGS. 18A-18C, a zipper trough, or zipper channel 1806 is formed. In one example, the zipper trough 1806 may be configured to provide clearance for a slider body to move along a zipper tape (e.g. zipper 614). FIG. 18B schematically depicts an isometric view of a bottom portion of the closure mechanism 1800. In one example, each of the back frame 1802 and the front frame 1804 may include a plurality of magnetic elements, of which elements 1808*a*-1808*c* are examples of a plurality of similar elements. In one implementation, the magnetic elements, e.g. elements 1808*a*-1808*c*, may be coupled to the front frame 1804 and the back frame 1802 using one or more molding, overmolding, gluing, or interference fitting processes. In one example, the magnetic elements within each of the back frame 1802 and the front frame 1804 may abut one another when the front frame 1804 is magnetically coupled to the back frame 1802. In another example, the magnetic elements within each of the back frame 1802 and/or the front frame 1804 may exert a magnetic force to without directly contacting one another. In one example, the magnetic elements, e.g. elements 1808*a*-1808*c*, may be permanent magnets, or may be ferromagnetic or paramagnetic materials. Additionally or alternatively, the closure mechanism 1800 may include magnetic strips, rather than discrete magnetic elements (e.g. elements 1808*a*-1808*c*), without departing from the scope of these disclosures.

Figure 19:
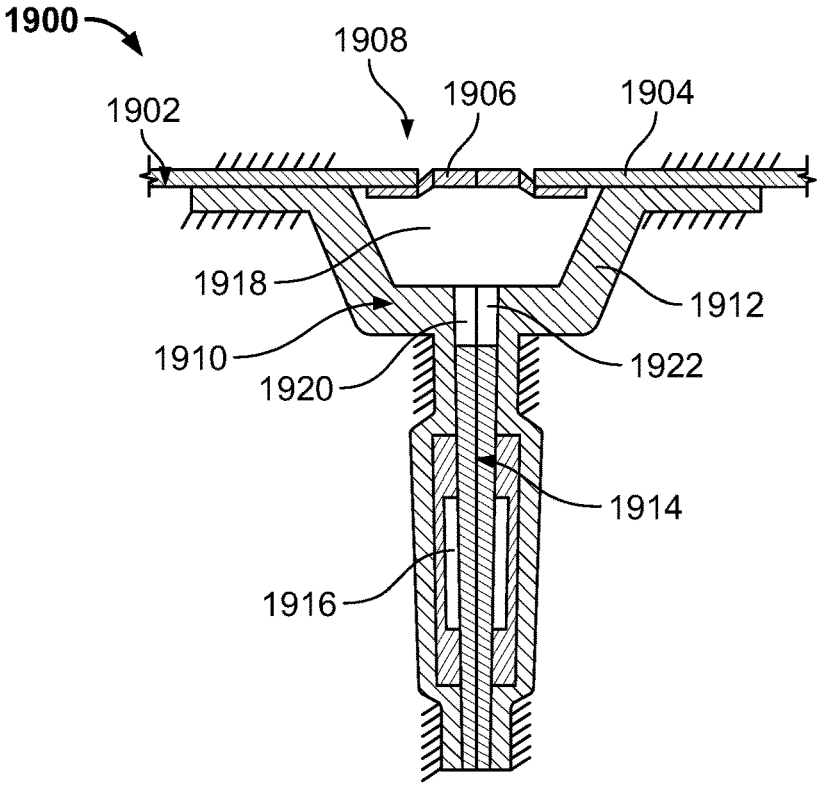
FIG. 19 schematically depicts a cross-sectional view of another implementation of a closure mechanism 1900, according to one or more aspects described herein.

FIG. 19 schematically depicts a cross-sectional view of another implementation of a closure mechanism 1900, according to one or more aspects described herein. In one example, the closure mechanism 1900 may be similar to the closure mechanism of container 400, and include a back shell 1902 and a front shell 1904 which form an outer shell of a container, similar to container 400. Additionally, the closure mechanism 1900 may include a zipper 1906 that is configured to provide a first closure of an opening 1908 between the back shell 1902 and the front shell 1904. In one example, the zipper 1906 may be stretchably coupled to the back shell 1902 and the front shell 1904 such that when the zipper 1906 is closed a tensile force urges a front frame 1912 toward a back frame 1910. In turn, this tensile force urges a front magnet strip 1914 toward a back magnetic strip 1916. In one example, when the front frame 1912 is magnetically and removably coupled to the back frame 1910, a zipper trough 1918 is formed. In another example, the closure mechanism 1900 may include gasket elements 1920 and 1922 configured to provide additional sealing of the opening 1908 when the front magnet strip 1914 is magnetically coupled to the back magnetic strip 1916.

Figure 20:
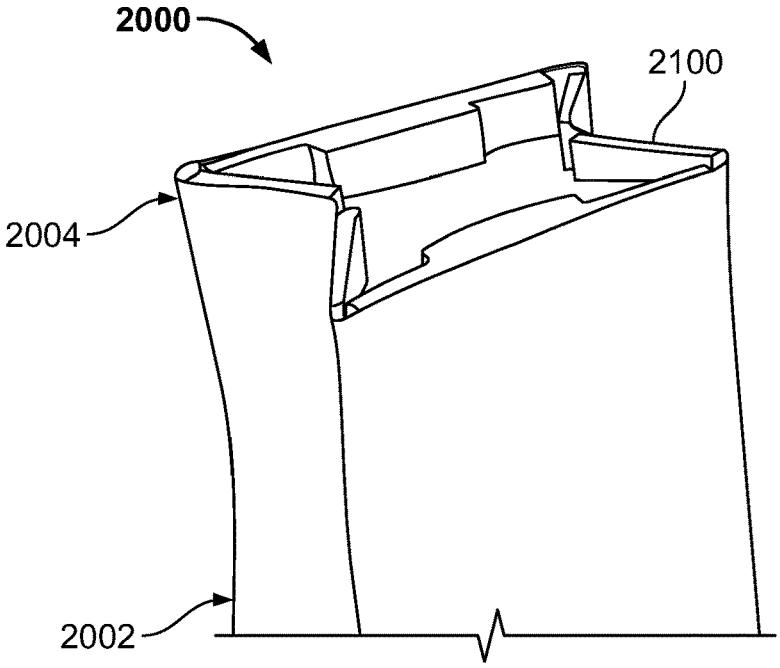
FIG. 20 schematically depicts an implementation of a closure mechanism, according to one or more aspects described herein.

FIG. 20 schematically depicts an implementation of a closure mechanism 2000, according to one or more aspects described herein. In one example, the closure mechanism 2000 is configured to resealably seal a container. Outer shell 2002 is one example of a type of container with which the closure mechanism 2000 may be utilized. It is contemplated, however, that the closure mechanism 2000 may be utilized with any container type, and outer shell 2002 represents one exemplary implementation. The outer shell 2002 may be formed of a water resistant material, or a partially or fully permeable material. While not depicted in the schematic representation of FIG. 20, the outer shell 2002 may generally have a front portion, a back portion, side portions, and a base portion. The outer shell 2002 may also include an opening 2004. The closure mechanism 2000 may be configured to resealably seal the opening 2004. In one example, the closure mechanism 2000 is configured to fold between an open configuration and a closed configuration to resealably seal the opening 2004. The closure mechanism 2000 may include magnetic elements configured to provide a sealing force. Further, the seal provided by the closure mechanism 2000 may be substantially watertight and/or airtight when in a closed configuration.

As depicted in FIG. 20, the closure mechanism 2000 is positioned in a partially folded configuration through which the closure mechanism 2000 is moved as it is transitioned between a fully open configuration and a closed configuration. In one example, the closure mechanism 2000 includes a folding magnetic collar 2100 that is coupled to the opening of the outer shell 2002. This folding magnetic collar 2100 is described in further detail in relation to FIGS. 21A and 21B.

Figure 21A:
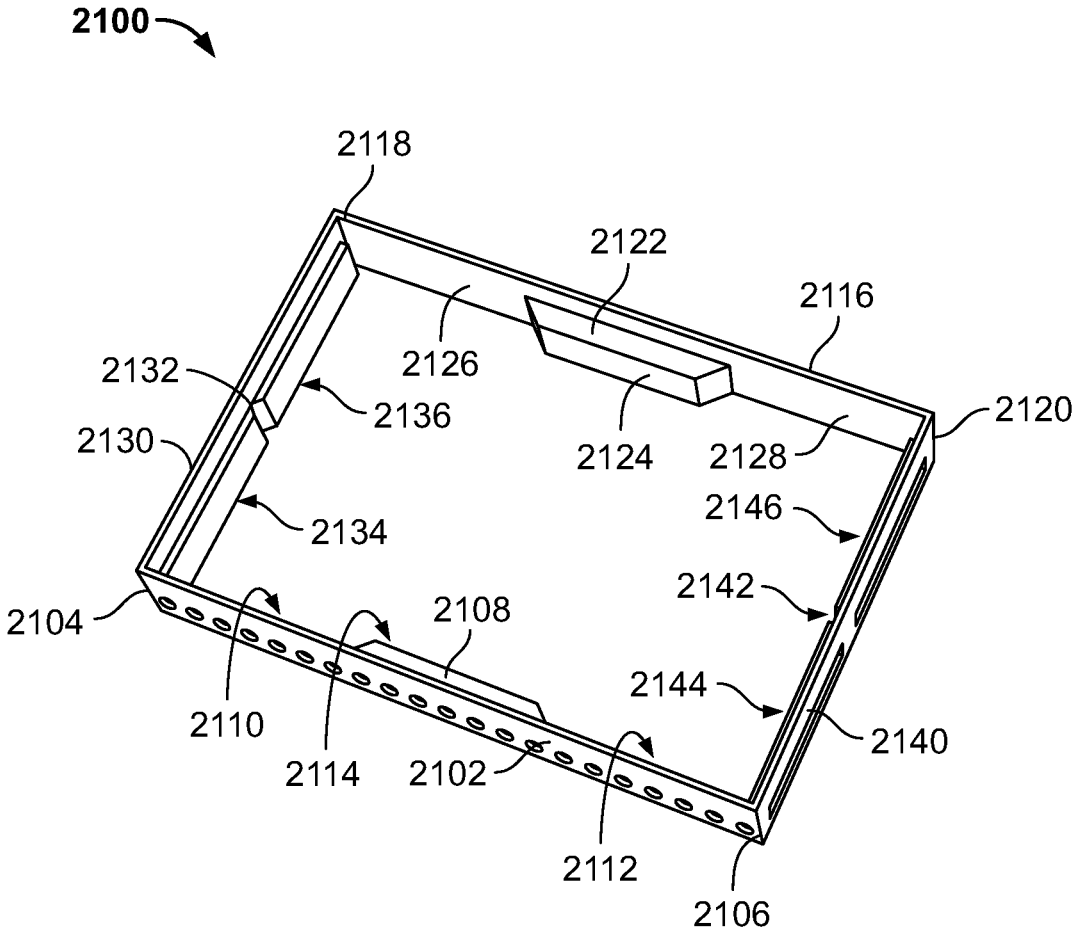
FIGS. 21A and 21B depict the folding magnetic collar of the closure mechanism, according to one or more aspects described herein.
Figure 21B:
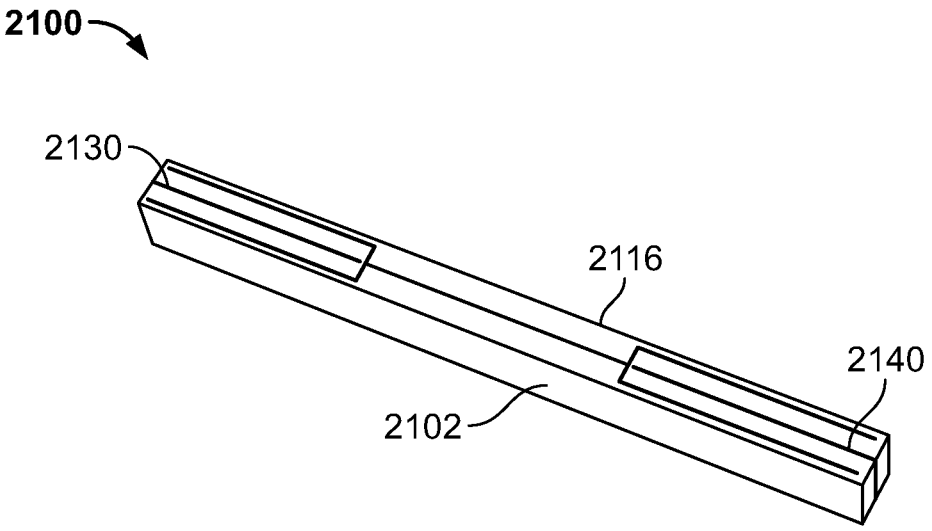

FIGS. 21A and 22B depict the folding magnetic collar 2100 of the closure mechanism 2000, according to one or more aspects described herein. In particular, FIG. 21A depicts the folding magnetic collar 2100 in a fully open configuration, and FIG. 21B depicts the folding magnetic collar 2100 in a fully closed configuration. The fully closed configuration of FIG. 21B may seal an opening of a container, such as opening 2004 of outer shell 2002.

The folding magnetic collar 2100 may include a front collar member 2102 that linearly extends between a first end 2104 and a second end 2106. These first and second ends 2104 and 2106 may be coupled to respective first and second ends of a front of an opening, such as opening 2004. The front collar member 2102 may also include a projection 2108 that extends toward a back collar member 2116. The projection 2108 may have a first magnetic surface 2114 that faces the back collar member 2116. Additionally, the front collar member 2102 may include a second magnetic surface 2110 spaced apart from a third magnetic surface 2112 by the projection 2108.

The back collar member 2116 of the folding magnetic collar 2100 may extend between a first end 2118 and a second end 2120. These first and second ends 2118 and 2120 may be coupled to respective first and second ends of a back of an opening, such as opening 2004. The back collar member 2116 may also include a projection 2122 that extends toward the front collar member 2102. The projection 2122 may have a first magnetic surface 2124 that faces front collar member 2102. Additionally, the back collar member may include a second magnetic surface 2126 spaced apart from a third magnetic surface 2128 by the projection 2122.

The folding magnetic collar 2100 may include a first side collar member 2130 that extends along a first side of an opening, such as opening 2004. The first side collar member 2130 may be hingedly coupled to the first end 2104 of the front collar member 2102 and hingedly coupled to the first end 2118 of the back collar member 2116. The first side collar member 2130 additionally includes a center hinge 2132 that separates a first magnetic element 2134 from a second magnetic element 2136.

The folding magnetic collar 2100 includes a second side collar member 2140 that extends along a second side of an opening, such as opening 2004. The second side collar member 2140 may be hingedly coupled to the second end 2106 of the front collar member 2102 and hingedly coupled to the second end 2120 of the back collar member 2116. The second side collar member 2140 additionally includes a center hinge 2142 that separates a first magnetic element 2144 from a second magnetic element 2146.

As described, the folding magnetic collar 2100 includes a hinge between the front collar member 2102 and the first side collar member 2130 at first end 2104. Additionally, the front collar member 2102 is hinged to the second side collar member 2140 at second end 2106. Similarly, the back collar member 2116 is hinged to the first side collar member 2130 at first end 2118 and to the second side collar member 2140 at second end 2120. Further, the first side collar member 2130 includes center hinge 2132, and the second side collar member 2140 includes center hinge 2142. It is contemplated that any of these hinge elements may include a live hinge structure that includes a flexure constructed from one or more polymers, metals, or alloys. Additionally or alternatively, any of these hinge elements may include any mechanical hinge mechanism that includes separate hinge elements that are rotatably coupled to one another.

As depicted in FIG. 21A, when the folding magnetic collar 2100 is in a fully open configuration, the front collar member 2102, the back collar member 2116, the first side collar member 2130, and the second side collar member 2140 are positioned in a substantially rectilinear configuration. When folded, the center hinge 2132 of the first side collar member 2130 hinges the first and second magnetic elements 2134 and 2136 of the first side collar member 2130 into contact with one another. Additionally, the hinged coupling of the first side collar member 2130 to the first end 2104 of the front collar member 2102 and to the first end 2118 of the back collar member 2116 hinges the first and second magnetic elements 2134 and 2136 of the first side collar member 2130 into contact with the second magnetic surface 2110 of the front collar member 2102 and the second magnetic surface 2126 of the back collar member 2116.

When folded, the center hinge 2142 of the second side collar member 2140 hinges the first and second magnetic elements 2144 and 2146 of the second side collar member 2140 into contact with one another. Additionally, the hinged coupling of the second side collar member 2140 to the second end 2106 of the front collar member 2102 and to the second end 2120 of the back collar member 2116 hinges the first and second magnetic elements 2144 and 2146 of the second side collar member 2140 into contact with the second magnetic surface 2112 of the front collar member 2102 and the second magnetic surface 2128 of the back collar member 2116.

When folded, the center hinge 2132 of the first side collar member 2134 and the center hinge 2142 of the second side collar member 2140 hinge the first magnetic surface 2110 and the second magnetic surface 2112 of the front collar member 2102 into contact with the respective first magnetic surface 2126 and second magnetic surface 2128 of the back collar member 2116. This closed configuration is depicted in FIG. 21B.

Figure 22:
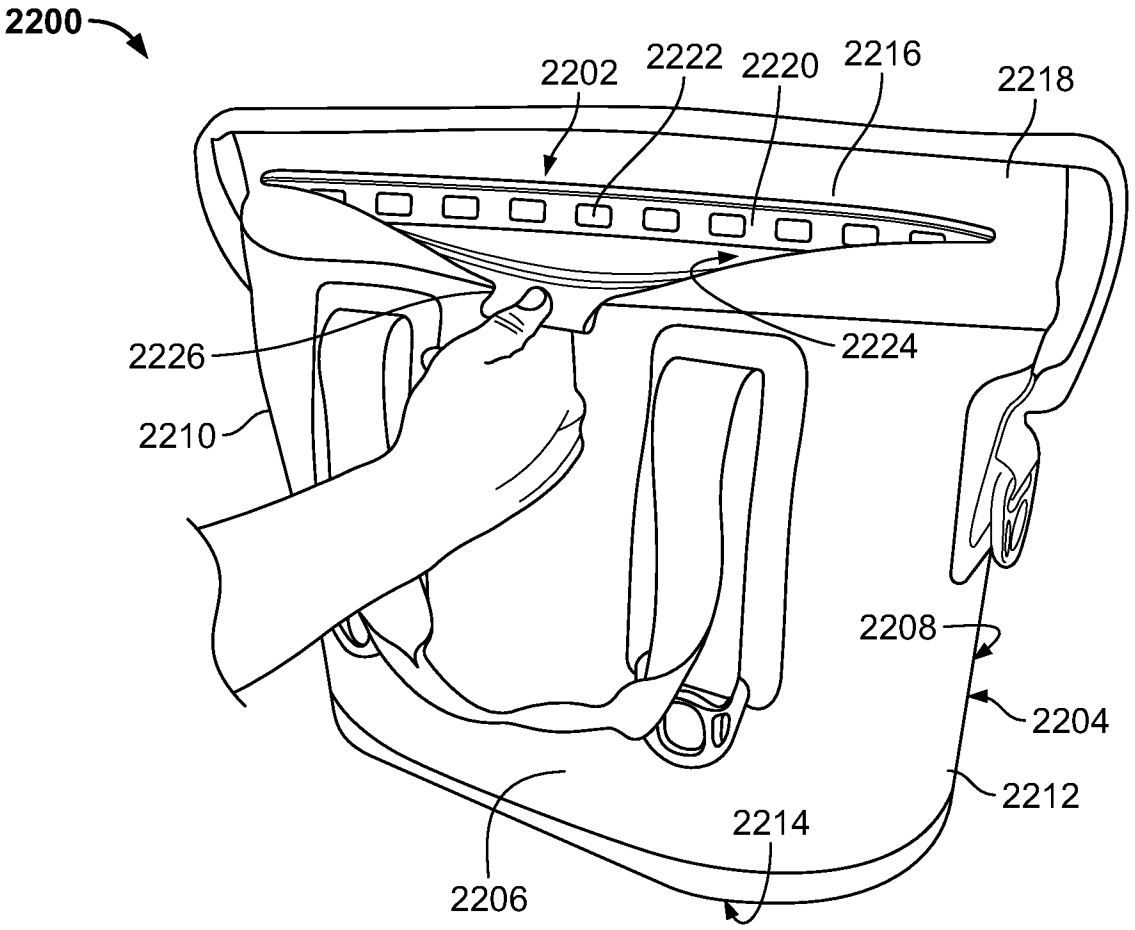
FIG. 22 depicts a container that has a magnetic closure, according to one or more aspects described herein.

FIG. 22 depicts a container 2200 that has a magnetic closure 2202, according to one or more aspects described herein. In one example, the container 2200 may be similar to any of the containers described throughout this disclosure. In another example, container 2200 may be similar to one or more of the insulating containers described in U.S. application Ser. No. 15/790,926, filed 23 Oct. 2017, titled "Insulating Container," the entire contents of which are incorporated herein by reference for any and all nonlimiting purposes.

The container 2200 may include an outer shell 2204 that is constructed from a water resistant material. The outer shell 2204 may include a front portion 2206, a back portion 2208, side portions 2210 and 2212, and a base portion 2214. In one example, an opening 2216 may be positioned at a top portion 2218 of the container 2200. However, it is contemplated that the magnetic closure mechanism 2202 may be utilized to resealably seal alternative opening implementations of containers similar to container 2200.

Figure 23:
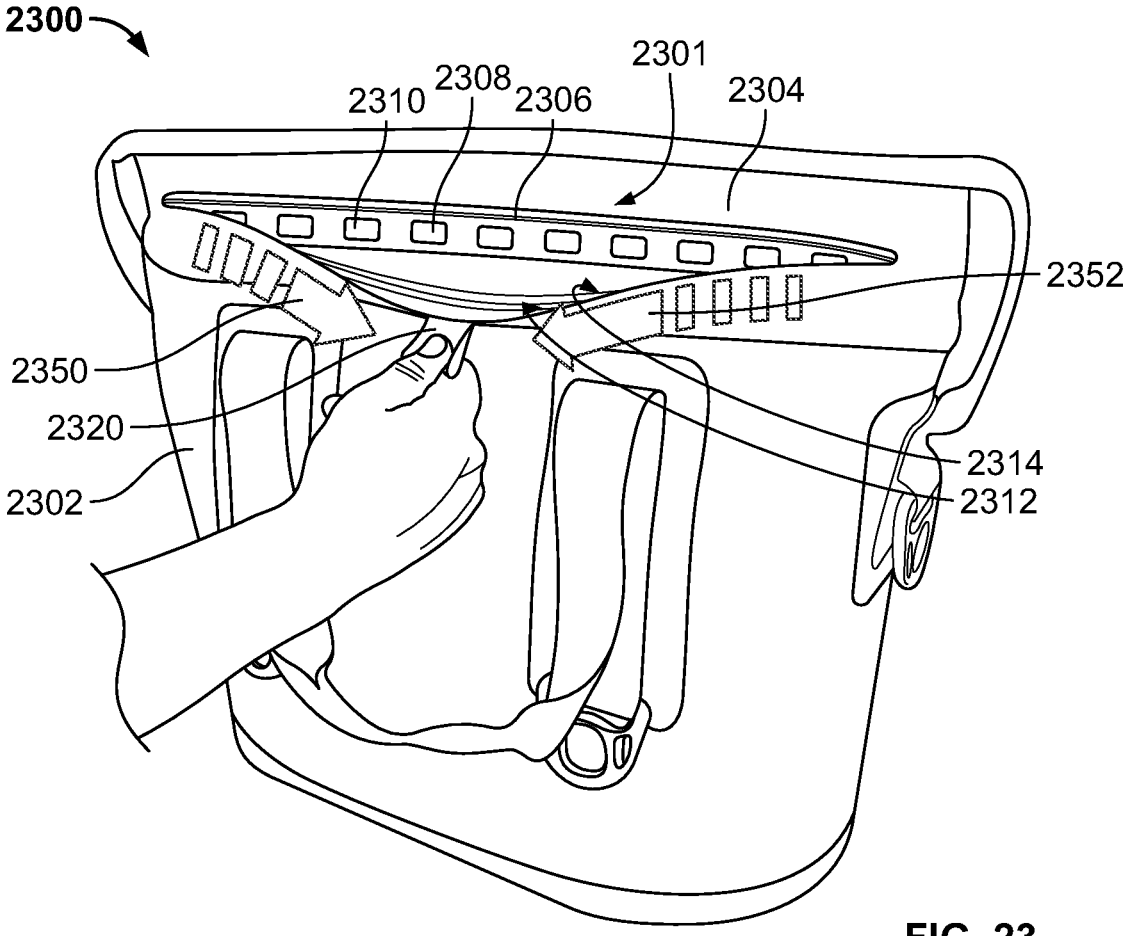
FIG. 23 depicts a container that has a magnetic closure, according to one or more aspects described herein.

The magnetic closure mechanism 2202 may include a first magnetic strip 2220 that is coupled to a first side of the opening 2216. The first magnetic strip 2220 may include a linear series of magnetic elements 2222. In another implementation, the magnetic strip 2202 may include a single continuous magnetic element, or a two-dimensional array of magnetic elements, without departing from the scope of these disclosures. A second magnetic strip 2224 may be coupled to a second side of the opening 2216. The first magnetic strip 2220 may be magnetically attracted to the second magnetic strip 2224 to resealably seal the opening 2216 using a magnetic force attraction between strips 2220 and 2224. As such, the second magnetic strip 2224 may include one or more magnetic elements, similar to the first magnetic strip 2220. In one example, the first magnetic strip 2220 may be manually separated from the second magnetic strip 2224 in order to transition the opening 2216 from a sealed configuration to an open configuration, as depicted in FIG. 22. In one example, each of the first magnetic strip 2220 and the second magnetic strip 2224 can be injection molded with rare earth magnets. The container 2200 may include a tab 2226 to allow a user to manually separate the first magnetic strip 2220 from the second magnetic strip 2224. The of the first magnetic strip and the second magnetic strip can help to create a strong seal that will not break when the container 2200 is dropped from reasonable heights. Additionally, the geometry of this sealing method creates insulated space to improve thermal performance and eliminate the 'thermal-bridge' effect FIG. 23 depicts a container 2300 that has a magnetic closure mechanism 2301, according to one or more aspects described herein. In one example, the container 2300 may be similar to any of the containers described throughout this disclosure, such as container 2200 from FIG. 22. The container 2300 may include an outer shell 2302. The outer shell 2302 may have an opening 2304 that extends into a storage compartment. A magnetic closure mechanism 2301 may be configured to resealably seal the opening 2304. The magnetic closure mechanism 2301 may include a first magnetic strip 2306 that extends along a longitudinal axis that is coupled to a first side of the opening 2304. In one example, the first magnetic strip 2306 includes a linear series of discrete magnet elements, of which magnets 2308 and 2310 or two examples spaced along the longitudinal axis of the first magnetic strip 2306. A rail 2312 may extend along a longitudinal axis and may be coupled to a second side of the opening 2304. A second magnetic strip 2314 may extend along a longitudinal axis and may be slidably coupled to the rail 2312. The second magnetic strip 2314 may have a series of magnets similar to the first magnetic strip 2306.

In one example, the second magnetic strip 2314 is slidably coupled to the rail 2312 such that the second magnetic strip 2314 is slidable relative to the rail 2312 with the longitudinal axis of the second magnetic strip 2314 parallel to the longitudinal axis of the rail 2312. In one example, the series of magnets on the first magnetic strip 2306 may have outer surfaces facing the second magnetic strip 2314, and with alternating magnetic polarities. Similarly, the series of magnets of the second magnetic strip 2314 may have outer surfaces facing the first magnetic strip 2306, and with alternating magnetic polarities. In a first configuration, the magnets of the first magnetic strip 2306 may be aligned with magnets of the second magnetic strip 2314 that have opposite magnetic polarities, and the first magnetic strip 2306 may be magnetically attracted to the second magnetic strip 2314. In a second configuration, the magnets of the first magnetic strip 2306 may be aligned with magnets of the second magnetic strip 2314 that have the same magnetic polarities, and the first magnetic strip 2306 may be magnetically repelled from the second magnetic strip 2314. The second magnetic strip 2314 may be transitioned from the first configuration to the second configuration by sliding the second magnetic strip 2314 relative to the rail 2312. Accordingly, when in the first configuration, the magnetic closure 2301 is in a closed configuration, and the opening 2304 is sealed. When in the second configuration, the magnetic closure 2301 is in an open configuration, and the opening 2304 is unsealed. As such, the slidable motion of the second magnetic strip 2314 relative to the rail 2312 may allow a user to manually disengage magnets from one another using a reduced manual force than may otherwise be needed to pull the first magnetic strip 2306 away from the second magnetic strip 2314. In one example, arrow 2350 schematically depicts a direction of motion to slide the second magnetic strip 2314 into a closed configuration, and arrow 2352 schematically depicts a direction of motion to slide the second magnetic strip 2314 into an open configuration.

The magnetic closure mechanism 2306 may additionally include a tab element 2320 that may be used to manually slide or twist the second magnetic strip 2314 relative to the first magnetic strip 2306 along the rail 2312. This tab element 2320 may include a fabric loop or a polymeric grip element. However, additional or alternative implementations may be used, without departing from the scope of these disclosures.

Figure 24A:
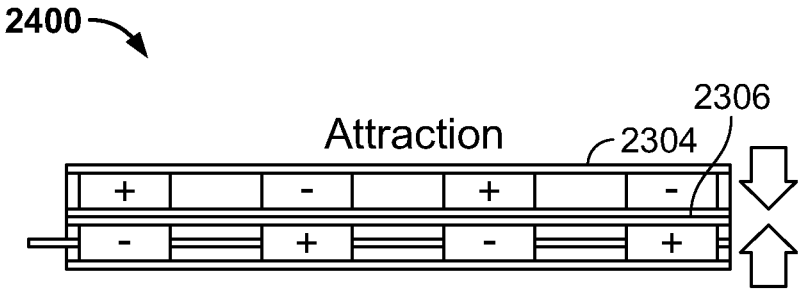
FIGS. 24A and 24B schematically depict a magnetic closure mechanism similar to that described in relation to FIG. 23, according to one or more aspects described herein.
Figure 24B:
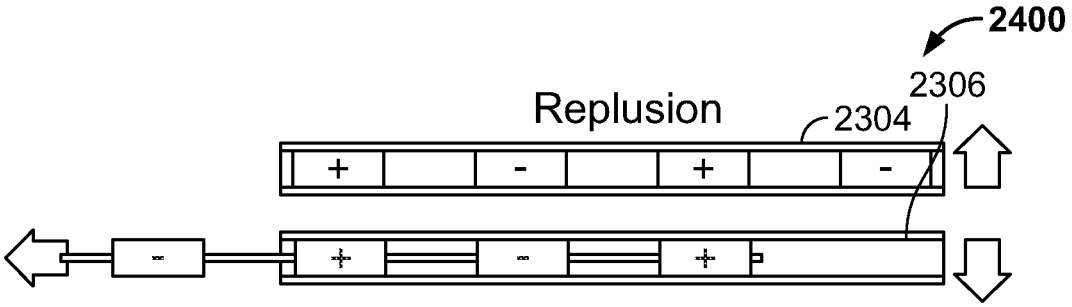

FIGS. 24A and 24B schematically depict a magnetic closure mechanism similar to that described in relation to FIG. 23, according to one or more aspects described herein. In particular, FIG. 24A schematically depicts a magnetic closure mechanism 2400 that has a first magnetic strip 2304 and a second magnetic strip 2306. The second magnetic strip 2306 is configured to be slidable relative to the first magnetic strip 2304. Further, each of the first magnetic strip 2304 and the second magnetic strip 2306 includes a series of magnets with outer surfaces having alternating magnetic polarity. When in the first configuration of FIG. 24A, the first magnetic strip 2304 is aligned with the second magnetic strip 2306 such that the outer surfaces of the magnets face the outer surfaces of magnets of opposite magnetic polarity. This first configuration results is a magnetic attractive force between the first magnetic strip 2304 and the second magnetic strip 2306.

FIG. 24B schematically depicts the first magnetic strip 2304 and the second magnetic strip 2306 in a second configuration. As depicted in FIG. 24B, the second magnetic strip 2306 has been moved relative to the first magnetic strip 2304 such that the outer surfaces of the magnets of the first and second magnetic strips facing one another have the same magnetic polarities. This second configuration results in the first magnetic strip 2304 being magnetically repelled from the second magnetic strip 2306. Accordingly, the second configuration depicted in FIG. 24B depicts the magnetic closure mechanism 2400 in an open configuration. When the first magnetic strip 2304 is repelled from the second magnetic strip 2306, the container may be maintained in the open position. This may allow the user to be able see the contents inside the container and easily access the contents inside the container.

Figure 25:
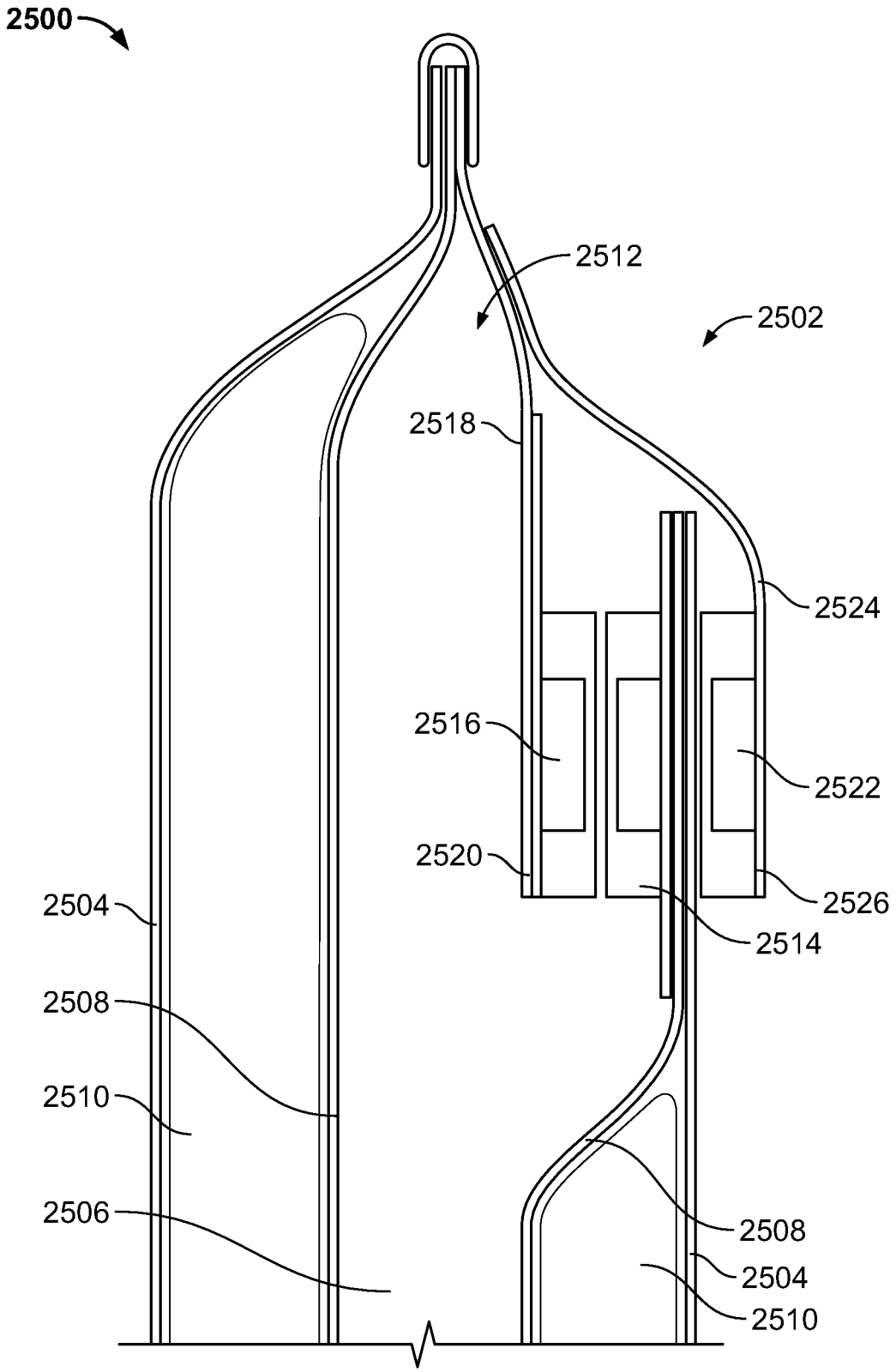
FIG. 25 schematically depicts another implementation of a container that has a magnetic closure mechanism, according to one or more aspects described herein.

FIG. 25 schematically depicts another implementation of a container 2500 that has a magnetic closure mechanism 2502, according to one or more aspects described herein. The container 2500 may be similar to the containers described throughout these disclosures. In one example, the container 2500 is an insulating container. Additionally or alternatively, the container 2500 may have a substantially water-resistant or water-proof outer shell 2504. While not depicted in FIG. 25, the outer shell 2504 may include any of the geometries and/or features of the containers described throughout these disclosures, and include a front portion, back portion, side portions, and a base portion, among others. In one implementation, FIG. 25 schematically depicts a cross-sectional view of a top portion of a container 2500 that has an internal storage compartment 2506. The storage compartment 2506 may be formed by an inner liner 2508. Additionally, the container 2500 may include one or more layers of insulation 2510 positioned between the outer shell 2504 and the inner liner 2508.

The container may include an opening 2512 extending into the storage compartment 2506. As depicted in FIG. 25, the opening 2512 is resealably sealed by the magnetic closure mechanism 2502. Accordingly, the magnetic closure mechanism 2502 may include a first magnetic strip 2514 that is coupled to an internal surface of the container 2500 on a first side of the opening 2512. In one example, the first magnetic strip 2514 is substantially rigidly coupled to the internal surface of the container 2500. Additionally, the magnetic closure mechanism 2502 includes a second magnetic strip 2516 that has a magnetic strip top side 2518, and a magnetic strip bottom side 2520. The second magnetic strip top side 2518 may be coupled to a second side of the opening 2512, and the second magnetic strip bottom side 2520 may be unattached to the container 2500 such that the second magnetic strip 2516 can flex and pivot relative to the first magnetic strip 2514. Accordingly, the second magnetic strip top side 2518 may be coupled to the container 2500 by a flexure element, which may include a fabric element, or a flexible polymeric element, among others.

The magnetic closure mechanism 2502 may additionally include a third magnetic strip 2522. The third magnetic strip 2522 may include a third magnetic strip top side 2524 and a third magnetic strip bottom side 2526. The third magnetic strip top side 2524 may be coupled to the second side of the opening 2512, and the third magnetic strip bottom side 2526 may be unattached to the container 2500 such that the third magnetic strip 2522 can flex and pivot relative to the first magnetic strip 2514. Accordingly, the third magnetic strip top side 2524 may be coupled to the container 2500 by a flexure element, which may include a fabric element, or a flexible polymeric element, among others.

In the closed configuration depicted in FIG. 25, the second magnetic strip 2516 may be configured to be magnetically coupled to the first magnetic strip 2514 inside the storage compartment 2506. Additionally, when in the closed configuration depicted in FIG. 25, the third magnetic strip 2522 may be configured to be magnetically coupled to the first magnetic strip 2514 on an external surface on the outer shell 2504 of the container 2500.

Figure 26:
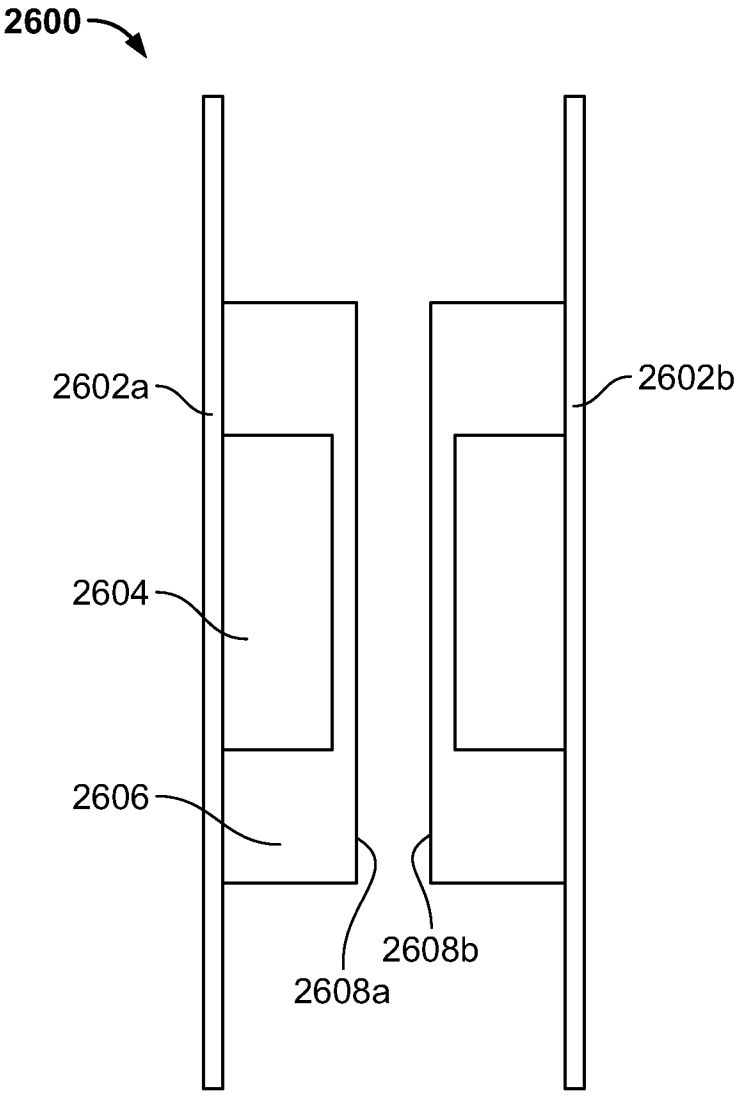
FIG. 26 schematically depicts a cross-sectional view of one implementation of a magnetic closure, according to one or more aspects described herein.

FIG. 26 schematically depicts a cross-sectional view of one implementation of a magnetic closure 2600, according to one or more aspects described herein. It is contemplated that the magnetic closure 2600 may be used with any of the closures and/or containers described throughout this disclosure. The magnetic closure 2600 may include two magnetic strips 2602*a* and 2602*b*, which may be configured to be magnetically coupled to one another to seal an opening of a container. Each of the magnetic strips 2602*a* and 2602*b* may include a single continuous magnetic element, a series of discrete magnetic elements, or an array of magnetic elements. Further, a magnetic element may include a permanent magnet, or a metallic material that is magnetically attracted to a magnet.

Each of the magnetic strips 2602*a* and 2602*b* may include one or more magnetic elements 2604 encapsulated with a shell material 2606. The shell material 2606 may include one or more polymers, alloys, ceramics, or fiber reinforced materials, among others. Additionally, the magnetic coupling surfaces 2608*a* and 2608*b* of the respective magnetic strips 2602*a* and 2602*b* may have planar geometries. In another implementation, the magnetic strips 2602*a* and 2602*b* may each be formed from a contiguous magnetic material such that the planar surfaces 2608*a* and 2608*b* are themselves magnetic.

Figure 27:
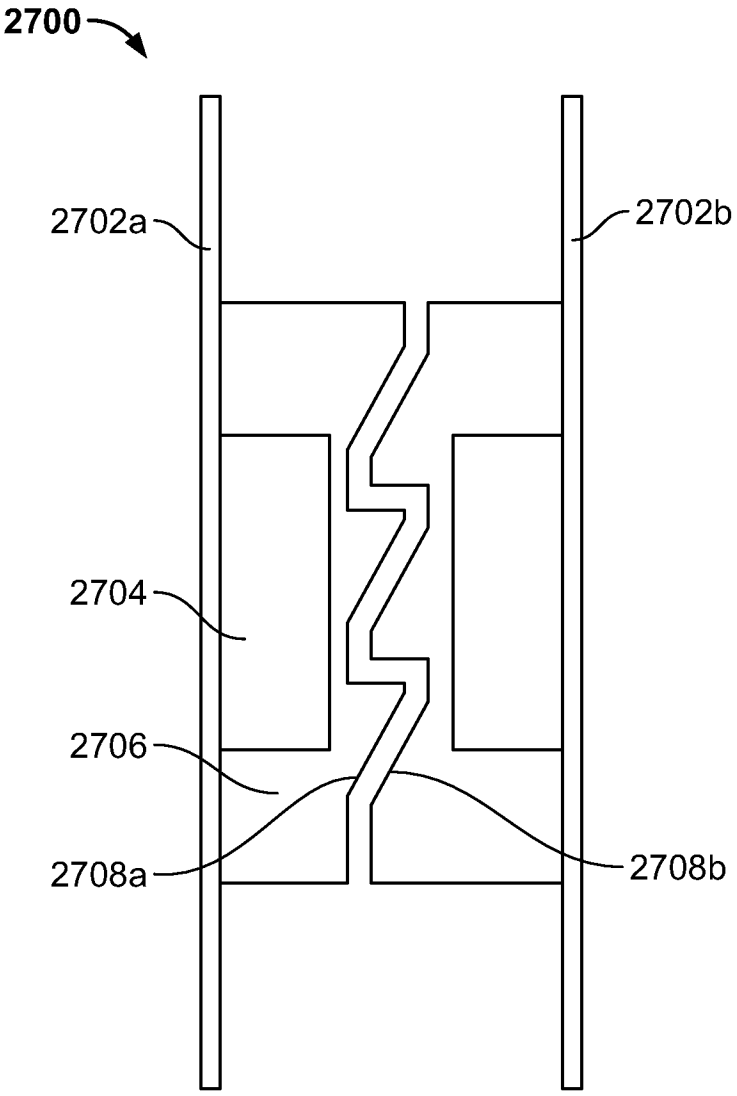
FIG. 27 schematically depicts a cross-sectional view of another implementation of a magnetic closure, according to one or more aspects described herein.

FIG. 27 schematically depicts a cross-sectional view of another implementation of a magnetic closure 2700, according to one or more aspects described herein. It is contemplated that the magnetic closure 2700 may be used with any of the closures and/or containers described throughout this disclosure. The magnetic closure 2700 may include two magnetic strips 2702*a* and 2702*b*, which may be configured to be magnetically coupled to one another to seal an opening of a container. Each of the magnetic strips 2702*a* and 2702*b* may include a single continuous magnetic element, a series of discrete magnetic elements, or an array of magnetic elements.

Each of the magnetic strips 2702*a* and 2702*b* may include one or more magnetic elements 2704 encapsulated by a shell material 2706. The shell material 2706 may include one or more polymers, alloys, ceramics, or fiber reinforced materials, among others. Additionally, the magnetic coupling surfaces 2708*a* and 2708*b* of the respective magnetic strips 2702*a* and 2702*b* may have non-planar geometries. In certain examples, the magnetic coupling surfaces 2708*a* and 2708*b* may have interlocking or complementary geometries. Further, the magnetic coupling surfaces 2708*a* and 2708*b* may have undulating, rippled, saw tooth, wavy, or zig-zag surface geometries. Additionally, the surface geometries of the magnetic coupling surfaces 2708*a* and 2708*b* may be irregular, or regular surface features (such as undulations, ripples, saw teeth, waves, or zig-zags etc. Advantageously, the non-planar surface geometry of magnetic coupling surfaces 2708*a* and 2708*b* may reduce or prevent sliding of the magnetic strips 2702*a* and 2702*b* relative to one another. This may, in turn, increase the strength and/or efficacy of a magnetic seal formed by the magnetic attraction between magnetic strips 2702*a* and 2702*b*. In another implementation, the magnetic strips 2702*a* and 2702*b* may each be formed from a contiguous magnetic material such that the non-planar surfaces 2708*a* and 2708*b* are themselves magnetic. In one example, the magnetic strips 2702*a* and 2702*b* can be formed by injection or extrusion molding. The interlocking geometry of the magnetic strips 2702*a* and 2702*b* can be constructed in a way to prevent seal failure.

Figure 28:
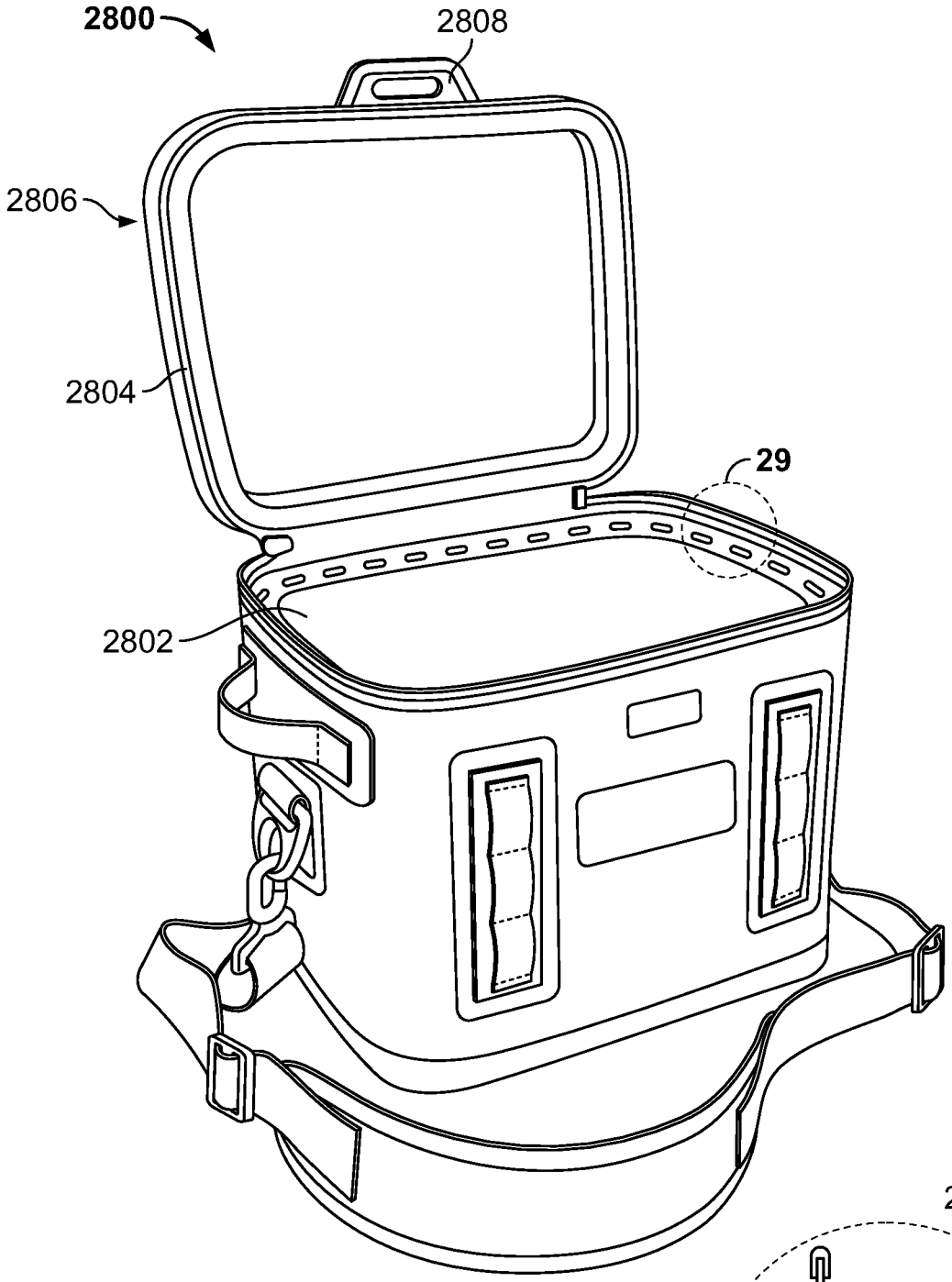
FIG. 28 depicts another example container that includes a magnetic closure mechanism, according to one or more aspects described herein.

FIG. 28 depicts another example container that includes a magnetic closure mechanism, according to one or more aspects described herein. Container 2800 may be implemented as an insulating container that has a storage compartment 2802 that is resealably sealed by a hinged lid 2806. The container 2800 may be similar to one or more of the containers described in U.S. application Ser. No. 15/261,407, filed 9 Sep. 2016, titled "Insulating Device and Method for Forming Insulating Device," the entire contents of which are incorporated herein by reference for any and all non-limiting purposes. The lid closure 2804 may resealably seal the storage compartment 2802 using a combination of an inner magnetic closure mechanism and an outer zipper mechanism. In one example, this combined closure may be similar to the closure of FIG. 6, which includes external zipper assembly 614 in combination with internal magnetic strips 606 and 608. The magnetic strips 606 and 608, in one example, can be injection molded TPU with embedded rare earth magnets. The magnets help provide the alignment and sealing force for the closure. The geometry of the magnetic strips 606 and 608 can creates a strong seal that remains intact when dropped from reasonable heights. And, the geometry of this seal creates insulated space to improve thermal performance and eliminate the 'thermal-bridge' effect. An additional pull-tab on the front allows an opening point for the lid 2806. In addition, the pull-tab 2808 and the container 2800 can be provided with one or more mating features to prevent the lid from inadvertently opening.

Figure 29:
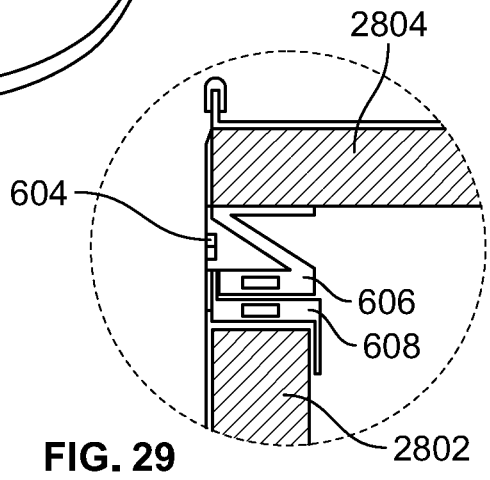
FIG. 29 schematically depicts a cross-sectional view of a portion of the closure mechanism of the container of FIG. 28, according to one or more aspects described herein.

FIG. 29 schematically depicts a cross-sectional view of a portion of the closure mechanism of the container 2800, according to one or more aspects described herein. In one example, the closure mechanism includes a zipper assembly 604 and internal magnetic strips 606 and 608. The magnetic strips 606 and 608 may be magnetically coupled to one another with or without the zipper assembly 604 being in a closed configuration. As such, the magnetic strips 606 and 608 may be used to resealably seal the lid 2804 to the storage compartment 2802, with this seal being further reinforced by the zipper assembly 604 when positioned in a closed configuration.

Figure 30:
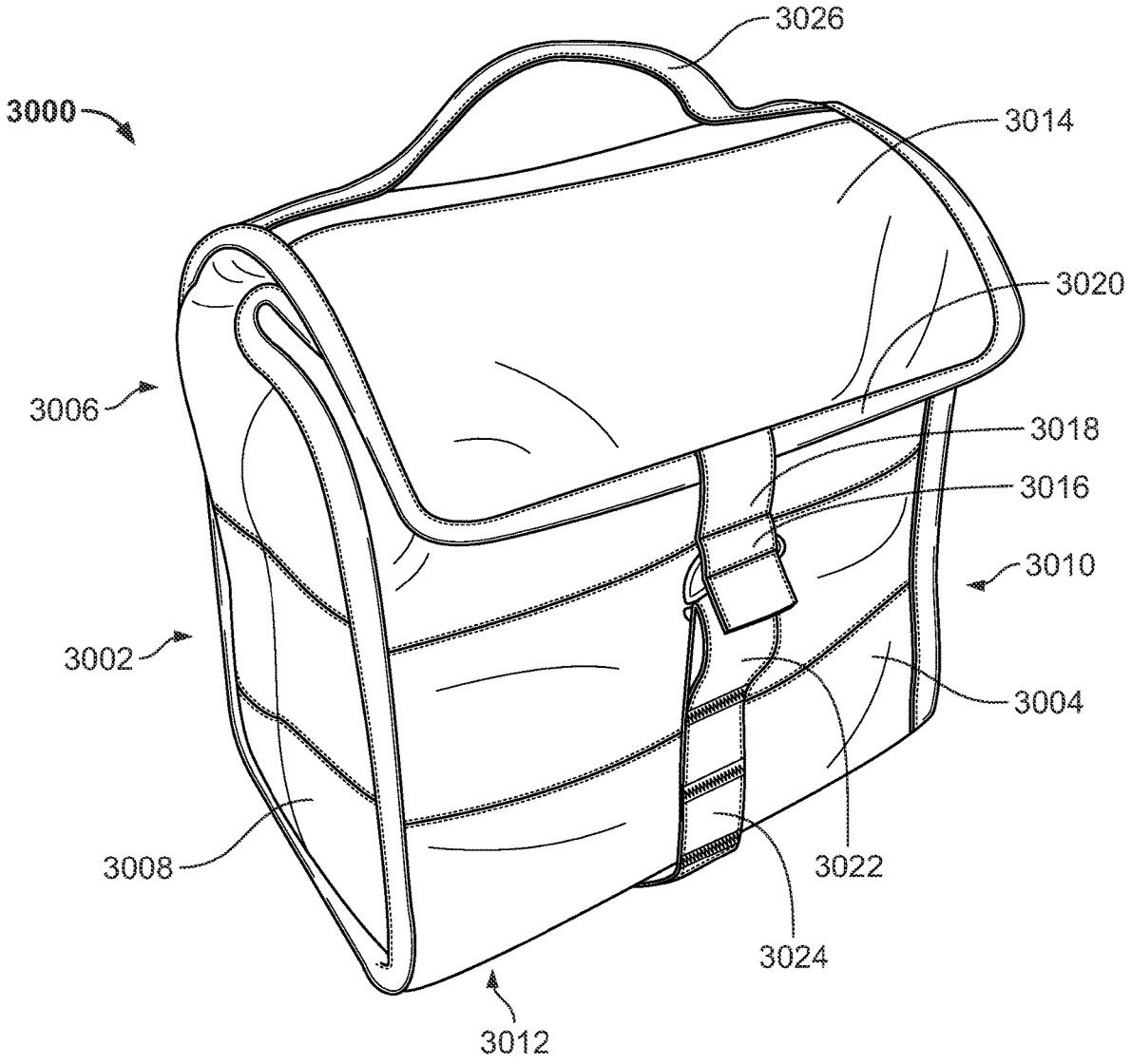
FIG. 30 depicts another implementation of a container, according to one or more aspects described herein.

FIG. 30 depicts another implementation of a container 3000, according to one or more aspects described herein. In particular, FIG. 30 depicts the container 3000 in a closed configuration, whereas FIG. 31 depicts the same container 3000 in an open configuration (partially open configuration). In the depicted example, the container 3000 includes an outer shell 3002. This outer shell 3002 may be partially or fully watertight, airtight, and/or sealed to substantially or fully prevent dust or other materials from entering into and/or escaping from the container 3000. For example, the outer shell 3002 may be constructed from one or more layers of material to result in a partially or fully water resistant barrier. In this regard, the outer shell 3002 may be formed of any materials or construction methodologies described throughout this disclosure, and/or constructed using any materials or techniques described in U.S. application Ser. No. 15/261,704, filed Sep. 9, 2016, the entire contents of which are incorporated herein by reference for any and all non-limiting purposes. Further, the outer shell 3002 may be implemented as a substantially deformable structure that is constructed from flexible materials.

The outer shell 3002 may be implemented with a substantially cuboidal lower geometry, and include a front portion 3004, a back portion 3006, a first side portion 3008, and a second side portion 3010. The outer shell 3002 may additionally include a base portion 3012. This base portion 3012 may be formed of a same material or materials as the portions 3004, 3006, 3008, and/or 3010, or may include additional or alternative materials to provide added durability and/or abrasion resistance to the base portion of the container 3000. Additionally, the outer shell 3002 includes a flap 3014 that extends from the back portion 3006. As depicted in FIG. 30, the flap 3014 is configured to be fastened to the front portion 3004 by a fastener 3016. This fastener 3016 may be implemented as a hook that is rotatably coupled to a strap 3018 that extends from a lower edge 3020 of the flap 3014. Additionally or alternatively, the fastener 3016 may include one or more of a magnetic cleat, a side release buckle, one or more snap closures, hook and loop fasteners, or one or more magnetic fasteners, among others. Furthermore, it is contemplated that the fastener 3016 may be rotatably coupled to the webbing loop 3022 or another area of the front portion 3004 of the outer shell 3002, and configured to be removably coupled to the strap 3018. The fastener 3016 may also be configured to be removably coupled to a hole that provides an anchoring point and extends through a portion of the outer shell 3002. This hole may have any geometry, and may be formed by any manufacturing process, such as laser cutting, punching, stamping, or formed by one or more material portions that are coupled to one another to form the hole. Additionally, outer shell 3002 may use more than one hole or channel as part of a closure mechanism for removably coupling the flap 3014 to the front portion 3004. Furthermore, these one or more holes or channels may be reinforced with rigid reinforcing elements (grommets, plugs, tubes, among others). The fastener 3060 may be configured to be removably fastened to a webbing loop 3022. Further, the webbing loop 3022 may form one of a series of webbing loops 3024 that is coupled to the front portion 3004 of the outer shell 3002. In one example, the series of webbing loops 3024 may be coupled to at least a portion of the front portion 3004, the base portion 3012, and/or the back portion 3006 of the outer shell 3002.

The container 3000 additionally includes a carry handle 3026 that is coupled to the back portion 3006 of the outer shell 3002. Alternatively, the carry handle 3026 may be coupled to the flap 3014. This carry handle 3026 may be formed from a flexible webbing material and may include internal padding encapsulated between two or more layers of an outer webbing material. However, additional or alternative handle implementations may be utilized with the container 3000, without departing from the scope of these disclosures.

It is contemplated that the container 3000 may include one or more additional or alternative handles, rings, and webbing loops for attaching various items, e.g. straps (shoulder), carabineers, dry bags, keys, storage cases, etc. The rings may be D-rings, and a shoulder strap (not shown) may be connected to the D-rings for easy carrying of the container 3000. The insulating device may also include side, front and/or rear carry handles, pockets, tie downs, and D-rings anywhere on the external surface of the outer shell 3002. The pockets can be sized for receiving keys, phones, wallets, etc. and may be waterproof. The pockets may also include a waterproof zipper to prevent the contents therein from getting wet.

Further, the outer shell 3002 can also include multiple reinforcement areas and/or patches that are configured to assist in structurally supporting handles (e.g., handle 3026), straps, and webbing loops (e.g., webbing 3022). It is contemplated that the various elements of the containers described throughout this disclosure, including container 3000, may be joined together using one or more joining techniques that includes stitching, gluing, riveting, or welding (e.g., RF fabric welding), among others.

Figure 31A:
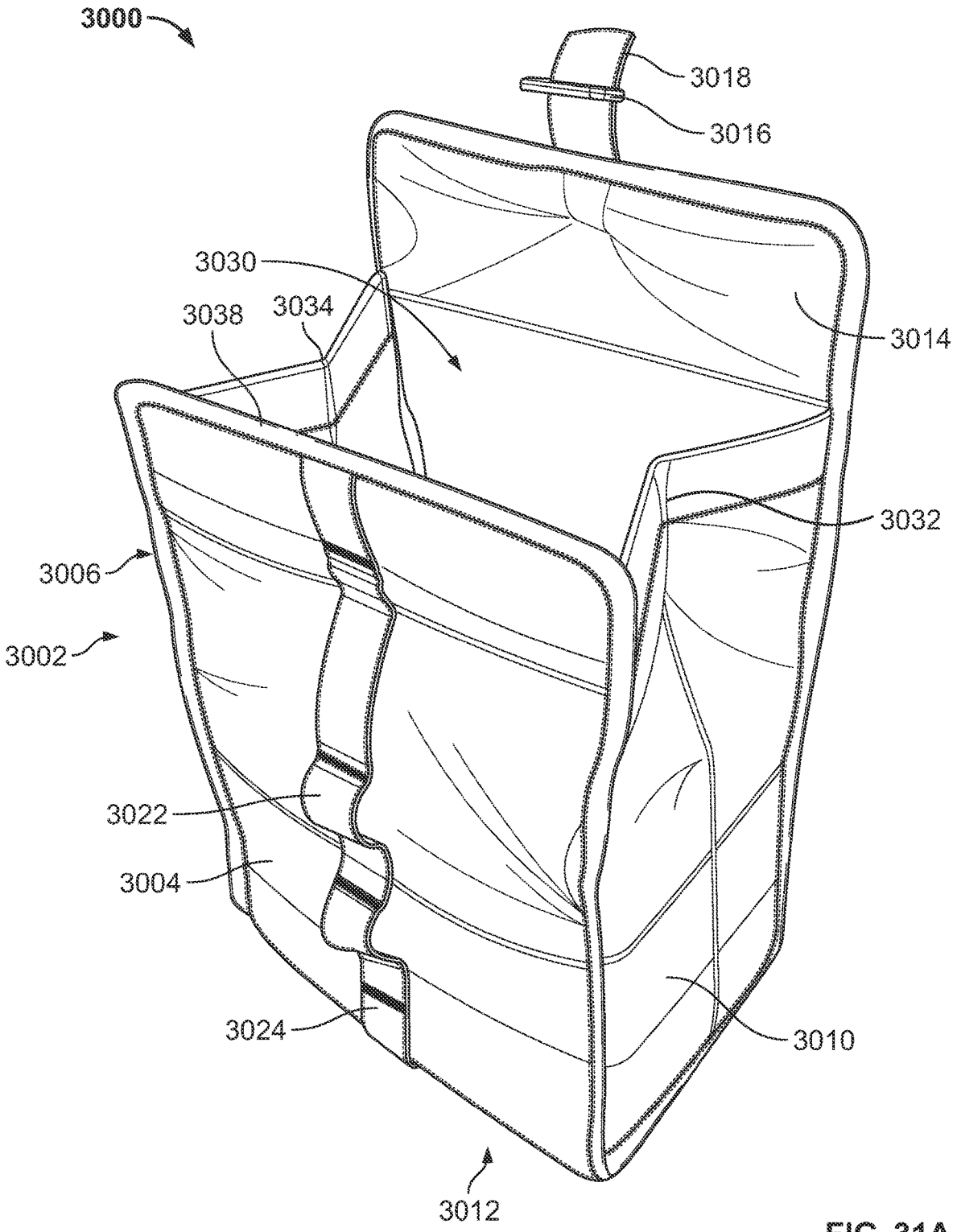
FIG. 31A depicts the container of FIG. 30 in a partially open configuration, according to one or more aspects described herein.

FIG. 31A depicts another view of the container 3000 of FIG. 30. In particular, FIG. 31A depicts the container 3000 in a partially opened configuration such that the fastener 3016 has been uncoupled from the webbing 3024, to reveal an opening 3030 into an internal storage compartment within the container 3000. The container 3000 includes a closure mechanism similar to the closure mechanism 2100. As depicted, the closure mechanism integrated into the container 3000 is in a partially open configuration such that the hinges 3032 and 3034 are partially extended. When the fully extended, the perimeter of opening 3030 may be substantially rectilinear in geometry. In alternative implementations, the container 3000 and opening 3030 may have other geometries. For example, the opening 3030 may be implemented with a circular, elliptical, oval, triangular, pentagonal, hexagonal, heptagonal, and/or octagonal opening geometry. It is further contemplated that the opening 3030 may be implemented with any polygonal geometry. The opening 3030 may additionally or alternatively be described as having a curvilinear geometry, and the geometry of opening 3030 (or geometries of other elements of the container 3000) may be deformable from one shape into one or more different shapes. Accordingly, the container 3000 includes both the fastener 3016 and a folding magnetic closure mechanism similar to that closure mechanism 2100. The folding magnetic closure mechanism is integrated into the perimeter 3038 of the opening 3030, and as described in further detail in relation to FIG. 32.

Figure 31B:
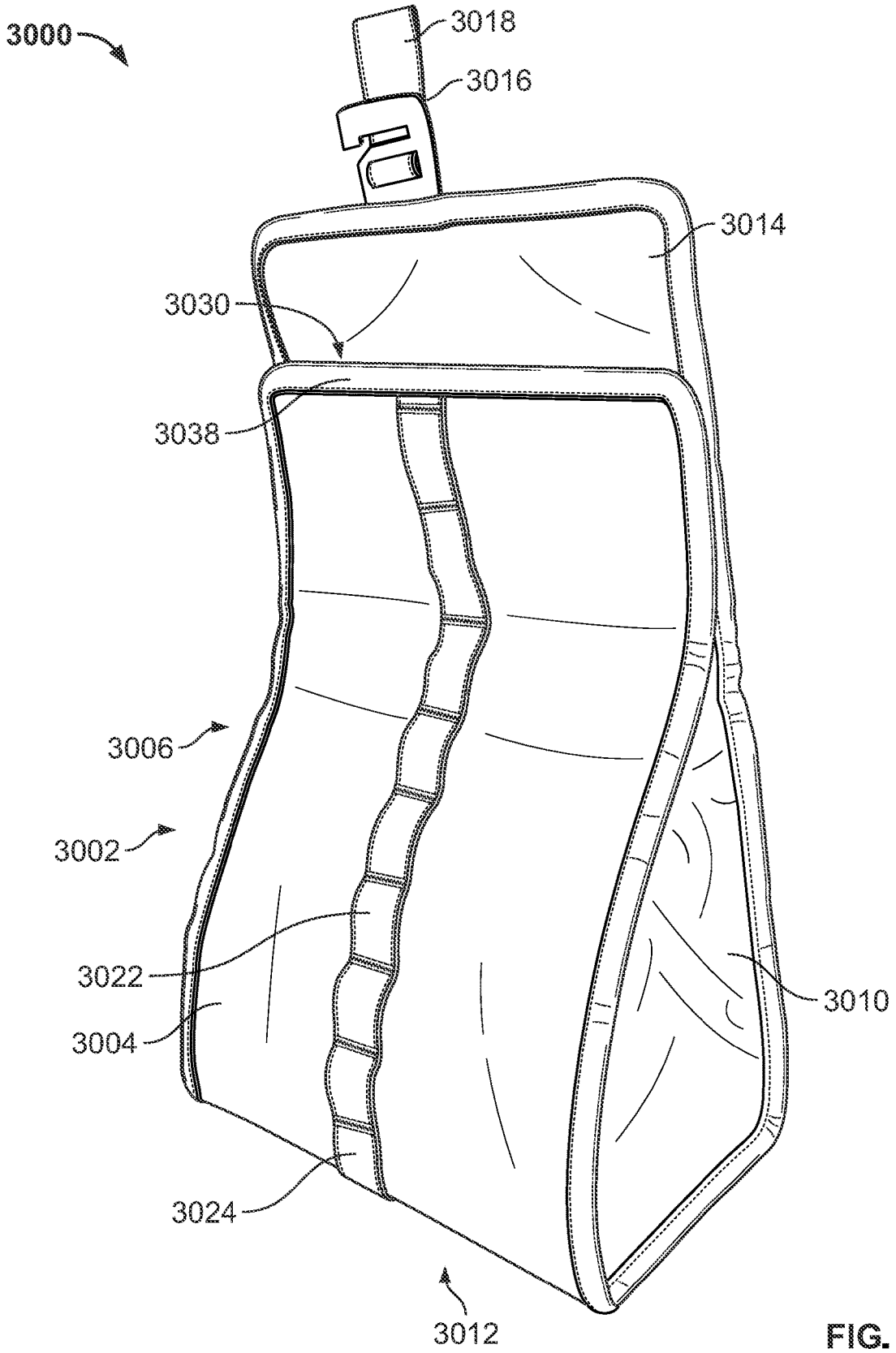
FIG. 31B depicts the container of FIG. 30 in a partially closed configuration, according to one or more aspects described herein.

FIG. 31B depicts the container 3000 in another configuration such that the magnetic closure mechanism formed around the opening 3030 is in a closed configuration, and the flap 3014 remains in open configuration with the fastener 3016 uncoupled from the front portion 3004 of the outer shell 3002.

Figure 32:
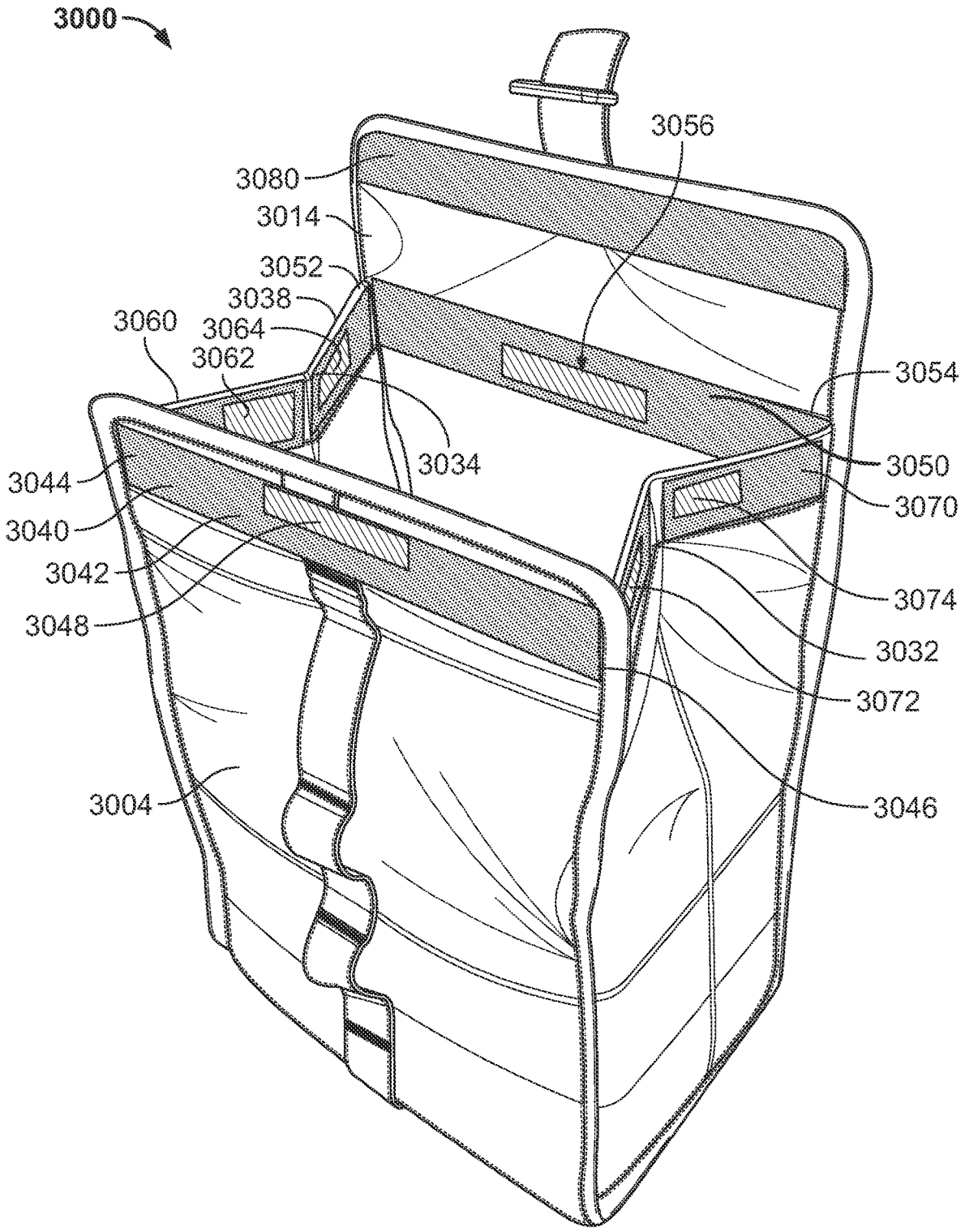
FIG. 32 schematically depicts the container of FIG. 30 with a folding magnetic closure mechanism integrated into the perimeter of an opening, according to one or more aspects described herein.

FIG. 32 schematically depicts the container 3000 with a folding magnetic closure mechanism integrated into the perimeter 3038 of the opening 3030. Accordingly, FIG. 32 schematically depicts internal elements that are not visible on the external surfaces or internal surfaces of the container 3000.

The folding magnetic closure mechanism within container 3000 may be referred to as a folding magnetic collar 3040, and may be substantially similar to the folding magnetic collar 2100. The folding magnetic collar 3040 may include a front collar member 3042 that extends, linearly, curvilinearly, or otherwise, along a top edge of the front portion 3004 of the outer shell 3002. The front collar member 3042 may extend between a first end 3044 and a second end 3046. The front collar member 3042 may be formed from a flexible polymeric material into which a magnetic element 3048 is embedded. This magnetic element 3048 may include a single magnet, or a series of separate magnet elements. Magnetic element 3048 may be magnetized as a permanent magnet, or may be magnetically attracted to a separate magnet. The magnetic element 3048 may face the back of the opening 3030.

The back collar member 3050 of the folding magnetic collar 3040 may extend between a first end 3052 and a second end 3054. Similar to the front collar member 3042, the back collar member 3050 may be formed from a flexible polymeric material into which a magnetic element 3056 is embedded. This magnetic element 3056 may be similar to the magnetic element 3048. The magnetic element 3056 may face the front of the opening 3030.

The folding magnetic collar 3040 may include a first side collar member 3060 that extends along a first side of the opening 3030. The first side collar member 3060 may be hingedly coupled to the first end 3044 of the front collar member 3040 and hingedly coupled to the first end 3052 of the back collar member 3050. The first side collar member 3060 additionally includes a center hinge 3034 that separates a first magnetic element 3062 from a second magnetic element 3064. Similarly, the magnetic elements 3062 and 3064 may be similar to the magnetic elements 3048 and 3056.

The folding magnetic collar 3040 also includes a second side collar member 3070 that extends along a second side of the opening 3030. The second side collar member 3070 may be hingedly coupled to the second end 3046 of the front collar member 3042 and hingedly coupled to the second end 3054 of the back collar member 3050. The second side collar member 3070 additionally includes a center hinge 3032 that separates a first magnetic element 3072 from a second magnetic element 3074. The magnetic elements 3072 and 3074 may be similar to the magnetic elements 3048, 3056, 3062, and 3064. Further, the magnetic elements 3048, 3056, 3062, 3064, 3072 and 3074 may be embedded in a flexible substrate. Further, the flexible substrate may form part of the collar members 3042, 3050, 3060, and 3070.

In one implementation, the hinges at ends 3044, 3046, 3052, and 3054, in addition to the hinges 3032 and 3034 may include a live hinge structure that includes a flexure constructed from one or more polymers, metals, or alloys. Additionally or alternatively, any of these hinge elements may include any mechanical hinge mechanism that includes separate hinge elements that are rotatatably coupled to one another.

The folding magnetic collar 3040, when in a fully open configuration, positions the front collar member 3042, the back collar member 3050, the first side collar member 3060, and the second side collar member 3070 in a substantially rectilinear or curvilinear configuration. When folded, the center hinge 3034 of the first side collar member 3060 hinges the first and second magnetic elements 3062 and 3064 of the first side collar member 3060 are brought into contact with one another.

When folded, the center hinge 3032 of the second side collar member 3070 hinges the first and second magnetic elements 3072 and 3074 of the second side collar member 3070 into contact with one another. Additionally, when the magnetic collar 3040 is folded, the magnetic element 3048 is brought into contact with, and magnetically coupled to, the magnetic element 3056.

In one implementation, when folded into a closed configuration, the magnetic collar 3040 may substantially seal the opening 3030 such that it is substantially water an airtight. In another implementation, the magnetic collar 3040 may be configured to close the opening 3030 but not form a watertight or airtight seal.

In one example, the flap 3014 may include a reinforcing polymeric plate 3080. In one implementation, this polymeric plate 3080 may include one or more magnetic elements, such that when the flap 3014 is folded over the opening 3030 and the fastener 3016 is removably coupled to the webbing 3024, the reinforcing plate 3080 as also magnetically coupled to the magnetic collar 3040 (e.g., to the magnetic element 3048).

Figure 33:
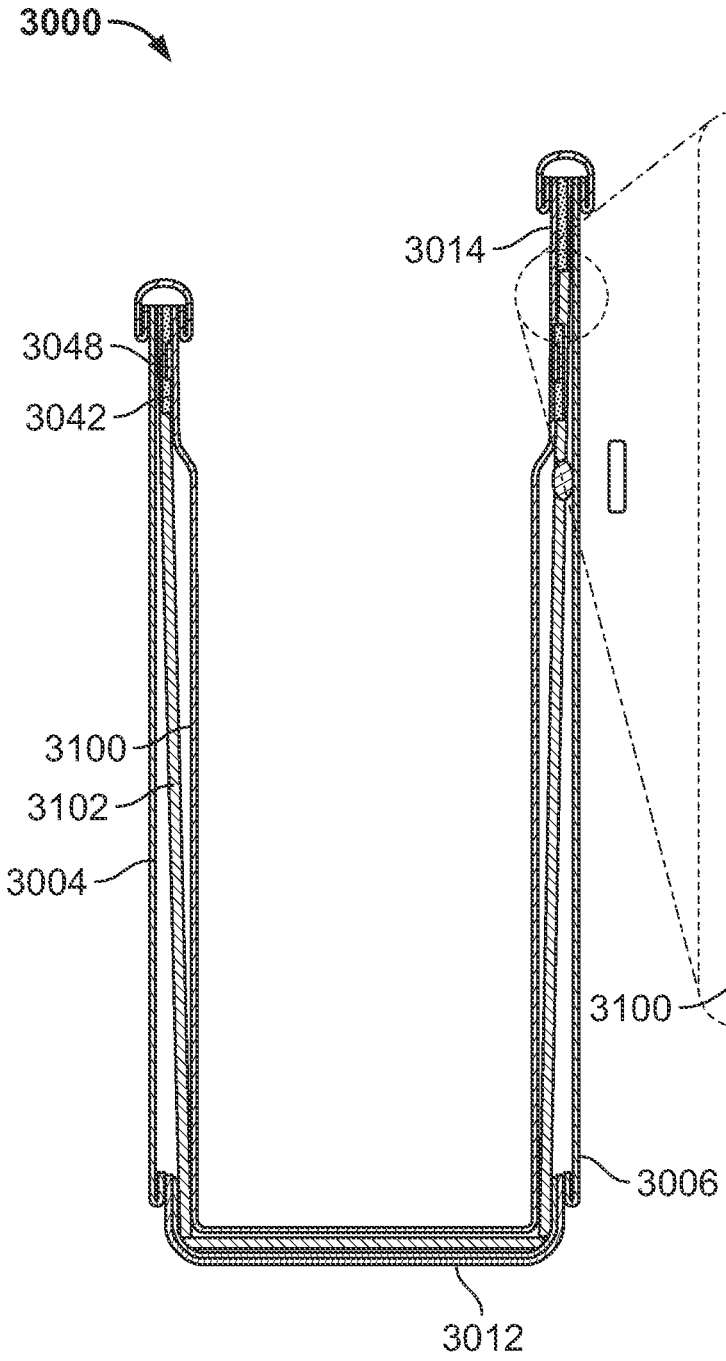
FIG. 33 schematically depicts a cross-sectional view through the container of FIG. 30, according to one or more aspects described herein.

FIG. 33 schematically depicts a cross-sectional view through the container 3000, according to one or more aspects described herein. As depicted, the container 3000 is in an open configuration. As depicted, the container 3000 includes an inner liner 3100. This inner liner 3100 may be formed from one or more layers of a flexible synthetic or natural material or combinations thereof, and may or may not be water resistant. A foam layer 3102 may be encapsulated between the outer shell 3004 and the inner liner 3100. This foam layer may extend around all sidewalls of the container 3000, or portion thereof. Further, the foam layer 3102 may have any foam layer thickness, and may use any foam material type, or combinations thereof. In one implementation, the foam layer 3102 may serve to provide protection to the one or more contents stored within the container 3000. Additionally or alternatively, the foam layer 3102 may include an insulating material configured to provide thermal insulation to reduce heat transfer between an internal storage compartment of the container 3000 and the external environment.

Figure 34:
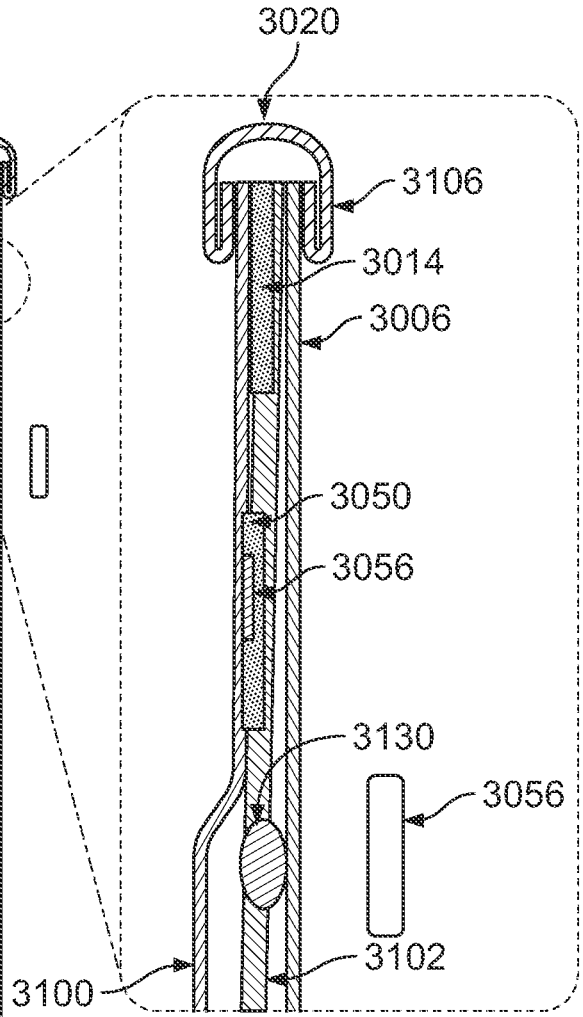
FIG. 34 schematically depicts a close-up view of a portion of the cross-sectional view of FIG. 33, according to one or more aspects described herein.

FIG. 34 schematically depicts a close-up view of a portion of the cross-sectional view of FIG. 33. In particular, FIG. 34 depicts one implementation of the construction used to form the container 3000. Specifically, a binding material 3106 may be used to couple the inner layer 3100, foam layer 3102, reinforcing plate 3080, and outer shell 3004 to one another and to the lower edge 3020 of the flap 3014. In one example, a handle stiffener 3130 may be used to provide structural support when the container 3000 is held by the handle 3056. Accordingly, the handle stiffener 3130 may be formed as a polymeric plate or structural member that is encapsulated between the outer shell 3002 and the inner liner 3100.

In one implementation, the foam layer 3102 is stitched to the outer shell 3002. However, additional or alternative construction methodologies may be utilized with the container 3000. For example, the foam layer 3102 may be stitched to the inner liner 3100, or may be free floating between the inner liner 3100 and the outer shell 3002.

Figure 35:
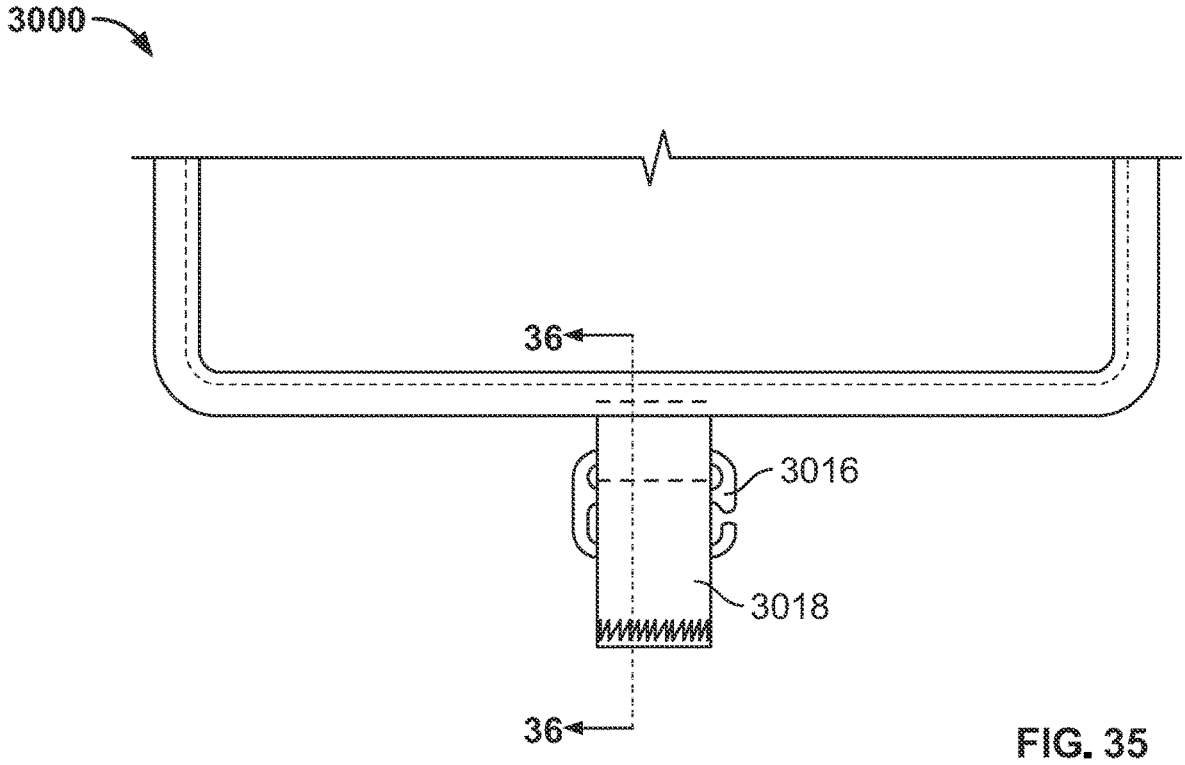
FIG. 35 schematically depicts a portion of the container of FIG. 30, according to one or more aspects described herein.
Figure 36:
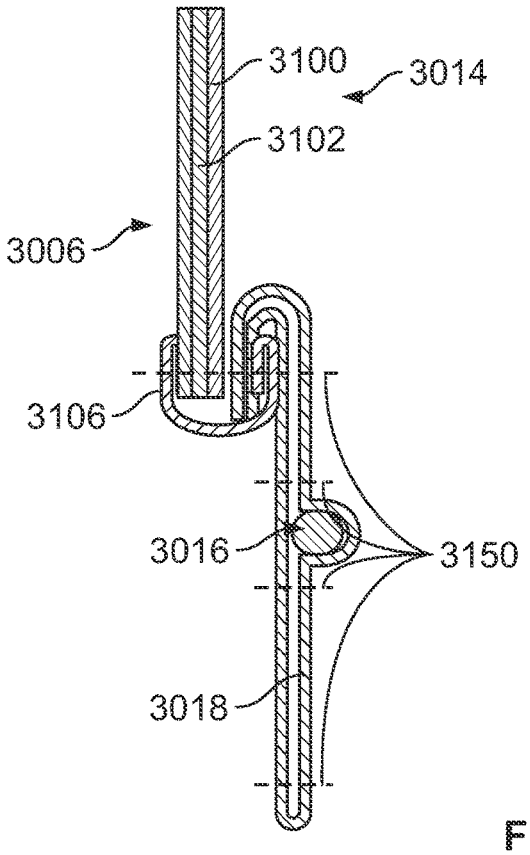
FIG. 36 schematically depicts a cross-sectional view through the container of FIG. 30 along the direction of arrows B-B depicted in FIG. 35.

FIG. 35 schematically depicts a portion of the container 3000. In particular, FIG. 35 depicts the strap 3018 and fastener 3016, which are further described in relation to the cross-sectional view of FIG. 36. Accordingly, FIG. 36 schematically depicts a cross-sectional view through the container 3000 along the direction of arrows B-B from FIG. 35. As depicted, the strap 3018 may be coupled to the flap 3014 by the binding material 3106. Further, the straps 3018 may be formed from a single length of material that is doubled back upon itself in stitched at the binding material 3106. Those elements 3150 schematically depict the positions of seams that stitched to form the strap 3018.

Figure 38:
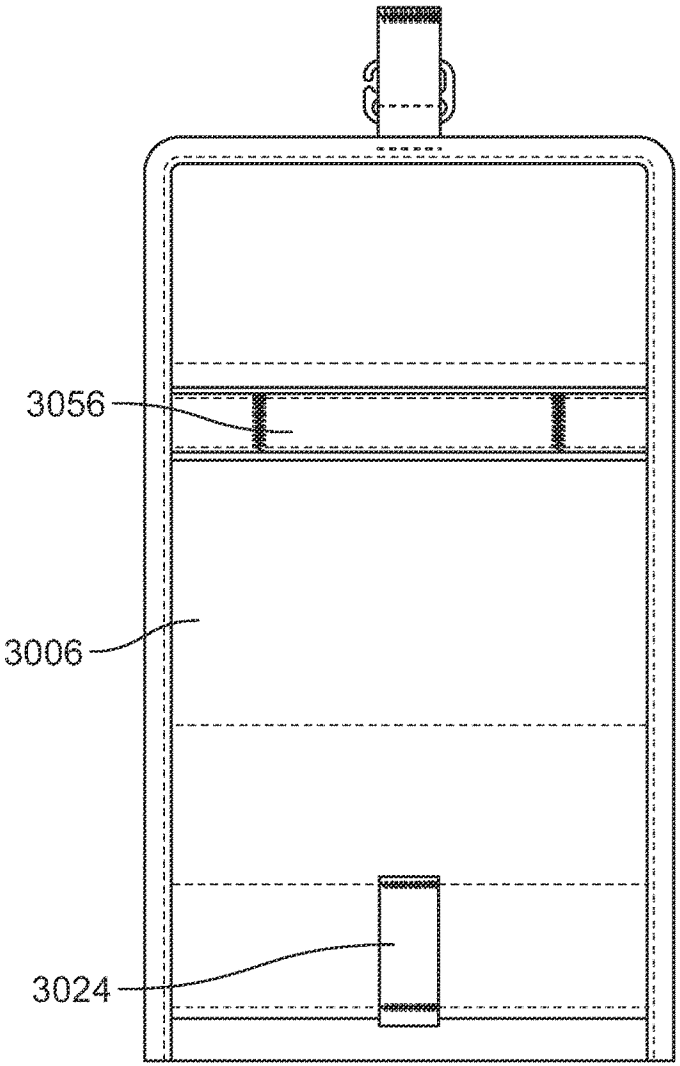
FIG. 38 depicts a back elevation view of the container of FIG. 30, according to one or more aspects described herein.
Figure 37:
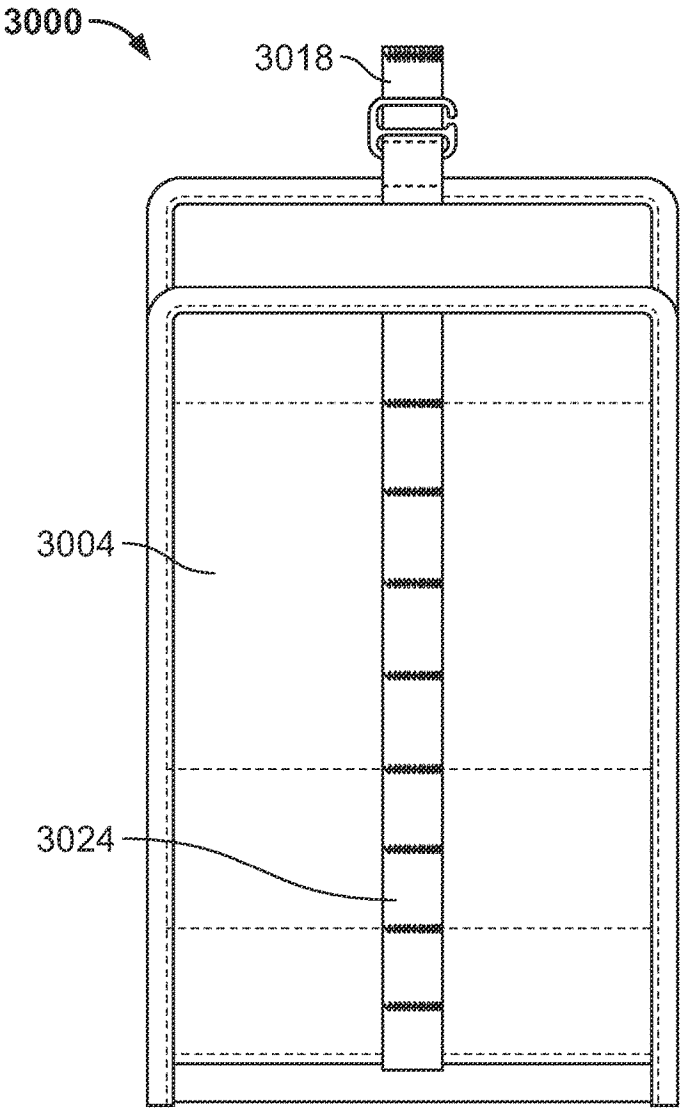
FIG. 37 depicts a front elevation view of the container of FIG. 30, according to one or more aspects described herein.
Figure 39:
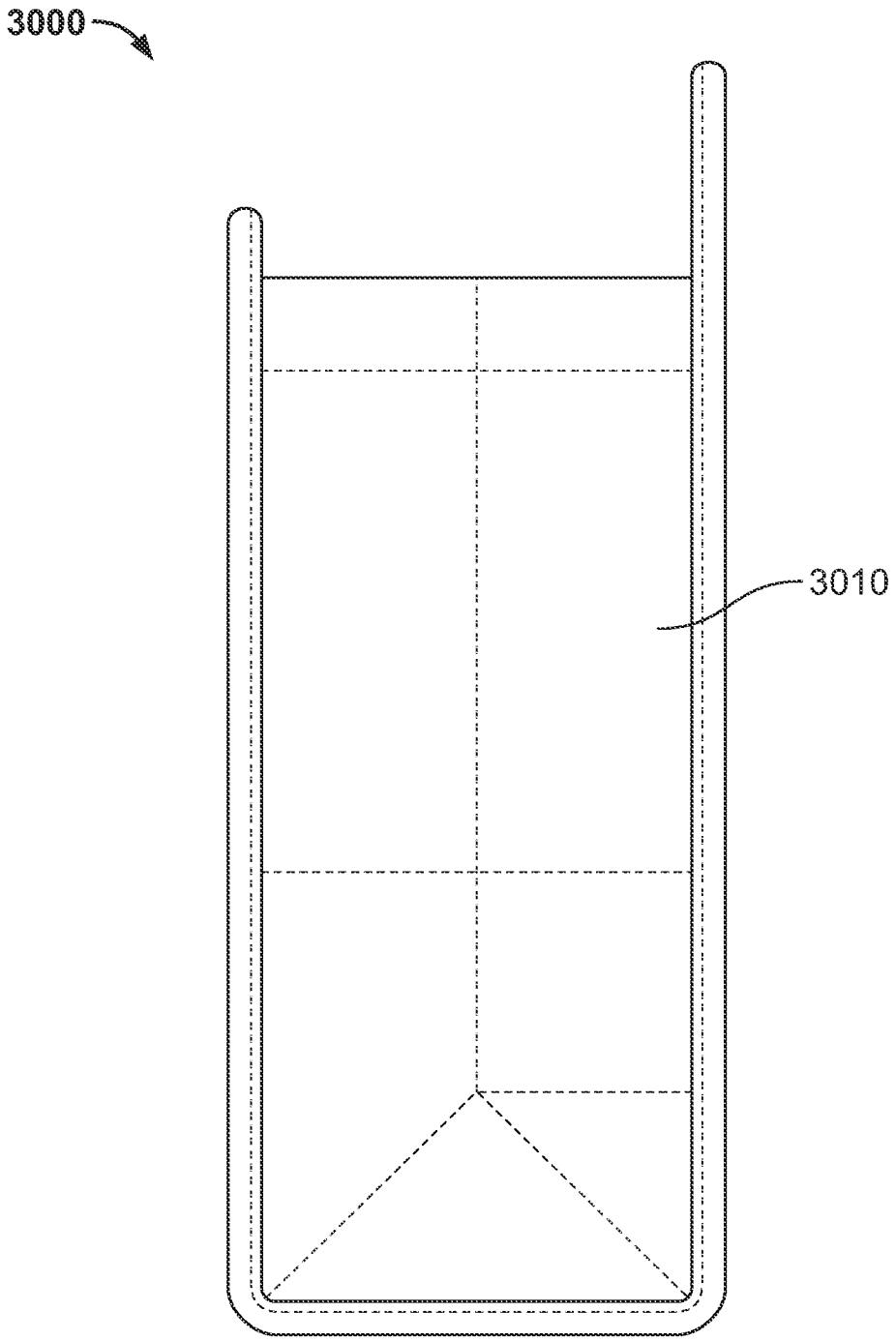
FIG. 39 depicts an end view of the container of FIG. 30, according to one or more aspects described herein.

FIG. 37 depicts a front elevation view of the container 3000, according to one or more aspects described herein. FIG. 38 schematically depicts a back elevation view of the container 3000, according to one or more aspects described herein. FIG. 39 depicts an end view of the container 3000, according to one or more aspects described herein.

Figure 40C:
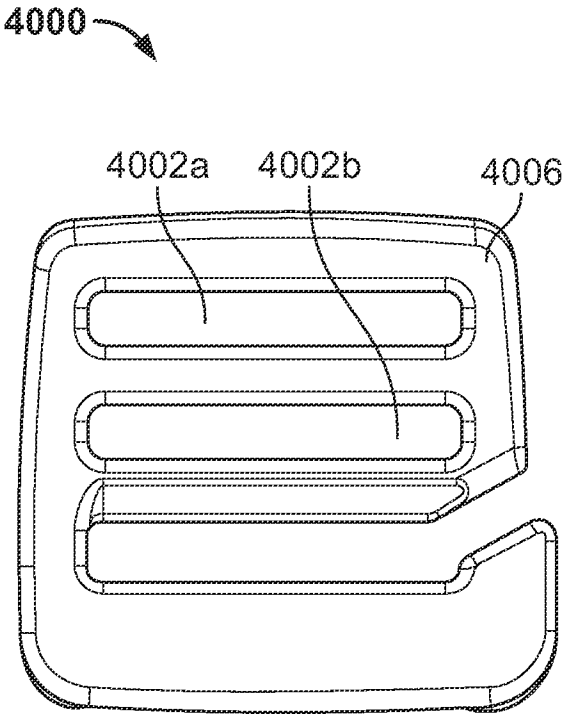
FIGS. 40A-C depict a hook fastener, according to one or more aspects described herein.
Figure 40B:
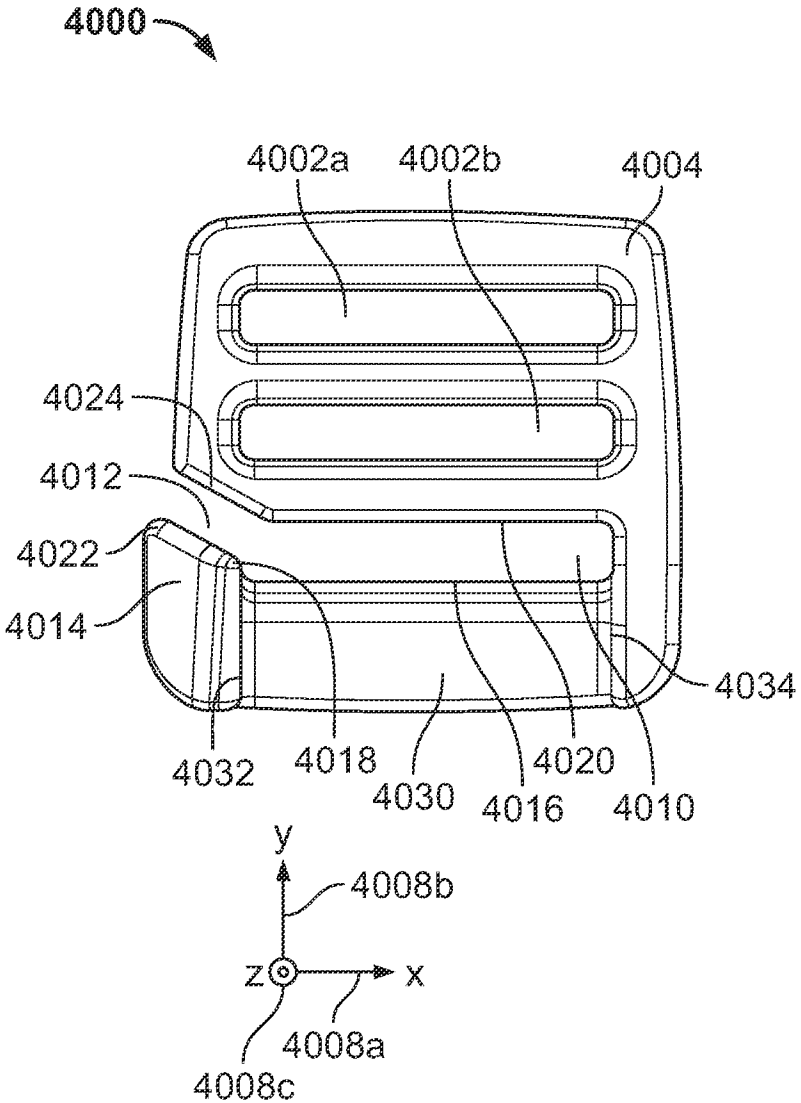
Figure 40A:
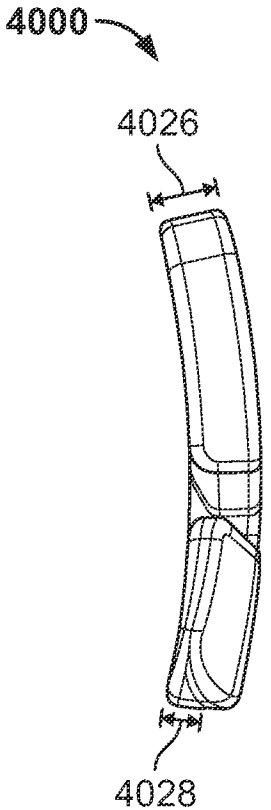

FIGS. 40A-40C depict side, front and back views of a hook fastener 4000, according to one or more aspects described herein. The hook fastener 4000 may be used in place of the fastener 3016, as previously described. Accordingly, the hook fastener 4000 may be configured to be rotatably coupled to the strap 3018, and configured to be removably coupled to the webbing loop 3022. Advantageously, the hook fastener 4000 includes multiple elements that reduce the likelihood of the fastener 4000 from being inadvertently decoupled from, in one example, the webbing loop 3022. It is contemplated that the hook fastener 4000 may additionally be utilized in various alternative fastening scenarios.

The hook fastener 4000 may be constructed from any material, or combination of materials. In one specific example, the hook fastener 4000 may be formed from aluminum, steel, titanium, a polymer (it is contemplated that any polymer, or combination of polymers may be used), or a ceramic, among others. The hook fastener 4000 includes two apertures 4002*a* and 4002*b* that extend through the hook fastener 4000 from a front face 4004 through to a back face 4006. These two apertures 4002*a* and 4002*b* have elongated geometries and rounded ends. In one example, a strap of webbing material, such as strap 3018, is passed through both of the apertures 4002*a* and 4002*b* to form a non-removable coupling (the strap is 3018 is not intended to be removed from the hook fastener 4000). This non-removable coupling that allows the hook fastener 4000 to pivot relative to the strap 3018. Advantageously, the use of the combination of two apertures 4002*a* and 4002*b* may reduce the propensity for the strap 3018 to rotate within the channels of the two apertures about the z-axis, schematically depicted as axis 4008*c*. Instead, the hook fastener 4000 is limited to rotation relative to the strap 3018 about the x-axis, schematically depicted as axis 4008*a*.

Additionally, the hook fastener 4000 includes a third aperture 4010 into which the webbing loop 3022 is configured to be received and held. An opening 4012 extends from a side of the hook fastener 4000 into the third aperture 4010. A ramped barb 4014 extending from the opening 4012 into the channel of the aperture 4010. Further, the lower wall 4016 of the aperture 4010 is stepped down from the end of the ramped barb 4014 by a step 4018. An upper wall 4020 of the aperture 4020 is approximately equal to or lower than a top point 4022 of the ramped barb 4014. An upper ramped surface 4024 is approximately parallel to the ramped geometry of the ramped barb 4014 and aids in guiding the webbing loop 3022 into an out from the channel of the aperture 4010.

Figure 41:
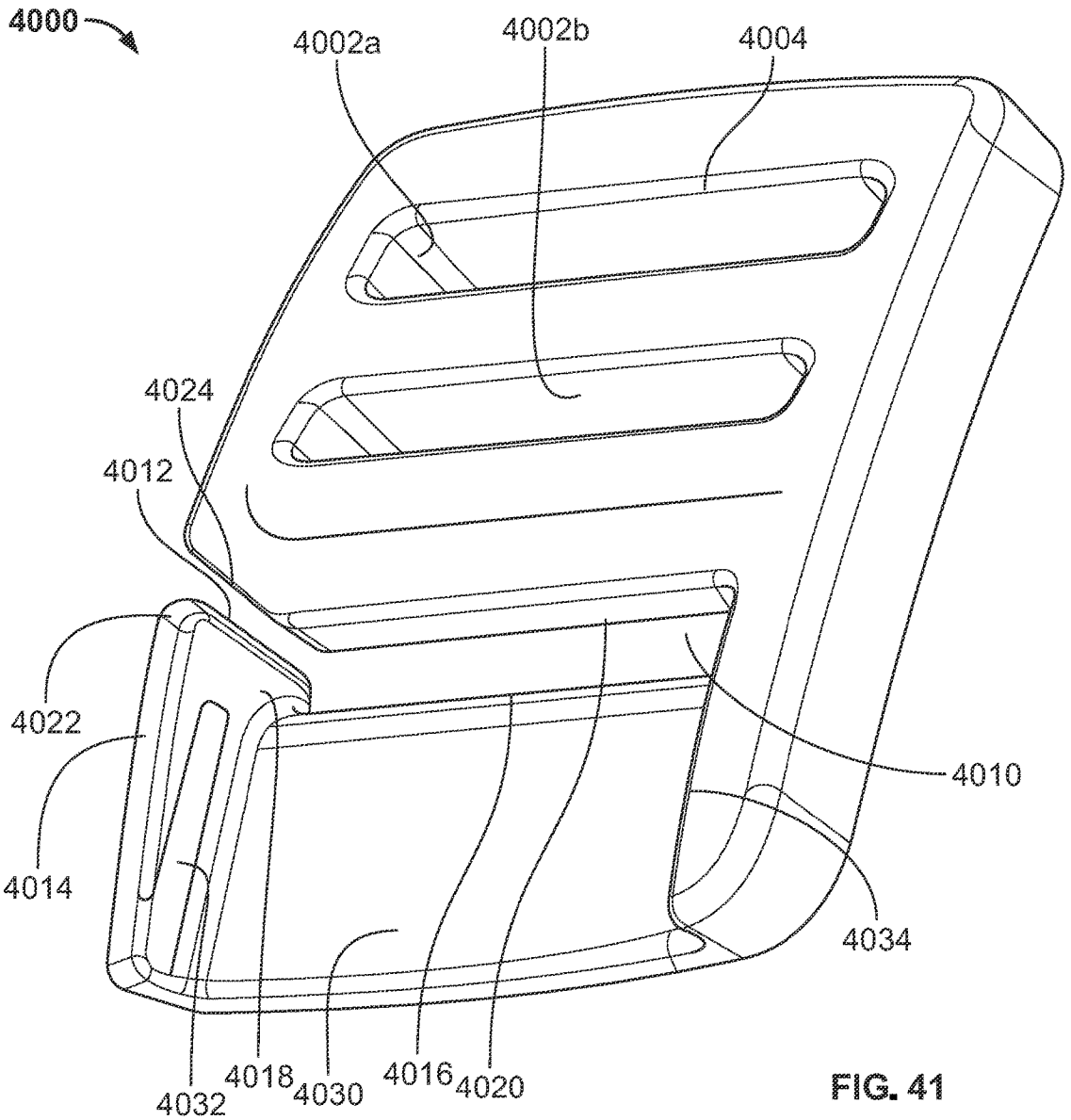
FIG. 41 depicts an isometric view of the hook fastener of FIGS. 40A-C, according to one or more aspects described herein.

The hook fastener 4000 has a curved geometry, as depicted in FIG. 40A. It is contemplated that the radius or radii of curvature associated with the depicted geometry of the hook fastener 4000 may have any values, without departing from the scope of these disclosures. The hook fastener 4000 has a first thickness 4026 and a second thickness 4028, less than the first thickness 4026. It is contemplated that the first thickness 4026 and the second thickness 4028 may be average thicknesses that may vary across the geometry of the hook fastener 4000. Further, the first thickness 4026 and the second thickness 4028 may have any values, without departing from the scope of these disclosures. In one example, the hook fastener 4000 includes a recessed channel 4030 that extends between a first end 4032 and a second end 4034. This recessed channel 4030 is configured to prevent the webbing loop 3022 from being inadvertently removed from the aperture 4010. In one example, the recessed channel 4030, and the end wall 4032 that extends in the z-direction 4008*c* above the surface of the recessed channel 4030, prevent a strap, or webbing portion (e.g., webbing loop 3022) from inadvertently sliding out of the opening 4012. In this regard, the relative height that the ramped barb 4014 extends above the recessed channel 4030 is depicted in a three-dimensional view of the hook fastener 4000 in FIG. 41.

Figure 42:
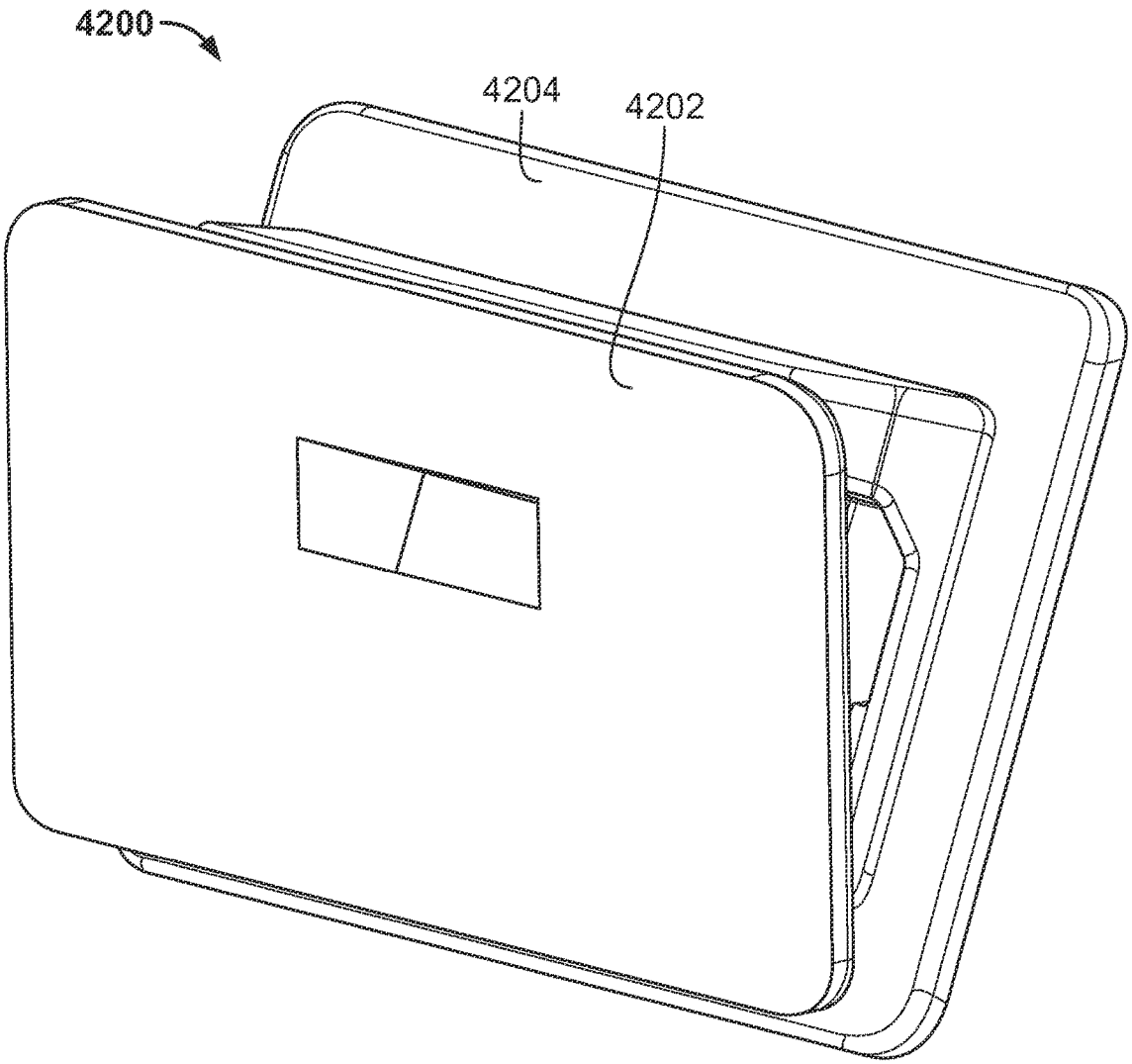
FIG. 42 depicts one implementation of a magnetic cleat, according to one or more aspects described herein.

FIG. 42 depicts one implementation of a magnetic cleat 4200, according to one or more aspects described herein. In one limitation, the magnetic cleat 4200 may be used as an alternative to the hook fastener 4000 or hook fastener 3016. In one example, the magnetic cleat 4200 includes a first portion 4202 that is configured to be magnetically coupled to a second portion 4204. Further, the first portion 4202 may be configured to be coupled to, in one example, the strap 3018, and the second portion 4204 may be configured to be coupled to an area of the front portion 3004 of the outer shell 3002. In an alternative example, the first portion 4202 of the magnetic cleat 4200 may be coupled to the flap 3014. Similarly, the second portion 4204 may be coupled to the series of webbing loops 3024, among others. It is contemplated that the first portion 4202 and the second portion 4204 may be coupled to the described areas of the container 3000, or other structures, using any fixation method and or technology. For example, the first portion 4202 and the second portion 4204 may be, among others, glued, stitched, riveted, sewn, or clamped into or onto various structures of the container 3000, or another structure, without departing from the scope of these disclosures.

Figure 43:
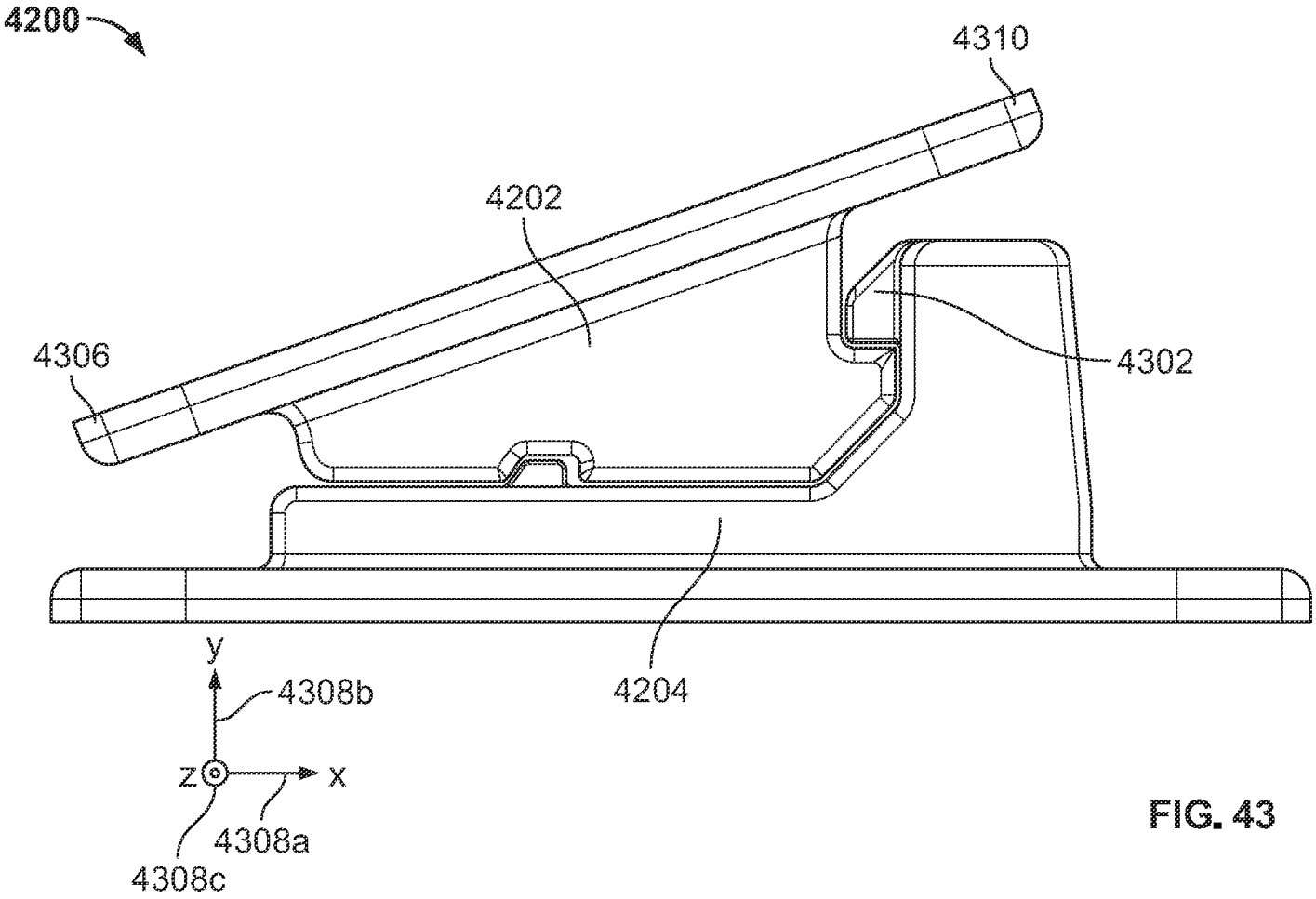
FIG. 43 depicts an end view of the magnetic cleat, according to one or more aspects described herein.

FIG. 43 depicts an end view of the magnetic cleat 4200, according to one or more aspects described herein. In one example, the magnetic cleat 4200 has geometries configured to prevent the first portion 4202 from being inadvertently magnetically decoupled from the second portion 4204. For example, the magnetic cleat 4200 includes a hook structure 4302 that is configured to prevent the first portion 4202 from being sheared away from the second portion 4204 along x-axis 4308*a*. The wedge-shaped geometry of the magnetic cleat 4200 facilitates, in one example, the intentional and manual decoupling of the first portion 4202 from the second portion 4204. In particular, a user may pivot the first portion 4202 away from the second portion 4204 by pulling the first end 4306 of the first portion 4202 away from the second portion 4204 substantially along the y-axis 4308*b* and/or by pushing the second end 4310 of the first portion 4202 toward the second portion 4204 substantially along the y-axis 4308*b* (along the negative y-axis 4308*b*).

Figure 44:
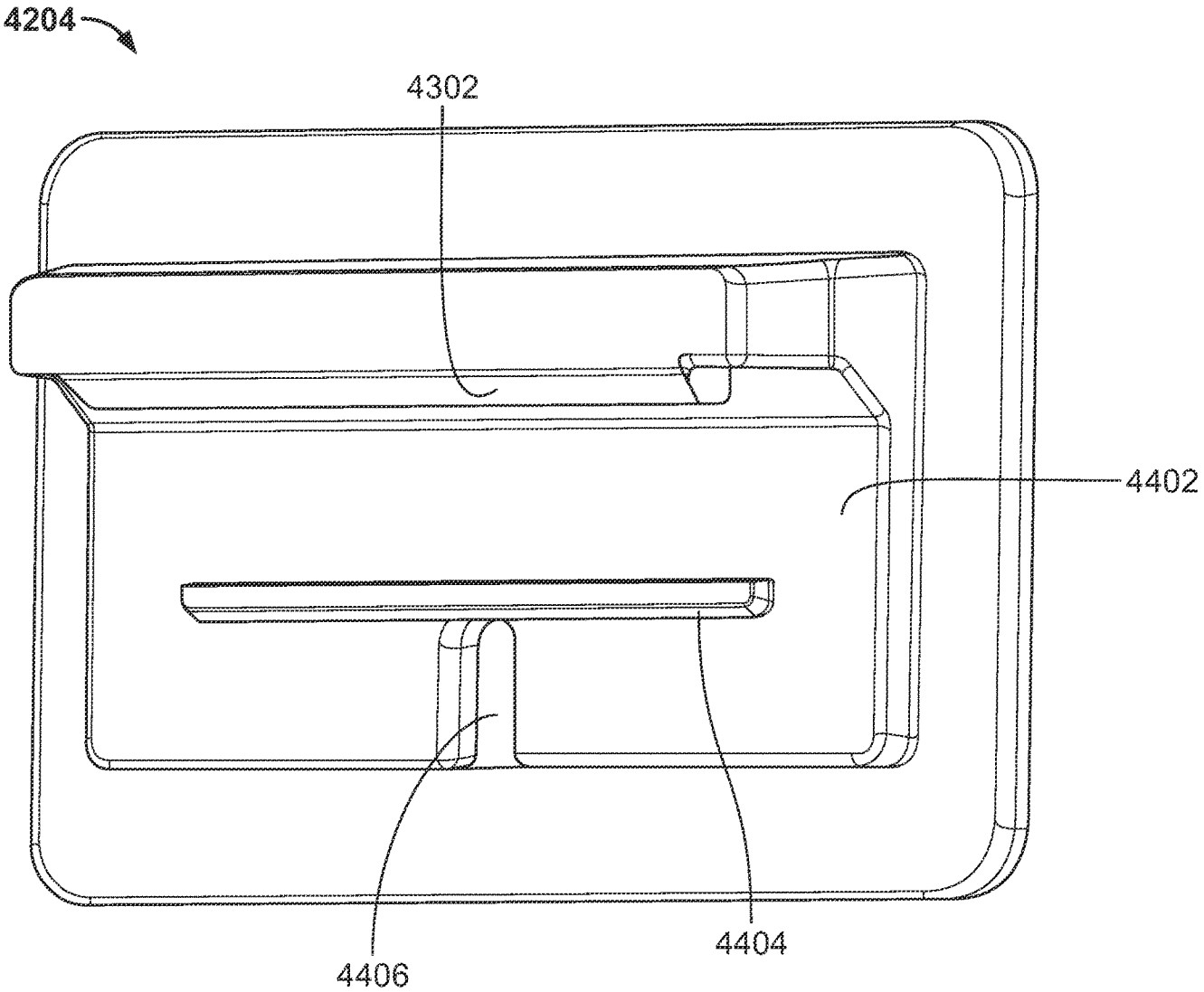
FIG. 44 depicts a view of a portion of the magnetic cleat of FIG. 42, according to one or more aspects described herein.

FIG. 44 depicts a view of the second portion 4204 of the magnetic cleat 4200, when removed from the first portion 4202. In one example, the second portion 4204 includes a magnetic surface 4402 that is configured to be magnetically coupled to a corresponding surface on the first portion 4202. Additionally, the magnetic surface 4402 includes geometric features configured to align and aid in retention of the first portion 4202 relative to the second portion 4204, when magnetically coupled to one another. In one example, the second portion 4204 includes an elongated protrusion 4404 that extends across a portion of the magnetic surface 4402. Additionally, the second portion 4204 includes a depression 4406 that extends into the structure of the second portion 4204 below the surface 4402.

Figure 45:
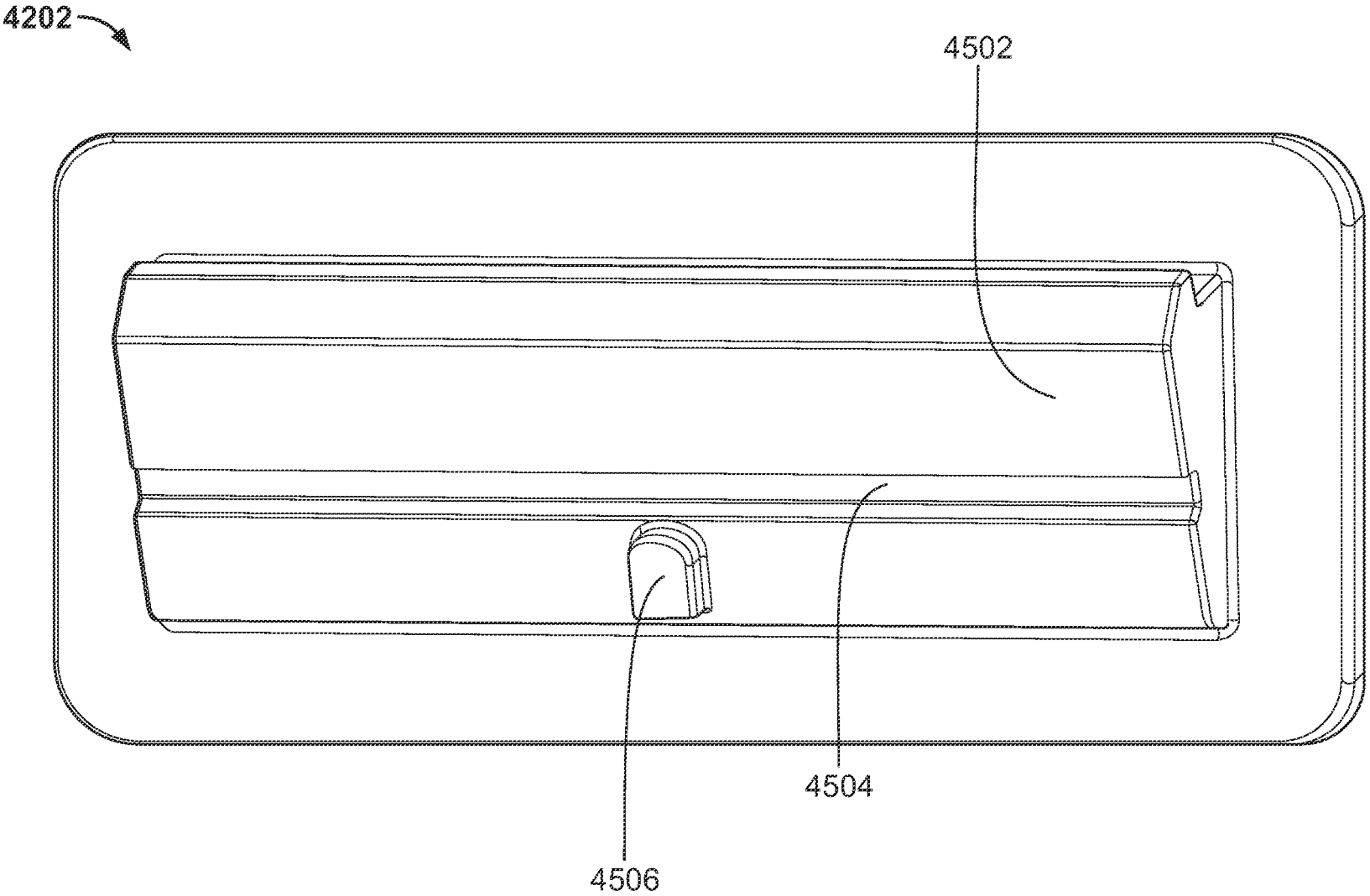
FIG. 45 depicts a view of another portion of the magnetic cleat of FIG. 42, according to one or more aspects described herein.

FIG. 45 depicts a view of the first portion 4202 of the magnetic cleat 4200. In one example, the first portion 4202 includes a magnetic surface 4502 that is configured to be magnetically coupled to the corresponding magnetic surface 4402 on the second portion 4204. Additionally, the magnetic surface 4502 includes geometric features configured to align and aid in retention of the first portion 4202 relative to the second portion 4204, when magnetically coupled to one another. In one example, the first portion 4202 includes an elongated depression 4504 that extends across a portion of the magnetic surface 4502 and is configured to receive the elongated protrusion 4404. Additionally, the second portion 4204 includes a protrusion 4506 that extends out from the structure of the surface 4502 it is configured to be received into the depression 4406 of the second portion 4204.

Figure 46:
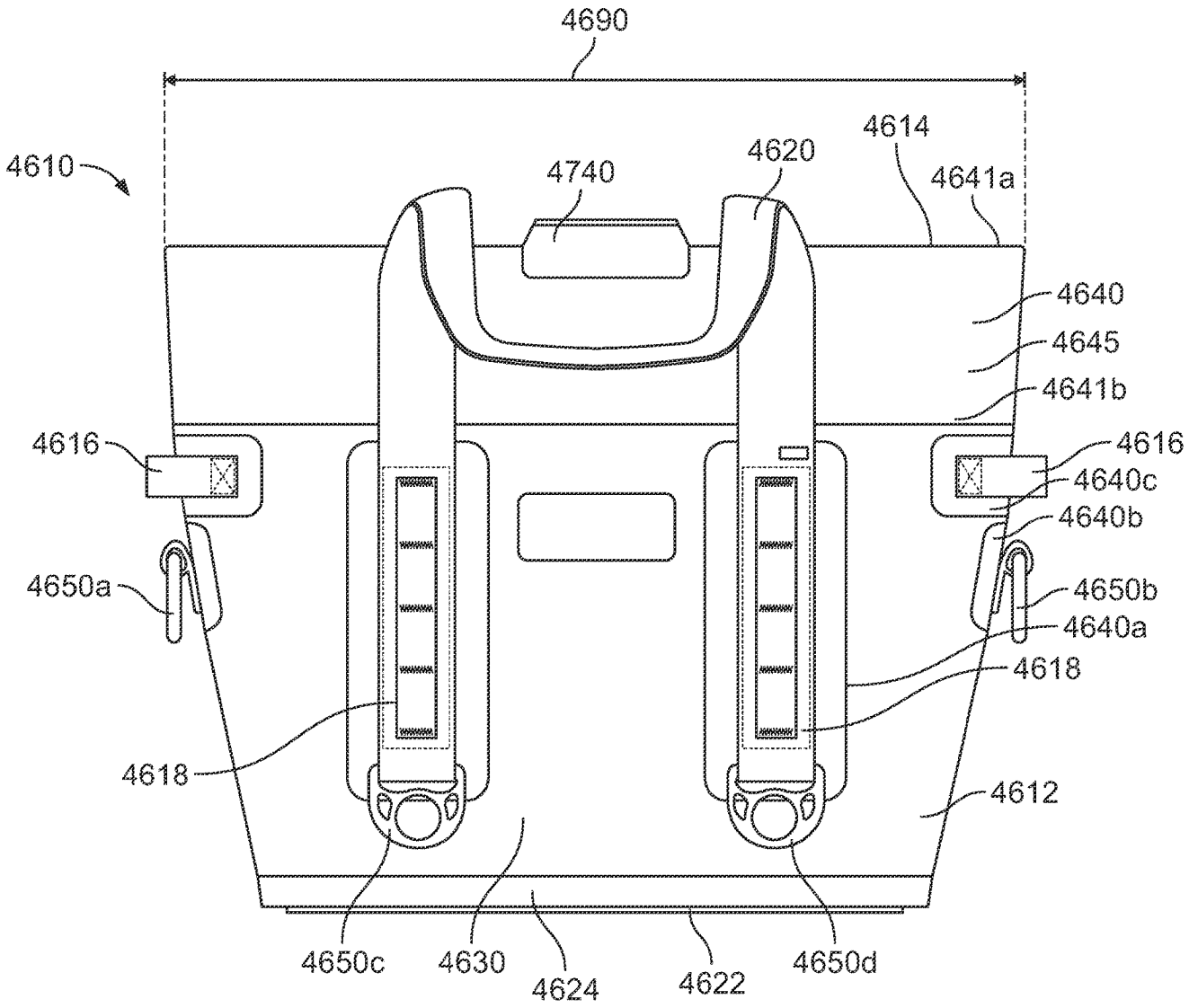
FIG. 46 depicts a front view an exemplary insulating container that can be configured to keep contents cool or warm for an extended period of time, according to one or more aspects described herein.
Figure 47:
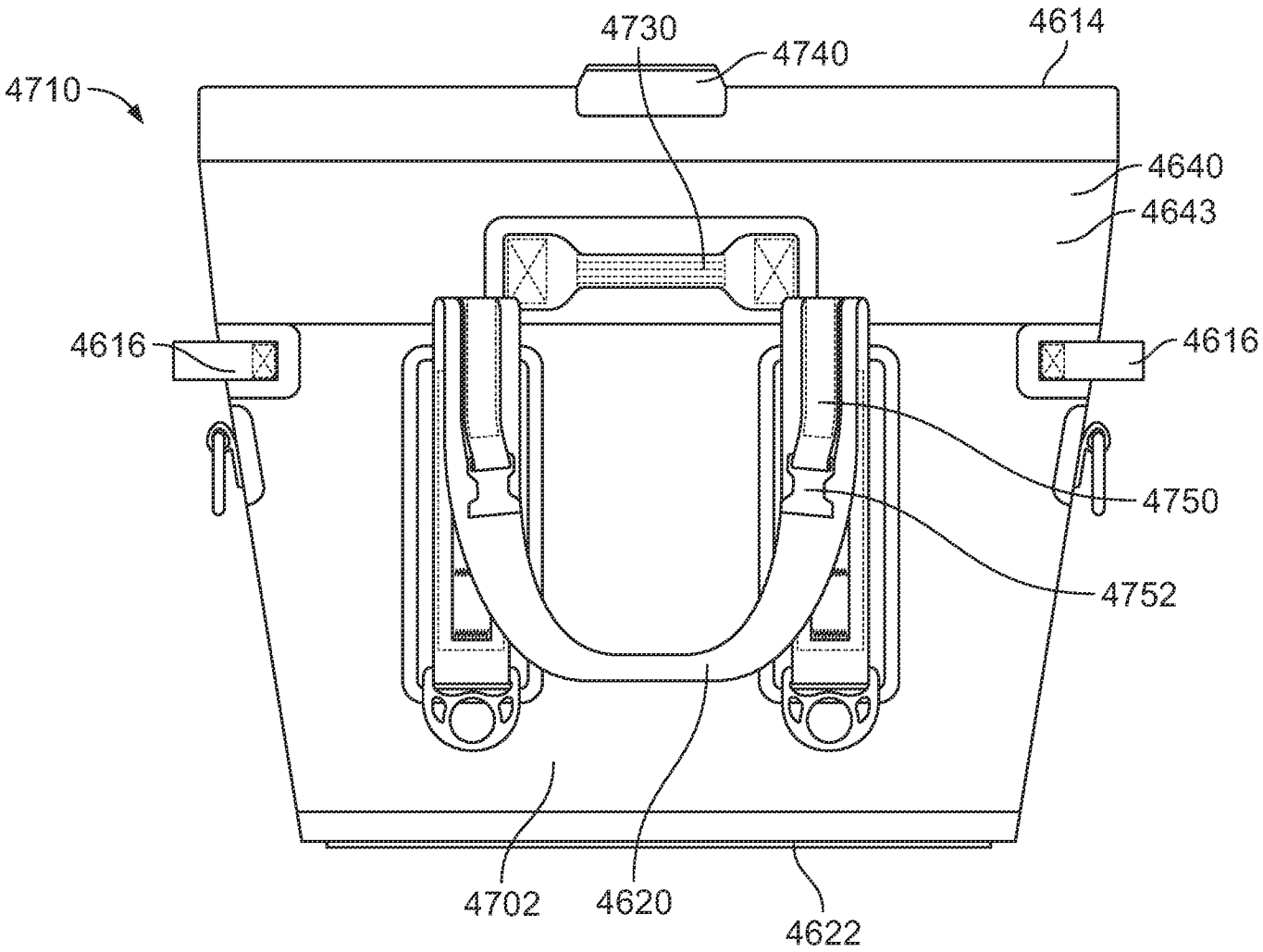
FIG. 47 depicts a back view of the exemplary insulating container of FIG. 46, according to one or more aspects described herein.
Figure 48:
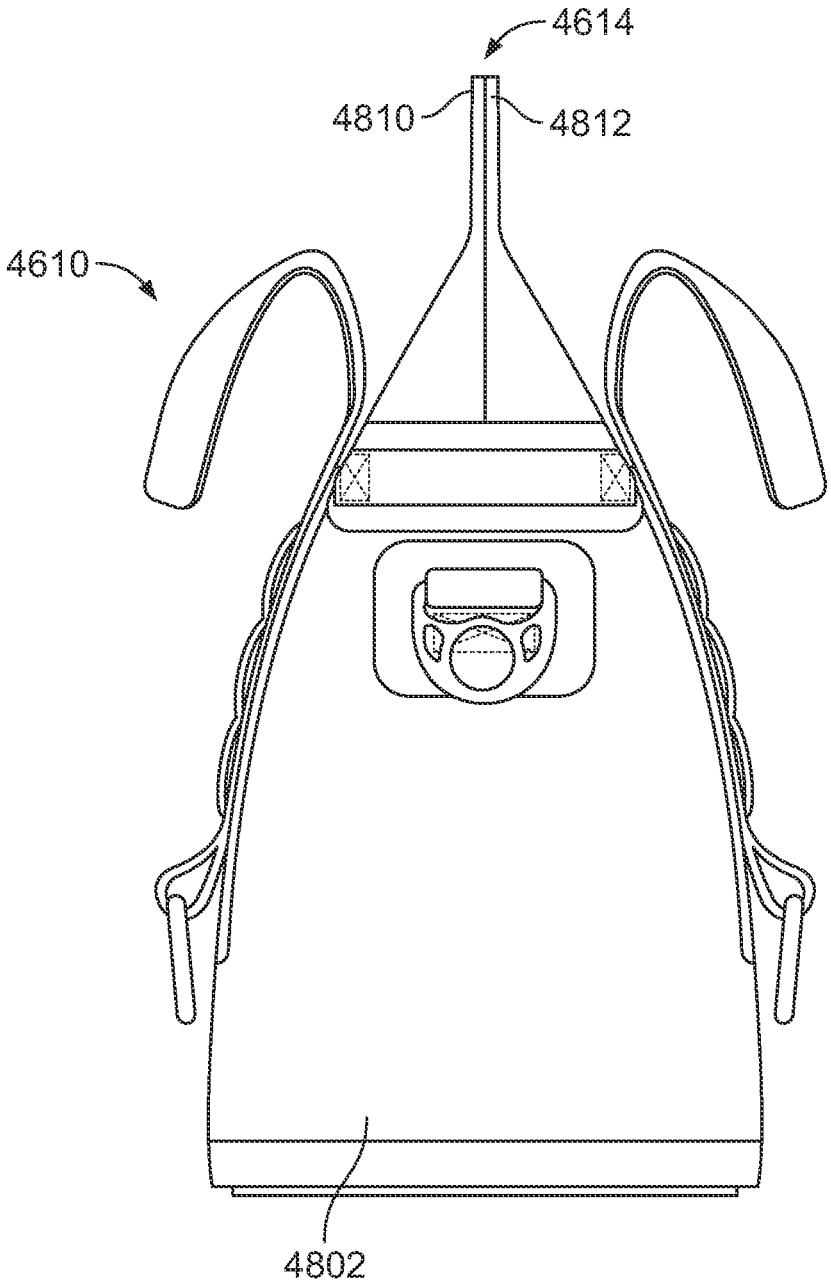
FIG. 48 depicts a side view of the exemplary insulating container of FIG. 46, according to one or more aspects described herein.

FIG. 46 depicts a front view an exemplary insulating container 4610 that can be configured to keep contents cool or warm for an extended period of time. The insulating container 4610 may include elements similar to those described in U.S. Pat. No. 10,143,282, filed 6 Mar. 2017, the entire contents of which are incorporated herein by reference in their entirety for any and all non-limiting purposes. FIG. 47 depicts a back view of the insulating container 4610, and FIG. 48 depicts a side view of the insulating container 4610. The insulating container 4610 generally includes an outer shell 4612 that defines a front portion 4630, a back portion 4702, a side portion 4802, and a base 4622. In one example, the front portion 4630, the rear portion 4702, and the site portion 4802 may collectively be referred to as the sidewall of the container 4610. The container 4610 additionally includes an opening 4614 at a top portion of a placket flap 4640. Accordingly, the placket flap 4640 is configured to extend between a top of the outer shell 4630, and the opening 4614. The opening 4614 is configured to provide a resealable point of entry into a storage compartment of the container 4610. The storage compartment is shown in further detail as compartment 5012 in FIG. 50. The opening 4614 may be sealed by any of the closure mechanisms described throughout this document. In one example, the opening 4614 includes the elements described in relation to FIG. 13D. Accordingly, the opening 4614 includes a front side 4810 and a back side 4812. The seam 1324, as described in relation to FIG. 13D, may be coupled to the front side 4810 of the opening 4614, and the seam 1328, as described in relation to FIG. 13D, may be coupled to the back side 4812 of the opening 4614. As such, the opening 4614 may be resealably sealed by the first magnetic strip 1320 and the second magnetic strip 1322, whereby the first and second magnetic strips 1320 and 1322 have top edges that are coupled to the respective front and back sides 4810 and 4812 of the opening 4614. The first and second magnetic strips 1320 and 1322 have bottom edges that are not attached to an internal surface of the container 4610, and described as loose ends 1342 and 1330. The opening 4614 may additionally include a pulltab 4670, which is configured to be manually script to pull the front and back sides 4810 and 4812 away from one another to unseal the opening 4614.

As shown in FIG. 46, various handles, straps, and webs (e.g., 4616, 4618, 4620) can also be included on the insulating container 4610 for carrying, holding, or securing the insulating device 4610. In this regard, the outer shell 4612 can also include multiple reinforcement areas or patches, e.g., 4640*a*-4640*c* that are configured to assist in structurally supporting the optional handles or straps (e.g., 4616, 4618, 4620). The handles or straps (e.g., 4616, 4618, 4620, 4730) and other attachments may be stitched, glued, welded or riveted, or attached using any other attachment methodology, or combination of methodologies, to the main structure of the insulating container 4610.

FIG. 46 further depicts a base 4622 and a base support ridge 4624. The base support ridge 4624 can provide structural integrity and support to the insulating device 4610 (otherwise referred to as an insulating container 4610) when the insulating device 4610 is placed onto a surface. In one example, the insulating container 4610 may additionally include a pull tab 4740, which may be configured to be manually gripped to pry apart the magnetic strips of the magnetic closure of the opening 4614.

Figure 50:
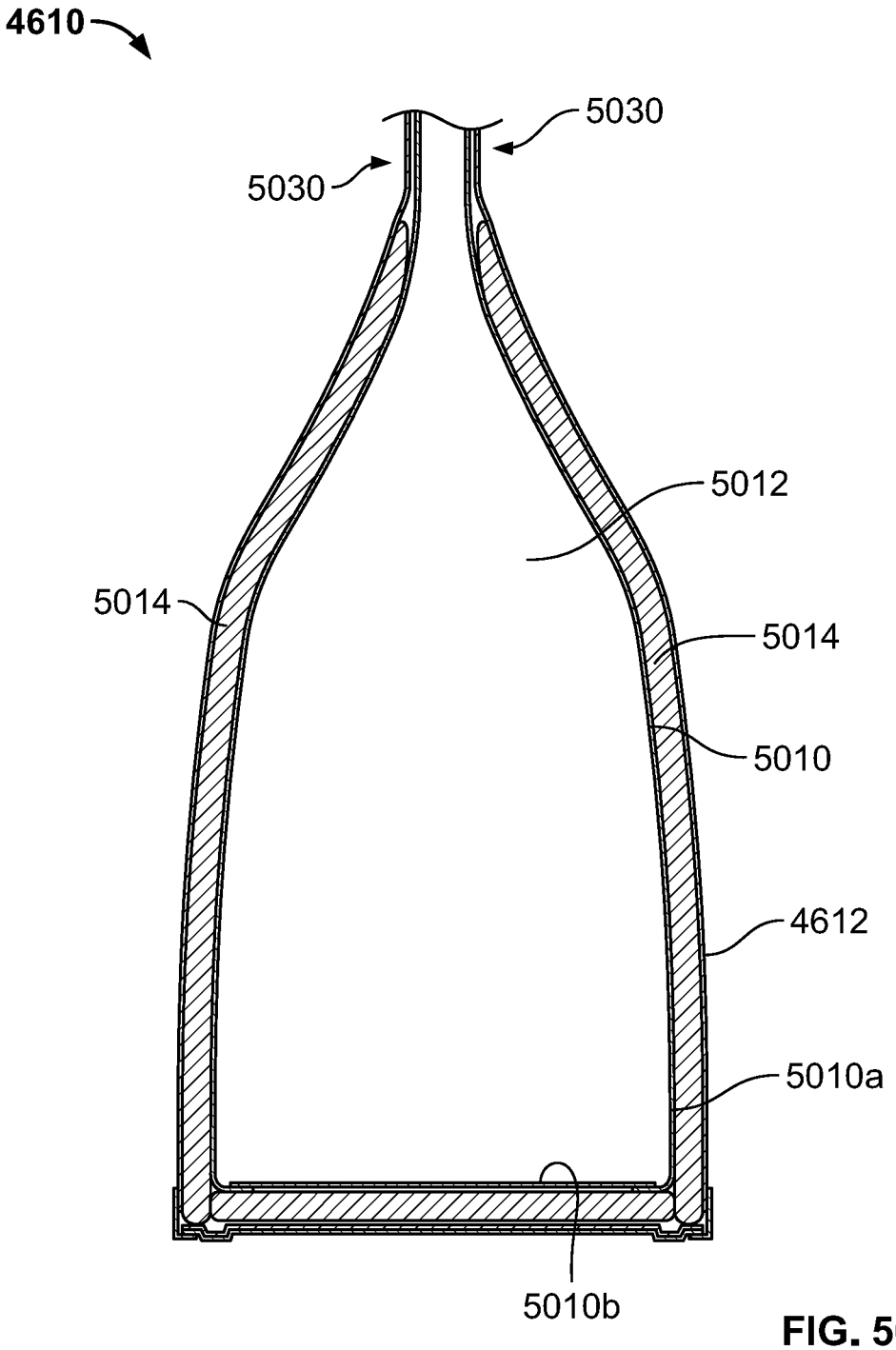
FIG. 50 schematically depicts a cross-sectional side view of the insulating device of FIG. 46, according to one or more aspects described herein.

FIG. 50 schematically depicts a cross-sectional side view of the insulating device 4610. In one example, the inner liner 5010 forms a chamber, receptacle, or storage compartment 5012 for receiving and storing contents therein. The insulating device 4610 includes an inner liner 5010, an insulating layer 5014, and an outer shell 4612. As shown in FIG. 50, the insulating layer 5014 can be located between the inner liner 5010 and the outer shell 4612, and can be formed as a foam insulator to assist in maintaining the internal temperature of the storage compartment 5012 for storing contents desired to be kept cool or warm. Also, the insulating layer 5014 can be located in between the inner liner 5010 and the outer shell 4612, and can be unattached to either the inner liner 5010 or the outer shell 4612 such that it floats between the inner liner 5010 and the outer shell 4612. In one example, the inner liner 5010 and the outer shell 4612 can be connected at a top portion 5030 of the insulating device 4610 such that the insulating layer 5014 can float freely within a pocket formed by the inner liner 5010 and the outer shell 4612.

In this example, the inner layer or inner liner 5010 can be formed of a first inner liner sidewall portion 5010*a* and a bottom inner liner portion 5010*b*. The first inner liner sidewall portion 5010*a* and the bottom inner liner portion 5010*b* can be secured together by, for example, welding, to form the compartment 5012. In one example, the compartment 5012 can be a "dry bag," or vessel for storing contents. In one example, a tape, such as a TPU tape, can be placed over the seams joining the sections of the storage compartment 5012, after the first inner liner sidewall portion 5010*a* and the bottom inner liner portion 5010*b* are secured or joined together. The tape seals the seams formed between the first inner liner sidewall portion 5010*a* and the bottom inner liner portion 5010*b* to provide an additional barrier to liquid to prevent liquid from either entering or exiting the compartment 5012. The inner liner 5010 can, thus, either maintain liquid in the compartment 5012 of the insulating device 4610 or prevent liquid contents from entering into the compartment 5012 of the insulating device 4610. It is also contemplated, however, that the inner liner 5010 can be formed as an integral one-piece structure that may be secured within the outer shell 4612.

Figure 51:
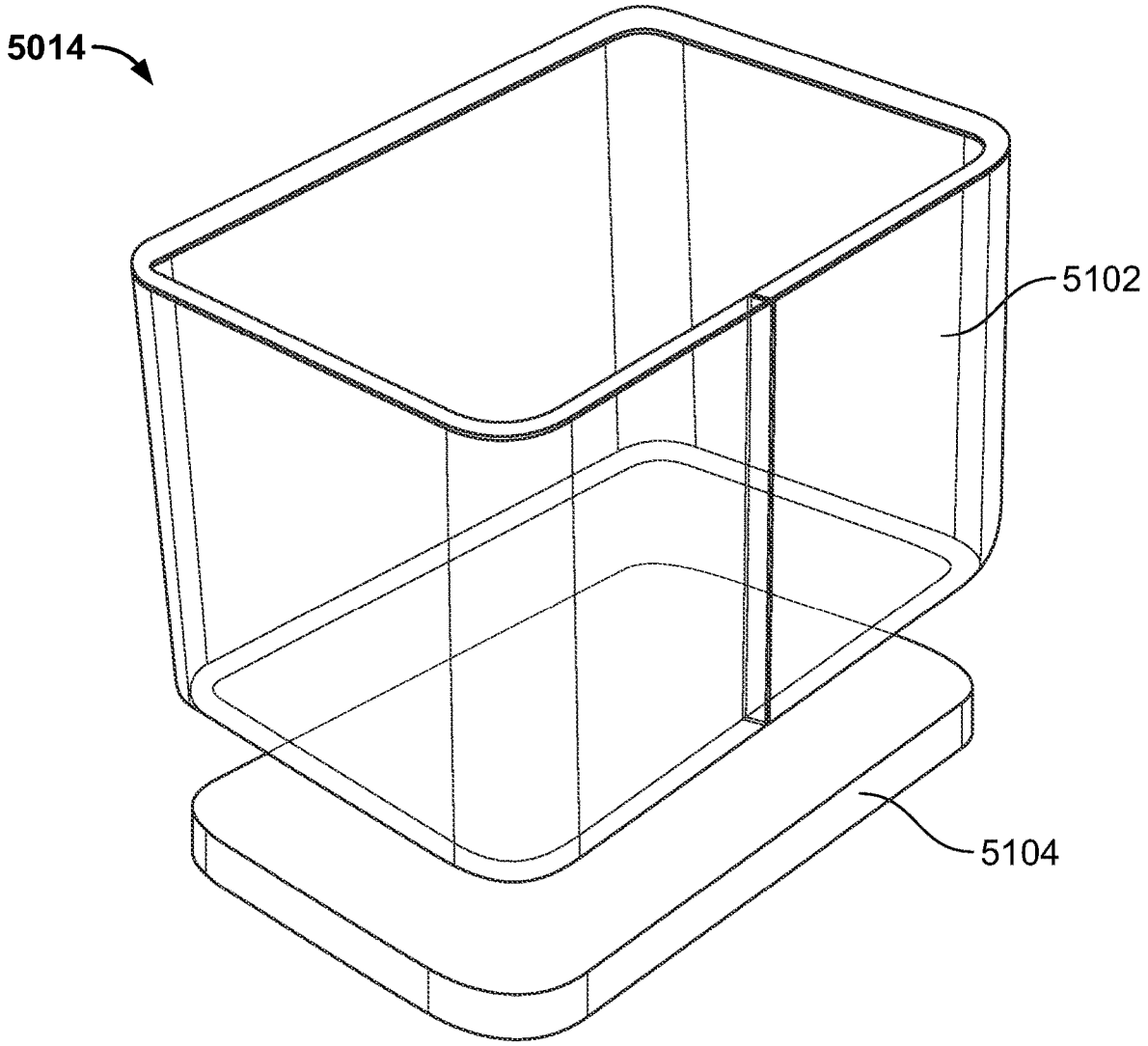
FIG. 51 schematically depicts an insulating layer of the insulating device of FIG. 46, according to one or more aspects described herein.

FIG. 51 schematically depicts the insulating layer 5014. The insulating layer 5014 can be formed of a first portion or an upper portion 5102, a second portion or base portion 5104. It is contemplated that the insulating layer 5014 may be formed from any insulating material. The insulating material may include, among others, an EVA foam and/or any other foam material having any density and/or insulation values/properties.

The insulating the container 4610 may include two carry handles 4620 that are connected to the front side 4630 of the insulating container 4610 and the back side 4702 of the insulating container 4610. In one example, a shoulder strap can be attached to attachment rings 4650*a-b*. The insulating container 4610 additionally include side handles 4616 to facilitate carrying of insulating the container 4610. Additionally, webbing formed as loops 4618 can be sewn onto or otherwise attached to the straps of the handles 4620. The loops 4618 can be used to attach items (e.g., carabineers, dry bags) to the insulating the container 4610. In one example, the carry handles 4620, side handles 4616, and attachment points 4618 can be constructed of nylon webbing. Other materials may include, among others, polypropylene, neoprene, polyester, Dyneema, Kevlar, cotton fabric, leather, plastics, rubber, or rope.

In one example, the rings 4650*a-d* may be Acetal D-rings. The attachment rings 4650*a-d* may be constructed from one or more polymers, metals, ceramics, glasses, alloys, or combinations thereof. In certain specific examples, the attachment rings 4650*a-d* may be constructed from polypropylene, neoprene, polyester, Dyneema, and Kevlar, cotton fabric, leather, plastics, rubber, or rope. The attachment rings 4650*a-d* may include other shapes, sizes, and configurations other than the depicted "D" shape. Examples include round, square, rectangular, triangular, or rings with multiple attachment points.

In one example, the closure used to seal the opening 4614 and as described, in one example, in relation to FIG. 13D, can be substantially waterproof or water resistant and prevent or reduce liquid ingress into and/or egress from the insulating container 4610. Further, the placket flap portion 4640 may be folded to further seal the opening 4614.

The placket flap portion 4640 may have a front side 4645 and a back side 4643. Further, in one implementation, the placket flap portion 4640 may be configured to fold such that a top placket portion 4641*a* folds over onto a bottom placket portion 4641*b*. When folded, the top placket portion 4641*a* may be removably coupled to the bottom placket portion 4641*b* by a secondary closure mechanism. In one example, both of the top placket portion 4641*a* and the bottom placket portion 4641*b* may include magnetic elements (e.g., permanent magnets and magnetic materials) that are embedded within the container 4610 along the length 4690 of the placket flap portion 4640. In one example, a single magnetic strip may be embedded in one or more of the top placket portion 4641*a* and the bottom placket portion 4641*b* and extend along at least a portion of the length of 4690. Additionally or alternatively, a series of one or more discrete magnetic elements may be embedded in one or more of the top placket portion 4641*a* and the bottom placket portion 4641*b* and extend along at least a portion of the length 4690. In other implementations, hook and loop fasteners, or other fastener types, may be used in combination with or as an alternative to magnetic fasteners to removably couple the top placket portion 4641*a* and the bottom placket portion 4641*b* to one another.

Figure 49:
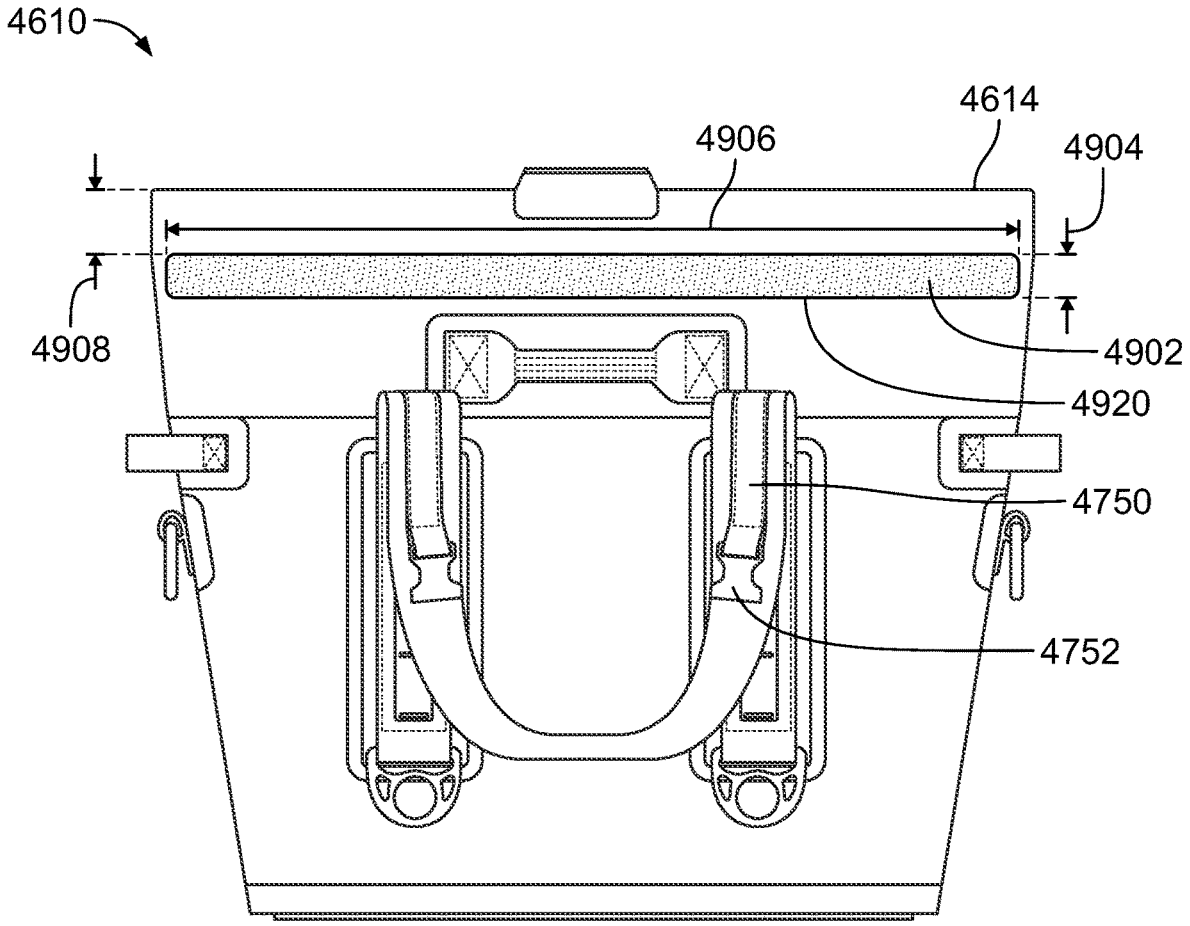
FIG. 49 schematically depicts a view of the exemplary insulating container of FIG. 46, according to one or more aspects described herein.

FIG. 49 schematically depicts the insulating container 4610. In particular, FIG. 49 schematically depicts an internal reinforcement board 4902 that may be positioned within the placket flap portion 4640. In one example, the reinforcement board 4902 may extend along at least a portion of the length 4690. It is contemplated that the board 4902 may have any height 4904 and length 4906. Further, it is contemplated that the board 4902 may be positioned at any distance 4908 from the top edge of the opening 4614. In one example, the board 4902 may be constructed from an ABS material with a thickness in the range of 1 to 10 mm. However, additional or alternative materials and/or thicknesses may be used to form the board 4902, without departing from the scope of these disclosures. In one example, the board 4902 may be configured to define a line along which the placket flap portion 4640 configured to fold. Accordingly, this fold line may be proximate a lower edge 4920 of the board 4902.

In another implementation, the placket flap portion 4640 may be configured to fold about the lower edge 4920 of the board 4902. Further, the top placket portion 4641*a* may be held in a folded configuration by buckles and straps that extend over the top of the container 4610 between the back portion 4702 and the front portion 4630. Strap 4750 and buckle 4752, which may be coupled the carry handle 4620, may be utilized to hold the top placket portion 4641*a* in a folded configuration when removably coupled to a corresponding buckle coupled to the carry handle 4620 on the front portion 4630 of the container 4610.

Figure 52:
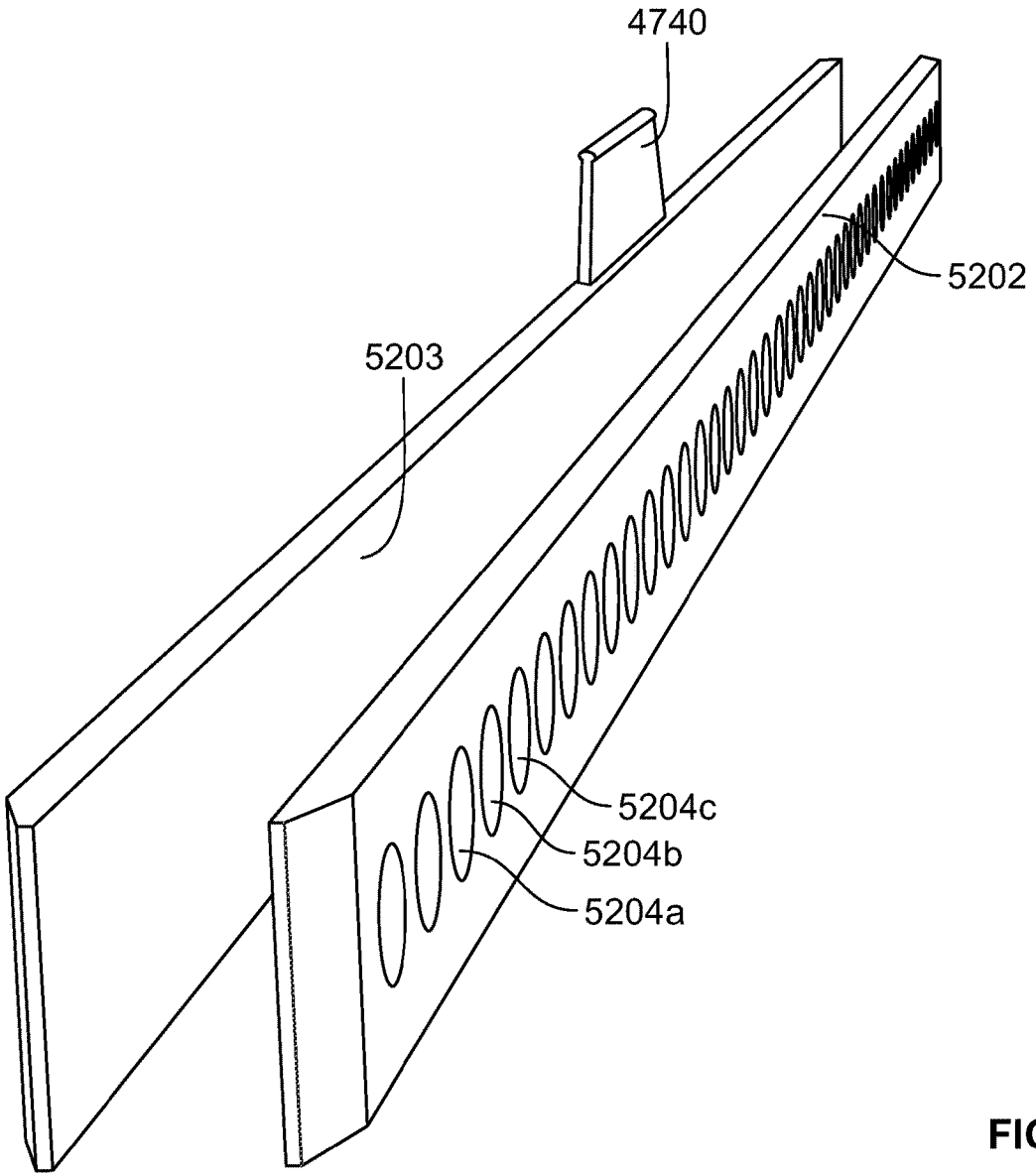
FIG. 52 depicts two magnetic strips, which may be used to form a magnetic closure of an opening of the insulating device of FIG. 46, according to one or more aspects described herein.

FIG. 52 depicts two magnetic strips 5202 and 5203, which may be used to form the magnetic closure of the opening 4614. In particular, the magnetic strips 5202 and 5204 may be used as alternatives to the magnetic strips 1320 and 1322 described in relation to the closure mechanism of FIG. 13D. As previously described, the closure mechanism of FIG. 13D may be used to resealably seal the opening 4614. In one implementation, both of the magnetic strips 4202 and 4204 include a series of discrete permanent magnets that are retained within magnet wells, of which wells 5204*a-c* are exemplary of a larger series of wells. In one example, the magnets that are rigidly affixed into the wells 5204 may be oriented such that adjacent magnets have opposite polarity facing outward. For example, for the magnets positioned within the exemplary wells 5204*a-c*, the magnet within well 5204*a* may face its north pole toward strip 5203, the magnet within well 5204*b* may face its south pole toward strip 5203, and the magnetic within well 5204*c* may face its north pole toward strip 5203 etc. it is contemplated that the magnetic strips 5202 and 5203 may be coupled to the front side 4810 and backside 4812 using any fixation methodology, technique and/or technology. It is further contemplated that the magnets affixed within the wells 5204*a-c* may be constructed from any material, without departing from the scope of these disclosures. As depicted, pull tab 4740 may extend from one of the magnetic strips 5202 or 5203. In an alternative implementation, each of the magnetic strips 5202 and 5203 may include a pull tab, similar to pull tab 4740. In yet another implementation, the pull tab 4740 may not be coupled to one of the magnetic strips 5202 or 5203. In such an implementation, the pull tab 4740 may instead be coupled to one or both sides of the opening 4614. For example, one or more pull tabs 4740 may be coupled to one or both of the front side 4810 and the backside 4812, and may not form part of the magnetic strip 5202 or the magnetic strip 5203. In yet another example, the insulating container 4610 may be implemented without one or more pull tabs 4740.

Figure 53:
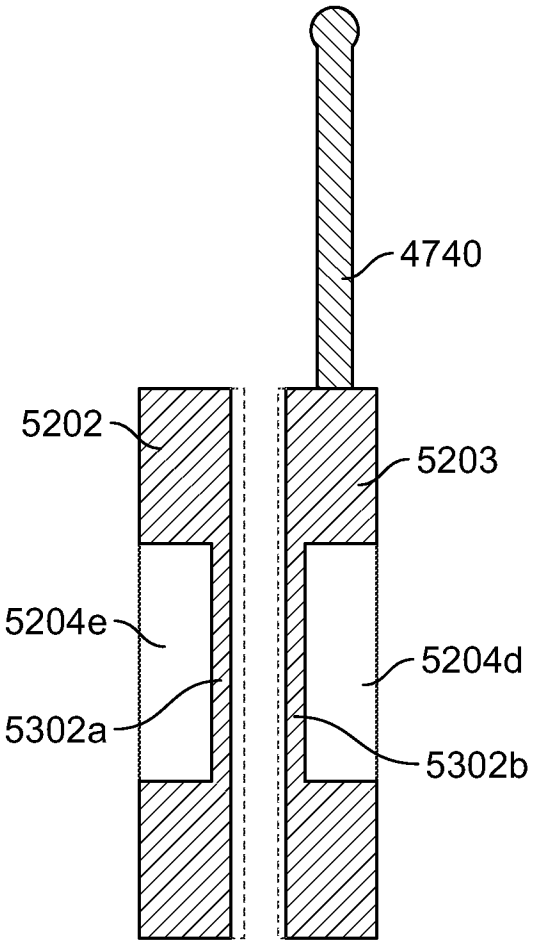
FIG. 53 schematically depicts a cross-sectional view of the magnetic strips of FIG. 52, according to one or more aspects described herein.

FIG. 53 schematically depicts a cross-sectional view of the magnetic strips 5202 and 5203. In one example, the magnetic strips 5202 and 5203 may be constructed from a TPU. However, it is contemplated that combination of polymers, metals, or alloys, among others, may be used to construct the magnetic strips 5202 and 5203. FIG. 53 depicts two exemplary magnet wells 5204*e* and 5204*d*, which are opposite one another and configured to retain to magnet elements. In one example, buffer layers 5302*a* and 5302*b* separate the magnets positioned within wells 5204*d* and 5204*e*, when magnetically coupled to one another. It is contemplated that these buffer layers 5302*a* and 5302*b* may the implemented with any thickness values.

In another implementation, the magnetic strips 5202 and 5203 may be implemented without the buffer layers 5302*a* and 5302*b*, such that the magnets held within wells 5204*d* and 5204*f* are positioned proximate one another when magnetically coupled to one another. In yet another example, the buffer layers 5302*a* and 5302*b* may be formed from an alternative material type to the rest of the structure of the magnetic strips 5202 and 5203, without departing from the scope of these disclosures.

Figure 54:
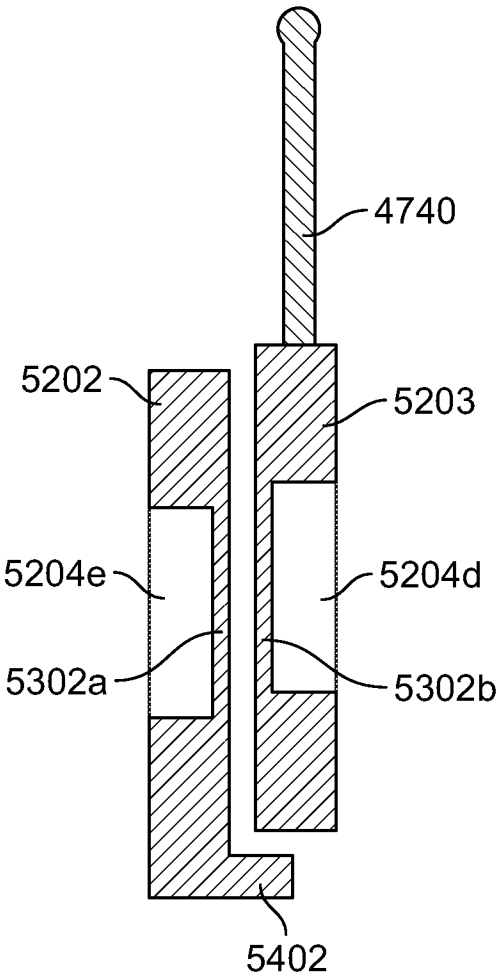
FIG. 54 schematically depicts an alternative implementation of magnetic strips come according to one or more aspects described herein.

FIG. 54 schematically depicts an alternative implementation of the magnetic strips 5202 and 5203. Accordingly, in addition to the alternating polarity of the magnets retained within each of the magnetic strips 5202 and 5203, the magnetic strips 5202 and 5203 may be aligned with one another using a fin 5402. This fin 5402 may have any geometry that facilitates proper alignment of the magnetic strips 5202 and 5203 with one another.

Figure 55:
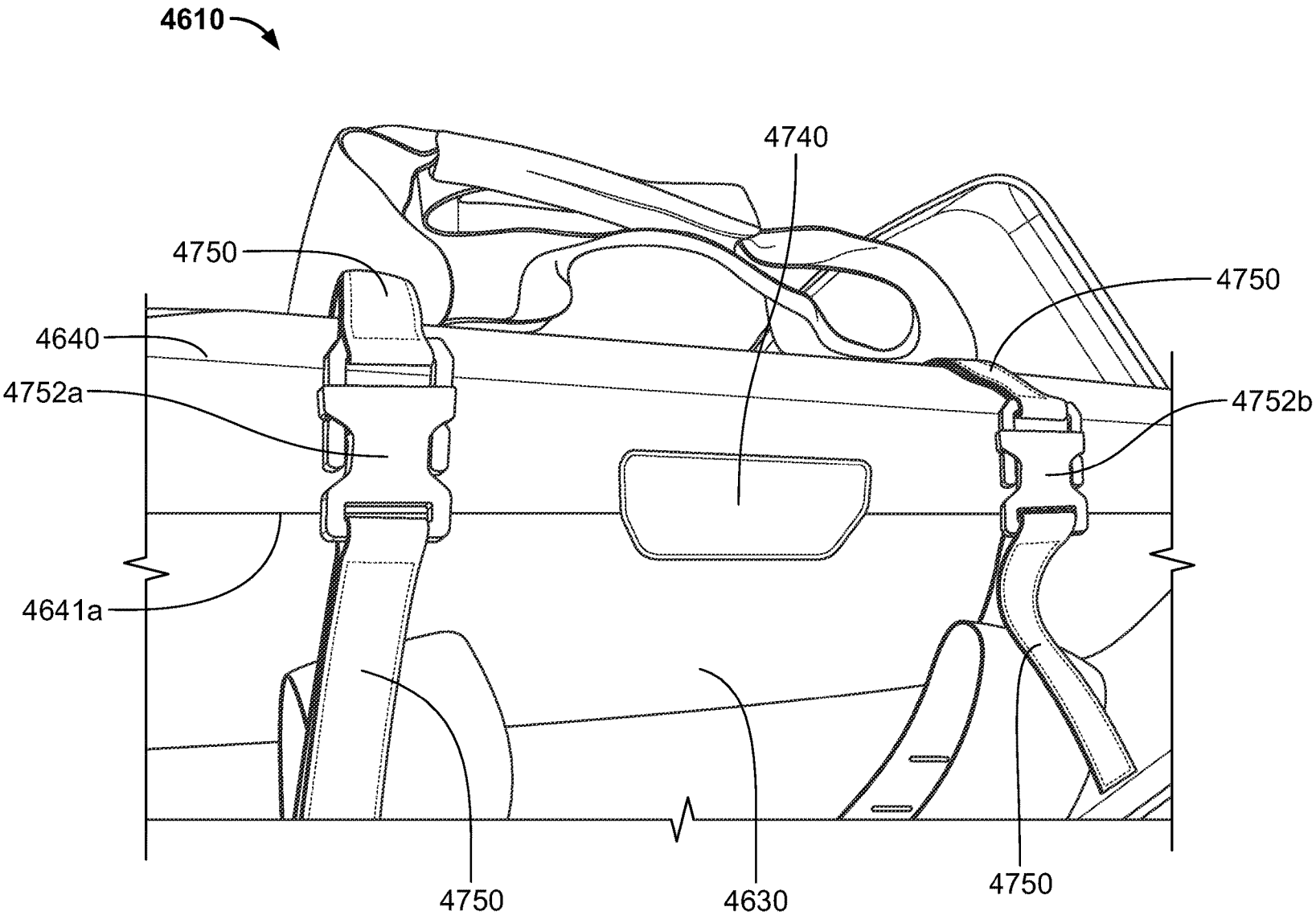
FIG. 55 depicts the insulating container of FIG. 46 with a placket flap portion in a folder configuration, according to one or more aspects described herein.

FIG. 55 depicts the insulating container 4610 with the placket flap portion 4640 in a folded configuration. In one example, the placket flap portion 4640 is held in the depicted folder configuration by buckles 4752*a* and 4752*b*, and straps 4750.

Figure 56B:
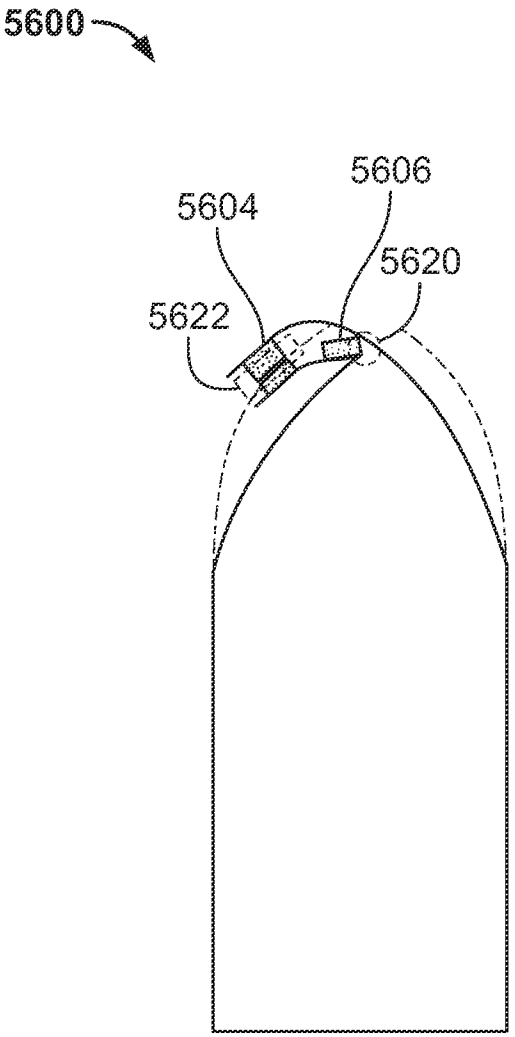
FIGS. 56A-B schematically depict cross-sectional views of an insulating container in respective unfolded and folded configurations, according to one or more aspects described herein.
Figure 56A:
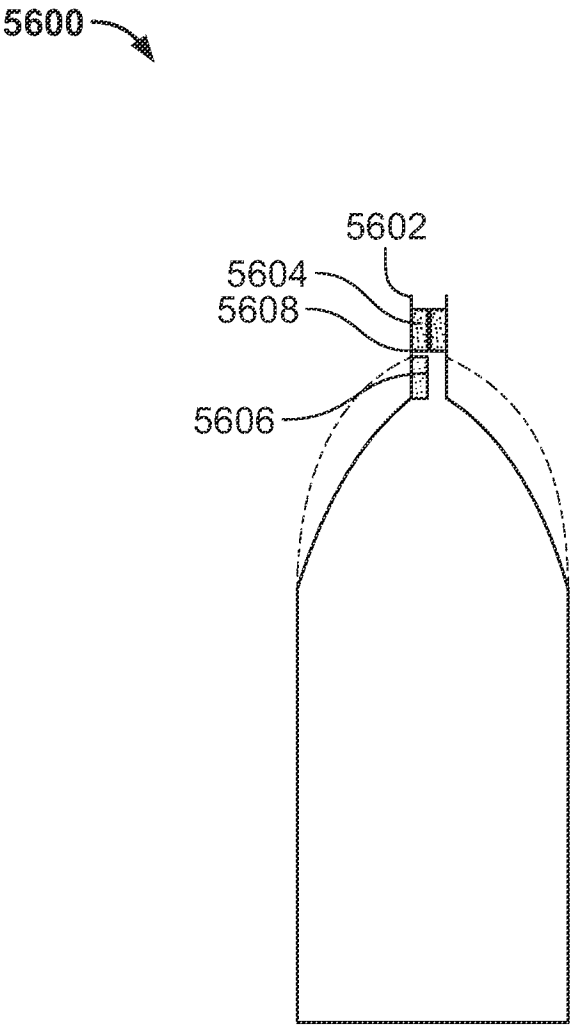

FIGS. 56A-B schematically depict cross-sectional views of an insulating container 5600 in respective unfolded and folded configurations. The insulating container 5600 is similar to the insulating container 4610, and includes an opening 5602 that is resealably sealed by a magnetic closure 5604 similar to the magnetic closure described in relation to the insulating container 4610. Further, this magnetic closure 5604 may be similar to the magnetic closure described in relation to FIG. 13D. The reinforcement board 5606 may be similar to the reinforcement board 4902. Accordingly, the reinforcement board 5606 creates a fold line about which the placket flap portion 5608 is configured to fold. As such, the placket flap portion 5608 may be similar to the placket flap portion 4640. FIG. 56B schematically depicts the insulating container 5600 in a folder configuration, and indicates where the reinforcement board 5606 creates a secondary seal at position 5620 that may further enhance the watertight and/or airtight performance of the primary seal created by the magnetic closure 5604 at position 5622.

The primary seal of the insulating container 4610 created by the magnetic closure of the opening 4614 and the secondary seal created by the folding of the placket flap portion 4640 may combine to make the insulating container 4610 substantially water and/or airtight. In certain specific examples, the insulating container 4610 may be configured to retain water (ice and melted ice) without or with reduced leakage of water from the internal compartment 5012 through the opening 4614 and out to the external environment. In certain specific examples, the insulating container 4610 may be configured to be positioned on its side (e.g., front side 4630 or back side 4702) and/or positioned in a downward facing orientation (with opening 4614 facing downward) and the container may be configured to prevent or substantially reduce the egress of water held within the internal compartment 5012 when held in one of these positions for prolonged periods of time. In certain specific examples, the insulating container 4610 may be configured allow less than 5%, 2%, 1%, 0.5%, 0.1%, 0.05%, or 0.01% of the water (or water and ice combination) held within the internal compartment 5012 to leak out though the opening 4614 when the insulating container is held for at least 1 minute, 2 minutes, 5, minutes, 10 minutes, 15 minutes, 20 minutes, 25 minutes, 30 minutes, 35 minutes, 45 minutes, or 1 hour with the opening 4614 facing downward at an incline of: 90 degrees (i.e., upside down), 60 degrees, 45 degrees, 30 degrees, or 0 degrees (i.e., the container held on its side 4630 or 4702).

In one implementation, a container may include an outer shell formed from a water resistant material, which has a front portion, a back portion, side portions, and a base portion. The outer shell may also have an opening at a top of the container that extends into a storage compartment, and a closure mechanism. The closure mechanism may also include a first magnetic strip that is coupled to an internal surface of the front portion at a front edge of the opening. Additionally, the closure mechanism may include a second magnetic strip that is coupled to an internal surface of the back portion at a back edge of the opening. Further, the closure mechanism may include a flap portion that extends from the back portion above the back edge of the opening, with a first fastener element coupled to the flap portion. A second fastener element may be coupled to an external surface of the front portion. As such, the first magnetic strip may be magnetically attracted to the second magnetic strip to resealably seal the opening, and the outer shell may be configured to fold to removably couple the first fastener element to the second fastener element.

In one example, the first magnetic strip on the second magnetic strip may be hingedly coupled at the respective front and back edges of the opening.

In another example, at least one of the first magnetic strip and the second magnetic strip may be hingedly coupled at the respective front and back edges of the opening.

In yet another example the first fastener element may be removably coupled to the second fastener element by hook and loop fasteners.

Further, the first fastener element and the second fastener element may include magnets.

The container may additionally include an internal slip pocket coupled to an internal back surface of the back portion.

The container may additionally include an internal zip pocket coupled to an internal front surface of the front portion.

The container may additionally have straps coupled to the back portion of the outer shell, which may be utilized to removably couple the container to an external structure. In one example, the external structure may be an insulating container.

In another example, the container may be constructed from two or more sub-panels that are welded together. E.g. by RF welding.

In another implementation, a container may include a front shell, a front frame extending around an internal perimeter of the front shell, a back shell, a back frame extending around an internal perimeter of the back shell, and hingedly coupled to the front frame at a bottom surface. The container may also include a closure mechanism configured to resealably seal the back shell to the front shell. The closure mechanism may additionally include a front magnetic strip extending around at least a first portion of the front frame, and a back magnetic strip extending around at least a first portion of the back frame. Additionally, the closure mechanism may include a zipper that extends around at least a second portion of the front frame and a second portion of the back frame.

In one example, the front frame and the back frame may be constructed from one or more elastomers.

In another example, the front and back magnetic strips may be encapsulated within channels within the respective front and back frames.

In yet another example, the closure mechanism may also include a zipper trough formed when the front magnetic strip is magnetically coupled to the back magnetic strip.

The zipper may also include a zipper tape that is stretchable he coupled to at least the second portion of the front frame and the second portion of the back frame.

Further, when the zipper is closed, the stretchable coupling of the zipper tape to the at least the second portion of the front frame and the second portion of the back frame may exert a compressive force that urges the front magnetic strip and the back magnetic strip toward one another.

In another example, at least one of the front shell the back shell have two or more sub-panels that are welded together.

The container may also include a pull-tab that is configured to provide a grip surface to manually uncouple the front magnetic strip from the back magnetic strip.

Additionally, the front magnetic strip in the back magnetic strip may each have a plurality of magnetic elements.

In one implementation, a container may include an outer shell formed from a water-resistant material, and having a front portion, a back portion, side portions, and a base portion. The outer shell may further include an opening at a top of the container that extends into a storage compartment. The opening may have a substantially rectilinear geometry when fully open, with a front, a back, a first side, and a second side. The container may also include a closure mechanism that has a folding magnetic collar that may be folded between an open configuration and a closed configuration to seal the opening.

The folding magnetic collar may have a front collar member that extends, linearly or otherwise, between a first end and a second end of the front of the opening. The front collar member they also have a projection that extends toward the back of the opening, and a first magnetic surface that faces the back of the opening. The front collar member may also have a second magnetic surface that is spaced apart from a third magnetic surface by the projection. The folding magnetic collar may additionally include a back collar member that extends, linearly or otherwise, between a first end and a second end of the back of the opening. The back collar member may have a projection that extends toward the front of the opening, and a first magnetic surface that faces the front of the opening. The back collar member I also have a second magnetic surface spaced apart from a third magnetic surface by the projection.

Additionally, the folding magnetic collar may have a first side collar member that extends along the first side of the opening, and hinged to the first end of the front collar member and to the first end of the back collar member. The first side collar member may also include a center hinge that separates a first magnetic element from a second magnetic element. A second side collar member may extend along the second side of the opening. The second side of the opening may be hinged to the second end of the front collar member and to the second end of the back collar member. The second side collar member may also include a center hinge that separates a first magnetic element from a second magnetic element.

When the opening is fully open, the front collar member, the back collar member, the first side collar member, and the second side collar member may be positioned in a substantially rectilinear configuration. When folded, the center hinge of the first side collar member may hinge the first and second magnetic elements of the first side collar member into contact with one another. Additionally, the hinged attachment of the first side collar member to the first end of the front collar member and to the first end of the back collar member may hinge the first and second magnetic elements of the first side collar member into contact with the second magnetic surface of the front collar member and the second magnetic surface of the back collar member.

When folded, the center hinge of the second side collar member May hinge the first and second magnetic elements of the second side collar member into contact with one another, and the hinged attachment of the second side collar member to the second end of the front collar member and to the second end of the back collar member may hinge the first and second magnetic elements of the second side collar member into contact with the third magnetic surface of the front collar member and the third magnetic surface of the back collar member.

When folded, the center hinge of the first side collar member and the center hinge of the second side collar member may hinge the first magnetic surface and the second magnetic surface of the front collar member into contact with the respective first magnetic surface and second magnetic surface the of the back collar member.

In one example, the storage compartment of the container is an insulating container.

In another example, the storage compartment of the container includes an inner liner.

The container may include an insulating layer between the outer shell and an inner liner, with the insulating layer providing insulation for the storage compartment.

The insulating layer may float between the inner liner and the outer shell of the container.

The insulating layer may be attached to at least one of the inner liner and the outer shell.

The outer shell of the container may be made up of two or more sub-panels that are welded together.

The closure mechanism of the container may be substantially waterproof an airtight when positioned in a closed configuration.

In another implementation, a container may include an outer shell formed from a water-resistant material, and which has a front portion, a back portion, side portions, and a base portion. The outer shell may also have an opening at a top of the container extending into a storage compartment. The a container may also include a closure mechanism that has a first magnetic strip that extends along a longitudinal axis and attached to a first side of the opening, and the first magnetic strip may have a first magnet and a second magnet spaced apart along the longitudinal axis. The closure mechanism may also include a second magnetic strip that extends along a longitudinal axis. The second magnetic strip may have a first magnet and a second magnet spaced apart along the longitudinal axis. The closure mechanism may also include a rail that extends along a longitudinal axis and is coupled to a second side of the opening. The second magnetic strip may be slidably attached to the rail such that the second magnetic strip is slidable relative to the rail with the longitudinal axis of the second magnetic strip parallel to the longitudinal axis of the rail. The first and second magnets of the first magnetic strip may have respective first and second outer surfaces with opposite magnetic polarities. The first and second magnets of the second magnetic strip may have respective first and second outer surfaces with opposite magnetic polarities, such that the first and second outer surfaces of the first magnetic strip face the first and second outer surfaces of the second magnetic strip. When in a first configuration, the first and second magnets of the first magnetic strip may be magnetically attracted to the first and second magnets of the second magnetic strip. When the second magnetic strip is positioned in a second configuration relative to the first magnetic strip, the first and second magnets of the first magnetic strip may be aligned with magnets of a same polarity on the first magnetic strip to magnetically repel the second magnetic strip from the first magnetic strip.

In another example, the second magnetic strip may be movable relative to the first magnetic strip by a motion other than sliding, such as rotation, pivoting, folding, among others.

In one implementation, a container may include an outer shell formed from a water-resistant material, and which has a front portion, a back portion, side portions, and a base portion. The outer shell may also have an opening at a top of the container extending into a storage compartment. The container may also include a closure mechanism that has a first magnetic strip that is attached to an internal surface of the container on a first side of the opening. A second magnetic strip may have a second magnetic strip top side and a second magnetic strip bottom side, such that the second magnetic strip top side is attached to a second side of the opening, and the second magnetic strip bottom side is unattached to the outer shell. The closure mechanism may also include a third magnetic strip that has a third magnetic strip top side and a third magnetic strip bottom side, such that the third magnetic strip top side is coupled to the second side of the opening, and the third magnetic strip bottom side is unattached to the outer shell. The second magnetic strip may be configured to be magnetically attached to the first magnetic strip inside the compartment, and the third magnetic strip may be configured to be magnetically attached to the first magnetic strip on an external surface of the container.

In one implementation, a container may include an outer shell formed from a water-resistant material, and which has a front portion, a back portion, side portions, and a base portion. The outer shell may also have an opening at a top of the container extending into a storage compartment. The container may also include a closure mechanism that has a first magnetic strip that extends along a first longitudinal axis and is attached to a first side of the opening. The first magnetic strip may have a first outer surface with an undulating surface geometry. The closure mechanism may also include a second magnetic strip that extends along the first longitudinal axis, and the second magnetic strip may have a second outer surface with an undulating surface geometry complementary to, and configured to be magnetically attached to, the first outer surface of the first magnetic strip.

In one example, the first outer surface or the second outer surface may be magnetized.

In another example, the first outer surface of the second outer surface may include a non-magnetic outer shell material that are at least partially encapsulates a magnetic material.

In one implementation, a container may include an outer shell formed from a water-resistant material, and which has a front portion, a back portion, side portions, and a base portion. The outer shell may also have an opening at a top of the container extending into a storage compartment. The container may also include a closure mechanism that has a first magnetic strip attached to an internal surface of the front portion at a front edge of the opening. The closure mechanism may also include a second magnetic strip that is attached to an internal surface of the back portion at a back edge of the opening. Additionally, a third magnetic strip may be attached to a flap portion that extends from the back portion above the back edge of the opening. Further, magnetic panel may be attached to an external surface of the front portion. The first magnetic strip may be magnetically attracted to the second magnetic strip and the third magnetic strip may be magnetically attracted to the magnetic panel to resealably seal the opening. The outer shell may be configured to fold to removably couple the third magnetic element to the magnetic panel.

In one implementation, a container may include an outer shell defining a first sidewall, an inner liner forming a storage compartment, an insulating layer positioned in between the outer shell and the inner liner, and an opening that allows access to the storage compartment. The container may also include a closure that seals the opening. The closure may be substantially waterproof when the container is in any orientation. The closure may include a lid assembly that has a handle and a reinforcement layer that is more rigid than the inner liner, the insulating layer, and the outer shell. The closure may also include an outer closure mechanism that extends around at least a portion of the lid assembly and an upper edge of the opening. The closure may also include an inner closure mechanism that has an upper magnetic strip extending along at least a portion of the lid assembly, and a lower magnetic strip that extends along at least a portion of the upper edge of the opening.

The outer shell of the container may also include a second sidewall and a third sidewall, and the opening may extend through the first sidewall, the second sidewall, and the third sidewall.

The container may be shaped in the form of a cuboid.

The inner liner and the outer shell of the container may form a joint that includes a vent for gases.

The outer shell of the container may include one or more handles, and a vent may be formed adjacent to a location of the one or more handles.

The closure of the container may be substantially waterproof and resist liquid from exiting the opening when the insulating device is filled completely with water and is dropped from a distance of six feet.

The outer shell of the container may define a bottom wall extending in a first plane, and such that the inner liner is secured to the outer shell in a second plane that is perpendicular to the first plane.

The inner liner may be formed from a first piece and a second piece, and the first piece may be joined to the second piece by a weld that defines a seam. The seam may be covered with a seam tape.

The inner liner of the container may be formed by injection molding.

The outer closure mechanism may be a zipper that includes a zipper pull. The zipper may be substantially waterproof.

The container may also include a body assembly.

The lid assembly and the body assembly may form the inner liner, the insulating layer, and the outer shell of the container.

The lid assembly may include at least a portion of the insulating layer of the container.

The insulating layer may float between the inner liner and the outer shell.

The insulating layer may be attached to the inner liner or the outer shell.

In one example, a container may include an outer shell that is formed from a water-resistant material and includes a front portion, a back portion, side portions, and a base portion. The outer shell may additionally include a series of webbing loops that are attached to an outer surface of the front portion. The outer shell may additionally include an opening at a top of the container that extends into a storage compartment. The opening may have a substantially rectilinear geometry when fully open. In alternative implementations, the opening may have other geometries, or a combination of geometries. For example, the opening may be implemented with a circular, elliptical, oval, triangular, pentagonal, hexagonal, heptagonal, and/or octagonal opening geometry. It is further contemplated that the opening may be implemented with any polygonal geometry. The opening may additionally or alternatively be described as having a curvilinear geometry, and the geometry of opening (or geometries of other elements of the container) may be deformable from one shape into one or more different shapes. The opening may thereby have a front, a back, a first side, and a second side. The outer shell may additionally have a closure mechanism that is configured to close the opening into the storage compartment. Accordingly, the closure mechanism may include a flap that extends from the back portion of the outer shell above the opening. The closure mechanism may also include a hook fastener element that is attached to and may rotate relative to the flap. The hook fastener element may be configured to be removably attached to a webbing loop from a series of webbing loops that are attached to the front portion of the outer shell. The closure mechanism may additionally include a folding magnetic collar that is designed to be folded between an open configuration and a closed configuration. The folding magnetic collar may seal the opening. The folding magnetic collar may additionally include a front collar member that extends between a first end and a second end of the front of the opening. The front collar member may have a magnetic surface that faces the back of the opening. The folding magnetic collar may also include a back collar member that extends between the first end and a second end of the back of the opening, with the back collar member having a magnetic surface that faces the front of the opening. The folding magnetic collar may also include a first side collar member that extends along the first side of the opening and is hingedly attached to the first end of the front collar member and to the first end of the back collar member. The first side collar member may also include a center hinge that separates a first magnetic element from a second magnetic element. The folding magnetic collar may also include a second side collar member that extends along the second side of the opening and is hingedly attached to the second end of the front collar member and to the second end of the back collar member. The second side collar member may also include a center hinge that separates a first magnetic element from a second magnetic element. When the opening is fully open, the front collar member, the back collar member, and the first and second side collar members may be positioned in a substantially rectilinear configuration. In alternative implementations, the opening, when fully open, may have other geometries, or a combination of geometries. For example, the opening may be implemented with a circular, elliptical, oval, triangular, pentagonal, hexagonal, heptagonal, and/or octagonal opening geometry. It is further contemplated that the opening may be implemented with any polygonal geometry. The opening may additionally or alternatively be described as having a curvilinear geometry, and the geometry of opening (or geometries of other elements of the container) may be deformable from one shape into one or more different shapes. When folded, the center hinge of the first side collar member hinges and the first and second magnetic elements of the first side collar member may be brought into contact with one another. Similarly, when folded, the center hinge of the second side collar member hinges and the first and second magnetic elements of the second side collar member may be brought into contact with one another. When the center hinge of the first side collar and the center hinge of the second side collar are folded, the magnetic surface of the front collar member is brought into contact with and magnetically coupled to the magnetic surface of the back collar member.

In one example, a container may include an outer shell that is formed from a water-resistant material and includes a front portion, a back portion, side portions, and a base portion. The outer shell may additionally include an opening at a top of the container that extends into a storage compartment. The opening may have a substantially rectilinear geometry when fully open. In alternative implementations, the opening, when fully open, may have other geometries, or a combination of geometries. For example, the opening may be implemented with a circular, elliptical, oval, triangular, pentagonal, hexagonal, heptagonal, and/or octagonal opening geometry. It is further contemplated that the opening may be implemented with any polygonal geometry. The opening may additionally or alternatively be described as having a curvilinear geometry, and the geometry of opening (or geometries of other elements of the container) may be deformable from one shape into one or more different shapes. The opening may thereby have a front, a back, a first side, and a second side. The outer shell may additionally have a closure mechanism that is configured to close the opening into the storage compartment. Accordingly, the closure mechanism may include a folding magnetic collar that is designed to be folded between an open configuration and a closed configuration. The folding magnetic collar may seal the opening. The folding magnetic collar may additionally include a front collar member that extends between a first end and a second end of the front of the opening. The front collar member may have a magnetic surface that faces the back of the opening. The folding magnetic collar may also include a back collar member that extends between the first end and a second end of the back of the opening, with the back collar member having a magnetic surface that faces the front of the opening. The folding magnetic collar may also include a first side collar member that extends along the first side of the opening and is hingedly attached to the first end of the front collar member and to the first end of the back collar member. The first side collar member may also include a center hinge that separates a first magnetic surface from a second magnetic surface. The folding magnetic collar may also include a second side collar member that extends along the second side of the opening and is hingedly attached to the second end of the front collar member and to the second end of the back collar member. The second side collar member may also include a center hinge that separates a first magnetic surface from a second magnetic surface.

When the opening is fully open, the front collar member, the back collar member, and the first and second side collar members may be positioned in a substantially rectilinear configuration. In alternative implementations, the opening, when fully open, may have other geometries, or a combination of geometries. For example, the opening may be implemented with a circular, elliptical, oval, triangular, pentagonal, hexagonal, heptagonal, and/or octagonal opening geometry. It is further contemplated that the opening may be implemented with any polygonal geometry. The opening may additionally or alternatively be described as having a curvilinear geometry, and the geometry of opening (or geometries of other elements of the container) may be deformable from one shape into one or more different shapes. When folded, the center hinge of the first side collar member hinges and the first and second magnetic surfaces of the first side collar member may be brought into contact with one another. Similarly, when folded, the center hinge of the second side collar member hinges and the first and second magnetic surfaces of the second side collar member may be brought into contact with one another. When the center hinge of the first side collar and the center hinge of the second side collar are folded, the magnetic surface of the front collar member may be brought into contact with and magnetically coupled to the magnetic surface of the back collar member.

In one example, an insulating container may include an outer shell that defines a side wall and a base. The outer shell may have a front portion, back portion, side portions, and a base portion. The insulating container may additionally include an inner liner that forms a storage compartment, with the inner liner having a front portion and a rear portion. An insulating layer may be positioned in between the outer shell and the inner liner, with the insulating layer providing insulation for the storage compartment. An opening at a top of the container may extend into the storage compartment, with the opening having a front side, and a back side. The insulating container may also have a placket flap portion that extends between a top of the outer shell and the opening. The placket flap portion may further have an internal reinforcement bore that extends along at least a portion of the placket flap portion is configured to define the line along which the placket flap is folded. The insulating container may also include a closure mechanism. This closure mechanism may include a first magnetic strip that has a first magnetic strip top edge and a first magnetic strip bottom edge, with the first magnetic strip top edge attached to a front side of the opening and the first magnetic strip bottom edge extending into the storage compartment and unattached to the inner liner. The closure mechanism may additionally include a second magnetic strip that has a second magnetic strip top edge and a second magnetic strip bottom edge, such that the second magnetic strip top edge is coupled to the back side of the opening and the second magnetic strip bottom edge extends into the storage compartment and is unattached to the inner liner. The first magnetic strip is configured to be magnetically coupled to the second magnetic strip to resealably seal the opening. The placket flap portion, when folded, may be configured to provide a secondary seal of the opening.

In another example, the placket flap portion is formed from a same material as the outer shell.

The placket flap portion may be retained in a folder position by buckles that are coupled to the front portion and the back portion of the outer shell.

The placket flap portion may be retained in a folder position by magnets embedded in the sidewalls of the placket flap portion.

The placket flap portion may be retained in a folder position by a magnetic cleat that is attached to an area of the placket flap portion and to an area on the outer shell.

The placket flap portion may be retained in a folder position by hook and loop fasteners.

The first magnetic strip and the second magnetic strip may be hingedly coupled to the respective front and back sides of the opening.

The outer shell may include two or more sub-panels that are welded together.

The insulating container may additionally include a pull tab that is attached to at least one of the first and second magnetic strips.

The insulating container, when the opening is sealed by the magnetic strip and the folded placket flap, is configured to allow less than 0.1% of a liquid stored within the storage compartment to leak out when the insulating containers held in an upside down orientation for 15 minutes.

The insulating container, when the opening is sealed by the magnetic strip and the folded placket flap, is configured to allow less than 0.01% of a liquid stored within the storage compartment to leak out when the insulating containers held in an upside down orientation for 15 minutes.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

We claim:

1. A container, comprising:

an outer shell formed from a water-resistant material, and having a front portion, a back portion, side portions, and a base portion, the outer shell further comprising:

an opening at a top of the container extending into a storage compartment;

a closure mechanism, further comprising:

a first magnetic strip extending along and coupled to an internal surface of the front portion at a front edge of the opening;

a second magnetic strip extending along and coupled to an internal surface of the back portion at a back edge of the opening, wherein at least one of the first magnetic strip and the second magnet strip comprises a row of circular magnetic elements spaced apart along a flexible polymer strip, and wherein the row of circular magnetic elements is visible when the opening is in an open configuration;

a flap portion extending from the back portion above the back edge of the opening, the flap portion having a first fastener element;

a second fastener element coupled to an external surface of the front portion;

wherein the first magnetic strip is magnetically attracted to the second magnetic strip to resealably seal the opening, wherein the outer shell is configured to fold to removably couple the first fastener element to the second fastener element.

2. The container of claim 1, wherein the first fastener element is configured to be removably coupled to the second fastener element by hook and loop fasteners.

3. The container of claim 1, further comprising an inner liner forming the storage compartment, the inner liner having a front portion and a rear portion.

4. The container of claim 3, further comprising an insulating layer positioned in between the outer shell and the inner liner, the insulating layer providing insulation for the storage compartment.

5. The container of claim 1, wherein the outer shell comprises two or more sub-panels that are welded together.

6. The container of claim 1, further comprising a pull tab coupled to the front edge of the opening.

7. The container of claim 1, further comprising a zip pocket integrated into the front portion of the outer shell.

8. The container of claim 1, further comprising straps coupled to the outer shell, and configured to removably couple the container to an external structure.

9. The container of claim 1 wherein the closure is configured to maintain an airtight seal as a 5 kg mass is positioned on the back portion of the container while the container contains only air.

10. An insulating container, comprising:

an outer shell defining a sidewall and a base, the outer shell having a front portion, a back portion, side portions, and a base portion;

an inner liner forming a storage compartment, the inner liner having a front portion and a rear portion;

an insulating layer positioned in between the outer shell and the inner liner, the insulating layer providing insulation for the storage compartment;

an opening at a top of the container extending into the storage compartment, the opening having a front side and a back side;

placket flap portion extending between a top of the outer shell and the opening;

a closure mechanism, further comprising:

a first magnetic strip extending along and coupled to the front side of the opening; and a second magnetic strip extending along and coupled to the back side of the opening, wherein at least one of the first magnetic strip and the second magnet strip comprises a row of circular magnetic elements spaced apart along a flexible polymer strip, and wherein the row of circular magnetic elements is visible when the opening is in an open configuration, wherein the first magnetic strip is configured to be magnetically coupled to the second magnetic strip to resealably seal the opening, and wherein the placket flap portion, when folded, is configured to provide a secondary seal of the opening.

11. The insulating container of claim 10, wherein the placket flap portion is retained in a folded position by hook and loop fasteners.

12. The insulating container of claim 10, wherein the outer shell comprises two or more sub-panels that are welded together.

13. The insulating container of claim 10, further comprising a pull tab coupled to the front side of the opening.

14. The insulating container of claim 10, further comprising a zip pocket integrated into the front portion of the outer shell.

15. The insulating container of claim 10, further comprising straps coupled to the outer shell, and configured to removably couple the insulating container to an external structure.

16. The insulating container of claim 10, wherein when the opening is sealed by the magnetic strip and the folded placket flap portion, the opening allows less than 0.5% of a liquid held within the storage compartment to leak out when the insulating container is held in an upside down orientation for at least 10 minutes.

* * * * *